US005548390A

United States Patent [19]

Sugisaki et al.

[11] Patent Number: 5,548,390

[45] Date of Patent: Aug. 20, 1996

[54] DOUBLE-SIDED PRINTING SYSTEM FOR CONTINUOUS FORMS

[75] Inventors: Eiichi Sugisaki, Kawasaki; Mitsuhiro Ino, Yokohama; Masato Nagayama, Kawasaki, all of Japan

[73] Assignee: Fujitsu Limited, Kanagawa, Japan

[21] Appl. No.: 353,126

[22] Filed: Dec. 9, 1994

[30] Foreign Application Priority Data

Jan. 10, 1994 [JP] Japan ..... 6-000866
Oct. 26, 1994 [JP] Japan ..... 6-262257

[51] Int. Cl.[6] ..... G03G 21/00

[52] U.S. Cl. ..... 355/319; 355/309

[58] Field of Search ..... 355/200, 202, 355/208, 308, 309, 316, 317, 318, 319, 320; 358/296, 300

[56] References Cited

U.S. PATENT DOCUMENTS

| | | | |
|---|---|---|---|
| 4,410,897 | 10/1983 | Moriguchi et al. . | |
| 4,586,812 | 5/1986 | Kaneko et al. | 355/319 X |
| 4,591,884 | 5/1986 | Miyamoto et al. | 355/319 X |
| 4,657,164 | 4/1987 | Felix . | |
| 4,855,790 | 8/1989 | Suzuki | 355/208 X |
| 4,958,187 | 9/1990 | Tsuchiya et al. | 355/202 |
| 4,972,236 | 11/1990 | Hasegawa | 355/319 |
| 5,115,281 | 5/1992 | Ohtsuka et al. | 355/319 |
| 5,150,167 | 9/1992 | Gonda et al. | 355/200 X |
| 5,179,417 | 1/1993 | Sugaya et al. | 355/319 |
| 5,253,028 | 10/1993 | Gonda et al. | 355/309 |

FOREIGN PATENT DOCUMENTS

| | | |
|---|---|---|
| 0154695 | 9/1985 | European Pat. Off. . |
| 3152105 | 8/1982 | Germany . |
| 4213245 | 10/1992 | Germany . |
| 56-45967 | 4/1981 | Japan . |
| 56-99585 | 8/1981 | Japan . |
| 57-144780 | 9/1982 | Japan . |
| 58-51172 | 3/1983 | Japan . |
| 58-160155 | 9/1983 | Japan . |
| 59-29183 | 2/1984 | Japan . |
| 92/15513 | 9/1992 | WIPO . |

OTHER PUBLICATIONS

Ossman "Color Printer Employing Fiducial Mark for Registration Correction", Xerox Disclosure Journal, vol. 18, No. 3, pp. 257–259.

IBM Technical Disclosure Bulletin, "Duplex Continuous--Form Printing", vol. 33, No. 7, pp. 240–241.

*Primary Examiner*—Sandra L. Brase

[57] ABSTRACT

An intermediate buffer device for absorbing the difference in paper feeding speed between first and second printers is disposed therebetween. The first printer prints on a first surface of continuous forms in accordance with the top-surface printing data input from a host apparatus, and the second printer prints on the second surface of continuous forms in accordance with the back-surface printing data input from a host apparatus. A detecting portion detects the amount of retention in the intermediate buffer device. A printer controller stops printing and paper feeding by the second printer when the amount of retention falls below a first set value L1 and stops paper feeding and printing by the first printer when the amount of retention exceeds a second set value L2.

34 Claims, 39 Drawing Sheets

FIRST PRINTER

SECOND PRINTER

DOUBLE-SIDED PRINTING SYSTEM FOR CONTINUOUS FORMS

BACKGROUND OF THE INVENTION

The present invention relates to a double-sided printing system for continuous forms and, more particularly, to a double-sided printing system for continuous forms for printing on both sides of continuous forms by sequentially operating two printers and a double-sided printing system for continuous forms for printing on both sides of continuous forms by sequentially operating two printing mechanisms which are provided within the system.

A printing apparatus using continuous forms as a printing medium is advantageous in that since the paper is fed by tractors provided with pins which engage the holes formed along both side edges of a form, no paper jam is caused during feeding and in that the paper is easily accommodated in a stacker.

If such continuous forms are printed on both sides, the paper can be very efficiently used. For this reason, printing apparatuses for printing on both sides of continuous forms have conventionally been proposed (e.g., Japanese Patent Laid-Open No. 99585/1981).

FIG. 39 shows the structure of the above-described conventional double-sided printing apparatus. In FIG. 39, the reference numeral 1 represents a printing controller and 2 printing portion. In the printing controller 1, the reference numeral 1*a* represents an interface portion for receiving printing data (top-surface printing data and back-surface printing data) such as character codes which are to be printed on both sides of continuous forms CF, from a host apparatus, 1*b* an converting portion for converting the top-surface printing data and back-surface printing data into dot printing image data for each page, 1*c* a switch, 1*d* and 1*e* first and second memories for storing printing image data which are to be printed on the top surface and the back surface, respectively, of each page, 1*f* and 1*g* reading portions for reading the printing image data from the first and second memories, respectively, and outputting the read data to first and second image forming portions 3*a* and 3*b*.

In the printing portion 2, the reference numerals 3*a*, 3*b* denote electrophotography type image forming portions, 4 a hopper for supplying the continuous forms CF, 5 a stacker for accommodating the printed continuous forms CF in a folded state, 6*a*, 6*b* tractors for feeding the continuous forms CF while engaging the holes formed along both side edges of the continuous forms CF with the pins provided on the outer peripheries of the tractors, 7*a*, 7*b* heat fixing rollers, and 8 paper feed rollers. In the image forming portions 3*a*, 3*b*, the reference numeral $\mathbf{3}_1$ represents a photosensitive drum which has a photoconductive material (photosensitive material) on the surface and which rotates at a constant rate in the direction indicated by the arrow A. The radius of the photosensitive drum $\mathbf{3}_1$ of the image forming portion 3*b* is much larger than the radius of the photosensitive drum $\mathbf{3}_1$ of the image forming portion 3*a*. This is in order to enable the second image forming portion 3*b* to print on the back surface of the paper which is printed by the first image forming portion 3*a*. More specifically, the radius of the photosensitive drum $\mathbf{3}_1$ of the second image forming portion 3*b* is determined so as to make it possible that when the back surface of the continuous forms fed after the top surface is printed by the first image forming portion 3*a* reaches the printing position of the second image forming portion 3*b*, the toner image produced on the photosensitive drum $\mathbf{3}_1$ of the second image forming portion 3*b* reaches exactly the printing position.

The reference numeral $\mathbf{3}_2$ denotes a pre-electrifier for uniformly electrifying the surface of the photosensitive drum $\mathbf{3}_1$, and $\mathbf{3}_3$ an electrostatic image forming portion for forming an electrostatic image on the photosensitive drum $\mathbf{3}_1$. The electrostatic image forming portion $\mathbf{3}_3$ has a pin electrode driving circuit $\mathbf{3}_{31}$ and a pin electrode $\mathbf{3}_{32}$. A multiplicity (corresponding to the width of the paper) of the pin electrodes $\mathbf{3}_{32}$ are provided in the longitudinal direction of the photosensitive drum $\mathbf{3}_1$. The reference numeral $\mathbf{3}_4$ represents a developing portion for developing an electrostatic image into a toner image, $\mathbf{3}_5$ a transferring electrifier for transferring the toner image to a continuous form CF, and $\mathbf{3}_6$ a cleaner for eliminating the toner remaining on the photosensitive drum $\mathbf{3}_1$ and cleaning the photosensitive drum $\mathbf{3}_1$. The position of the transferring electrifier $\mathbf{3}_5$ is the printing position.

When a negative voltage is applied by the pin electrodes $\mathbf{3}_{32}$ to the surface of the photosensitive drum $\mathbf{3}_1$ which has been uniformly positively, for example, electrified by the pre-electrifier $\mathbf{3}_2$, the charges at that position are eliminated. Therefore, when a negative voltage is applied to the pin electrodes $\mathbf{3}_{32}$ of the first and second image forming portions 3*a*, 3*b* on the basis of the dot image data, and the photosensitive drums $\mathbf{3}_1$ are rotated, the latent images corresponding to the image to be printed are formed on the surfaces of the photosensitive drums $\mathbf{3}_1$. Thereafter, the developing portions $\mathbf{3}_4$ apply positively charged toner to the surfaces of the photosensitive drums $\mathbf{3}_1$, so that the toner moves onto the electrostatic latent images. When the transferring electrifiers $\mathbf{3}_5$ conduct corona discharge on the back surface of the continuous forms CF at a potential of the opposite (negative) polarity to that of the electrified toner images, the toner images are transferred to the continuous forms CF. The continuous forms CF with the toner images transferred by the transferring electrifiers $\mathbf{3}_5$ are carried to the fixing rollers 7*a*, 7*b* so as to be heat-fixed.

The continuous forms CF are stored in the hopper 4 in a folded state, and they are fed from the hopper 4 in the direction indicated by the arrow B and stored in the stacker 5 in a folded state with the rotation of the tractors 6*a*, 6*b*. The printing controller 1 simultaneously inputs the printing image data for the top surface and the back surface so as to simultaneously form the electrostatic latent images on the photosensitive drums $\mathbf{3}_1$. Since the radii of the photosensitive drums $\mathbf{3}_1$ of the first and second image forming portions 3*a*, 3*b* are different, the transferring electrifier $\mathbf{3}_5$ of the first image forming portion 3*a* first prints on the back surface of the continuous form CF, and the transferring electrifier $\mathbf{3}_5$ of the second image forming portion 3*b* then prints on the top surface of the continuous form CF when the continuous form CF is carried to the transferring electrifier $\mathbf{3}_5$ and the printing position thereof reaches the transferring electrifier $\mathbf{3}_5$. This operation is repeated henceforth, thereby printing continuous forms CF on both sides of the continuous forms CF.

For the purpose of such double-sided printing, it is conventionally necessary to newly purchase an expensive double-sided printing apparatus even if there are already a plurality of single-side printing apparatuses. Accordingly, if it is possible to construct a double-sided printing system by using two single-side printing apparatus, it is advantageous in points of cost and space. Such a double-sided printing system can conveniently be used as two single-side printing apparatuses and as one double-sided printing apparatus as occasion demands.

In addition, in the above-described conventional double-sided printing apparatus, it is necessary to make the diameter of the photosensitive drum $3_1$ of the second image forming portion 3b much larger than that of the photosensitive drum $3_1$ of the first image forming portion 3a, which results in an increase in the size and the cost of the printing apparatus.

SUMMARY OF THE INVENTION

Accordingly, it is a first object of the present invention to eliminate the above-described problems in the related art and to provide a double-sided printing system for continuous forms which can print on both sides of continuous forms by sequentially operating two printers.

It is a second object of the present invention to provide a double-sided printing system which can constantly keep an appropriate amount of sag in the continuous forms between both printers by absorbing the difference in printing speed, namely, the paper feeding speed between both printers.

It is a third object of the present invention to provide a double-sided printing system which enables a second printer to print on the back surface of a form exactly at the portion printed by a first printer.

It is a fourth object of the present invention to provide a double-sided printing system which enables one printer to monitor the state of the other printer so as to enable both printers to simultaneously initiate and stop printing.

It is a fifth object of the present invention to provide a double-sided printing apparatus in which the photosensitive drums of the first and second image forming portions have the same size.

It is a sixth object of the present invention to provide a double-sided printing apparatus which solves the problems conventionally caused when the photosensitive drums in the first and second image forming portions have the same size.

To achieve the first to fourth objects, in a first aspect of the present invention there is provided a double-sided printing system for continuous forms comprising: a first printer for printing on one side (first surface) of continuous forms; a second printer provided at a subsequent stage to the first printer in the direction of paper feeding so as to print on the other side (second surface) of the continuous forms; a host apparatus for transferring printing data which are to be printed on the first and second surfaces to the first and second printers, respectively; an intermediate buffer device provided between the first and second printers so as to absorb the difference in paper feeding speed between the first and second printers; a detecting portion provided in the intermediate buffer device so as to detect the amount of retention of the continuous forms in the intermediate buffer device; and a controlling means for stopping printing and paper feeding by the second printer when the amount of retention of the continuous forms falls below a first set value, resuming printing and paper feeding by the second printer when the amount of retention of the continuous forms becomes not less than a predetermined value, stopping paper feeding and printing by the first printer when the amount of retention of the continuous forms exceeds a second set value, resuming printing and paper feeding by the first printer when the amount of retention of the continuous forms becomes not more than a predetermined value.

To achieve the first and third objects, in a second aspect of the present invention there is provided a double-sided printing system for continuous forms comprising: a first counter for counting the amount of feed of the continuous forms on the first printer side after the continuous forms are loaded on the first printer; a second counter for counting the amount of feed of the continuous forms after the continuous forms are loaded on the second printer; and printing controllers which are provided in the first and second printers so as to be communicable to each other, wherein the printing controller of the first printer supplies the count value N of the first counter at the start of printing on the first surface to the printing controller of the second printer, and the printing controller of the second printer starts printing on the second surface when the count value of the second counter becomes equal to the supplied count value N.

To achieve the second object, in a third aspect of the present invention, there is provided a double-sided printing system for continuous forms which stops printing and paper feeding by the second printer when the difference ($[PC_A]-[PC_B]$) between the count value $[PC_A]$ of the first counter and the count value $[PC_B]$ of the second counter falls below the first set value, resumes printing and paper feeding by the second printer when the difference ($[PC_A]-[PC_B]$) becomes not less than a third set value which is larger than the first set value, stops printing and paper feeding by the first printer when the difference exceeds the second set value, and resumes printing and paper feeding by the first printer when the difference ($[PC_A]-[PC_B]$) becomes not more than a fourth set value which is smaller than the second set value.

To achieve the fourth and fifth objects, in a fourth aspect of the present invention there is provided a double-sided printing apparatus for continuous forms comprising: a first printing portion for printing on one side (first surface) of the continuous forms; a second printing portion for printing on the other side (second surface) of the continuous forms; a host apparatus for transferring printing data which are to be printed on the first surface and on the second surface to the first and second printing portions; and a printing controller for distributing the printing data to be printed on the first and second surfaces which are received from the host apparatus to the first and second printing portions, respectively; wherein the second printing portion includes a bit map memory for storing dot printing image data for N pages which are the number of pages of the continuous forms between the printing positions of the first and second printing portions, and the printing controller instructs the second printing portion to start printing on the second surface after the first printer prints N pages on the first surface of the continuous forms.

Other features and advantages of the present invention will be apparent from the following description taken in conjunction with the accompanying drawings.

DESCRIPTION OF THE PREFERRED EMBODIMENT

(A) SCHEMATIC EXPLANATION OF THE PRESENT INVENTION

(a) Schematic Explanation of First Embodiment

Figure 1:
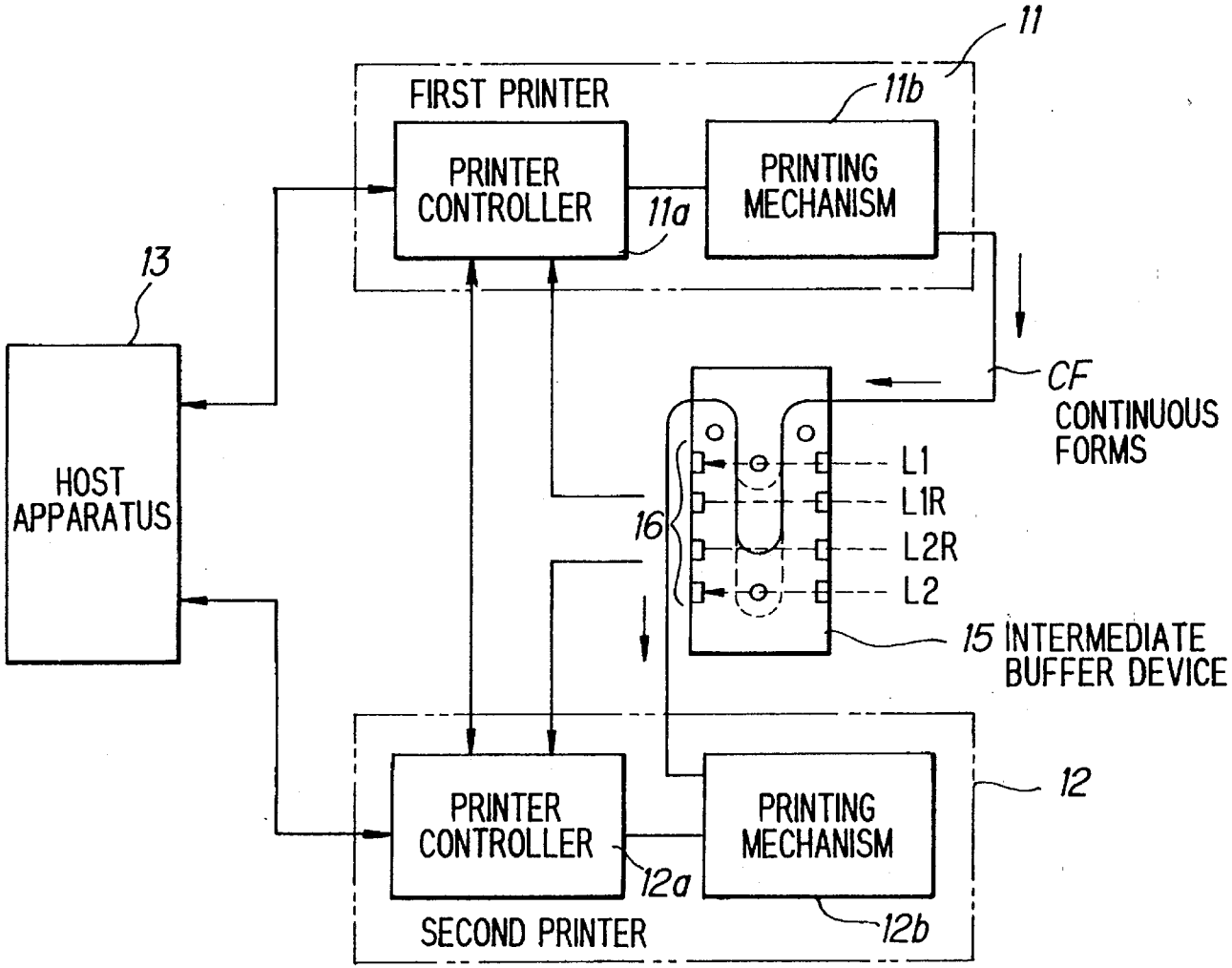
FIG. 1 schematically explains a first embodiment of the present invention.

FIG. 1 schematically explains a first embodiment of the present invention.

In FIG. 1, the reference numeral 11 represents a first printer for printing on one side (first surface) of continuous forms CF, 12 a second printer provided at a subsequent stage to the first printer 11 so as to print on the other side (second surface) of the continuous forms CF, 13 a host apparatus for transferring printing data to be printed on the first and second surfaces to the first and second printers 11 and 12, respectively, 15 an intermediate buffer device provided between the first and second printers 11, 12 so as to absorb the difference in paper feeding speed between the first and second printers 11 and 12, and 16 a detecting portion (e.g., light emitting/light receiving element) provided in the intermediate buffer device 15 so as to detect the amount of retention of the continuous forms CF in the intermediate buffer device 15. The reference numeral 11*a* denotes a printer controller for stopping printing and paper feeding by the first printer 11 when the amount of retention of the continuous forms CF exceeds a second set value L2, 12*a* a printer controller for stopping printing and paper feeding by the second printer 12 when the amount of retention of the continuous forms CF falls below a first set value L1, 11*b* a printing mechanism of the first printer 11 and 12*b* a printing mechanism of the second printer 12.

The intermediate buffer device 15 for absorbing the difference in paper feeding speed between the first and second printers 11 and 12 is provided between the first and second printers 11, 12. The first printer 11 prints on the first surface of the continuous forms CF on the basis of the top-surface printing data input from the host apparatus 13, and the second printer 12 prints on the second surface of the continuous forms CF on the basis of the back-surface printing data input from the host apparatus 13. The detecting portion 16 detects the amount of retention of the continuous forms CF in the intermediate buffer device 15, and the printer controller 12*a* stops printing and paper feeding by the second printer 12 when the amount of retention of the continuous forms CF falls below the first set value L1, while the printer controller 11*a* stops printing and paper feeding by the first printer 11 when the amount of retention of the continuous forms CF exceeds the second set value L2. The printer controller 12*a* also resumes paper feeding and printing by the second printer 12 when the amount of retention of the continuous forms CF becomes not less than a predetermined value (e.g., L1R), and the printer controller 11*a* also resumes printing and paper feeding by the first printer 11 when the amount of retention of the continuous forms CF becomes not more than a predetermined value (e.g., L2R).

In this way, it is easy to construct a double-sided printing system for printing on both sides of continuous forms by using two continuous form printers. In addition, it is possible to keep an appropriate amount of sag in the continuous forms between both printers by absorbing the difference in printing speed, namely, paper feeding speed between both printers, thereby preventing the paper from jamming and being cut. If a reversing mechanism for reversing the surface of the continuous forms CF is provided between the first and second printers 11, 12, printing on the second surface by the second printer 12 is facilitated.

If it is assumed that the number of pages of the continuous forms CF between the printing positions of the first and second printers 11, 12 is N, the host apparatus 13 adds blank data for N pages to the end of all the printing data which are to be printed on the first surface and supplies the total data to the first printer 11, and adds blank data for N pages to the beginning of all the printing data which are to be printed on the second surface and supplies the total data to the second printer 12. In this manner, it is possible to print by the second printer 12 on the back surface exactly at the portion printed by the first printer 11.

When a start switch is operated, one of the first and second printers 11, 12 informs the other of the fact so as to be ready for simultaneous printing. When a stop switch is operated during printing, one of the first and second printers 11, 12 informs the other of the fact so as to simultaneously stop printing. When printing becomes impossible in one of the first and second printers 11, 12 due to shortage of toner or the like, the printer informs the other printer of the fact so as to simultaneously stop printing. In this manner, the first and second printers 11, 12 can simultaneously start or stop printing.

(b) Schematic Explanation of Second Embodiment

Figure 2:
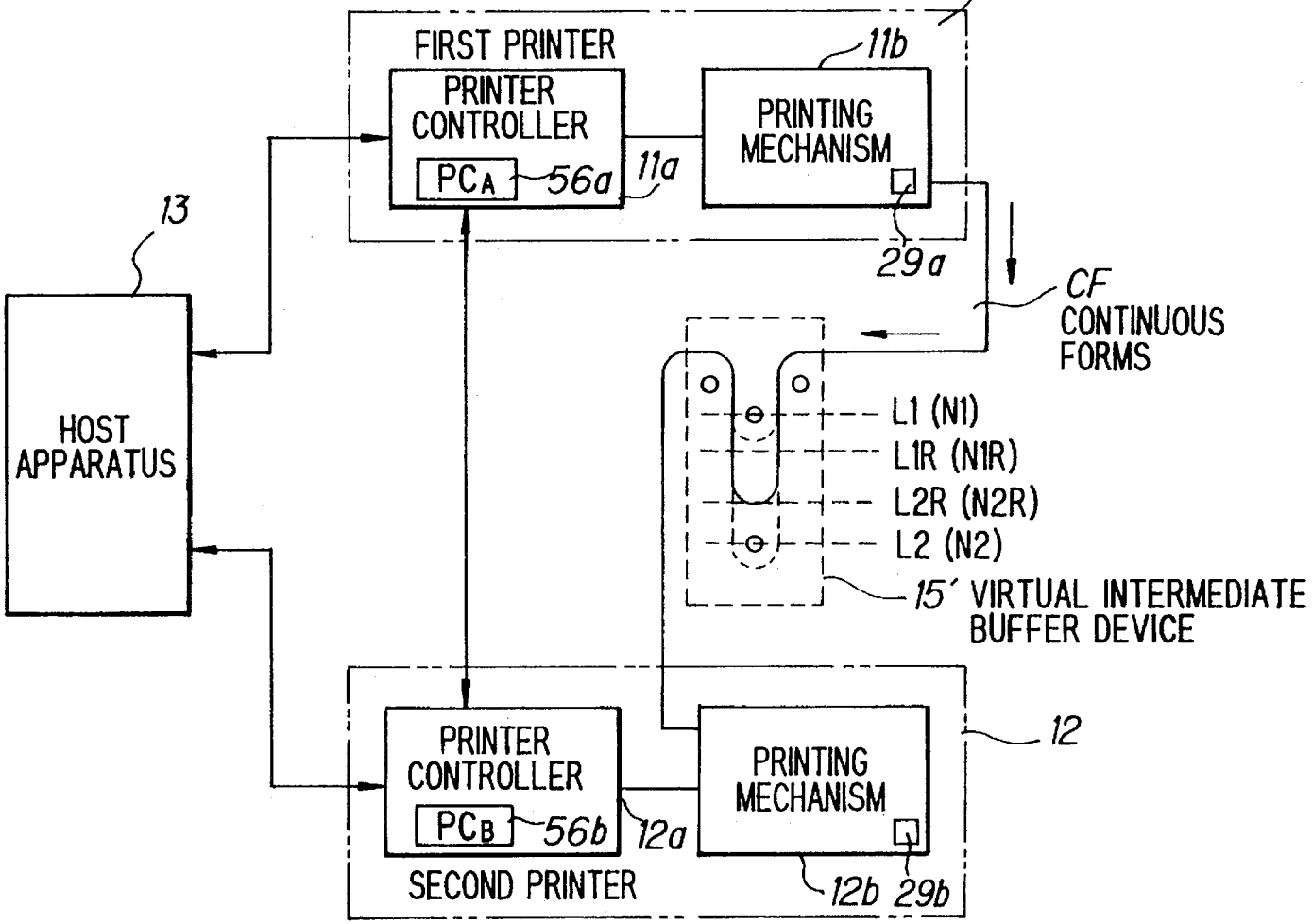
FIG. 2 schematically explains a second embodiment of the present invention.

FIG. 2 schematically explains a second embodiment of the present invention. The same reference numerals are provided for the elements which are the same as those shown in FIG. 1.

In FIG. 2, the reference numeral 56*a* denotes a counter ($PC_A$) for counting the amount of feed of the continuous forms CF on the first printer side after the continuous forms CF are loaded on the first printer 11, 56*b* a counter ($PC_B$) for counting the amount of feed of the continuous forms CF on the second printer side after the continuous forms CF are loaded on the second printer 12, and 29*a*, 29*b* a sensor for detecting the amount of feed in each of the first and second printers 11, 12.

The counter 56*a* ($PC_A$) of the first printer 11 counts the amount of feed of the continuous forms CF on the first printer side after the continuous forms CF are loaded on the first printer 11, and the counter 56*b* ($PC_B$) counts the amount of feed of the continuous forms CF on the second printer side after the continuous forms CF are loaded on the second printer 12. The printer controller 11*a* of the first printer 11 supplies the count value N of the counter $PC_A$ at the start of printing on the first surface, to the printer controller 12*a* of the second printer 12, and the printer controller 12*a* starts printing on the second surface when the count value of the counter $PC_B$ becomes equal to the supplied count value N. In this case, the printer controller 12*a* of the second printer feeds the continuous forms CF by the amount corresponding to the value n and increases the count value of the second counter $PC_B$ by n every time the count value of the counter $PC_A$ increases by n until the count value of the counter $PC_B$ becomes equal to the supplied count value N. In this way, it is possible to print accurately on the top surface and the back surface of the continuous forms CF.

When a double-sided print cancellation command for demanding single-side printing is issued from the host apparatus 13, the printer controller 12*a* of the second printer 12 feeds the continuous forms by the amount which corresponds to the count value n every time the count value of the counter $PC_A$ which is informed of by the first printer 11 increases by n. In this way, single-side printing is also enabled by the double-sided printing system.

The forms between the first and second printers 11, 12 are sagged and a virtual intermediate buffer device 15' (it does not actually exist but it is introduced for the convenience of explanation) for absorbing the difference in printing speed, namely, paper feeding speed between both printers is provided at the sagged portion. When the difference ($[PC_A]-[PC_B]$) between the count value $[PC_A]$ of the counter $PC_A$ and the count value $[PC_B]$ of the counter $PC_B$ falls below the first set value N1, printing and paper feeding by the second printer 12 is stopped. When the difference exceeds the second set value N2, paper feeding and printing by the first printer 11 is stopped. When printing and paper feeding by the second printer 12 is stopped because the difference ($[PC_A]-[PC_B]$) falls below the first set value N1, if the difference ($[PC_A]-[PC_B]$) becomes not less than a set value N1R which is larger than the first set value N1, printing and paper feeding by the second printer 12 is resumed. When printing and paper feeding by the first printer 11 is stopped because the difference ($[PC_A]-[PC_B]$) exceeds the second set value N2, if the difference ($[PC_A]-[PC_B]$) becomes not more than a set value N2R which is smaller than the second set value N2, printing and paper feeding by the first printer 11 is resumed. In this way, it is possible to constantly keep an appropriate amount of sag in the forms between both printers by absorbing the difference in printing speed, namely, paper feeding speed between both printers, thereby preventing the paper from Jamming and being cut. In addition, the amount of sag can be recognized on the basis of the signal which is output from the sensor 29*a*, 29*b* without the need for any special intermediate buffer device, which is advantageous in points of installation space and cost.

The printer controller 12*a* of the second printer 12 stops printing and paper feeding when the difference ($[PC_A]-[PC_B]$) in count value falls below the first set value N1. In this case, if the second printer 12 is in course of printing operation, the second printer 12 supplies a feed request to the first printer 11. The printer controller 11*a* of the first printer 11 judges (1) whether or not a predetermined time has passed without receiving next printing data after receiving a command which indicates the end of the printing data, and (2) whether or not a switch for commanding the second printer 12 to print to the end of the printing data (the switch is provided in one or both of the first and second printers 11, 12 and the switch ON/OFF state is informed of by each other) is operated. After the feed request is issued, if said predetermined time has passed without receiving next printing data or the switch is operated, the first printer 11 feeds the continuous forms CF. If the difference ($[PC_A]-[PC_B]$) becomes not less than the third set value N1R due to the paper feeding by the first printer 11, the second printer 12 resumes printing and paper feeding. In this way, even if printing has been finished by the first printer 11 when the second printer 12 stops printing, the second printer 12 can resume printing.

After the resumption of printing and paper feeding by the second printer 12, the first printer 11 feeds the continuous forms CF by the amount which corresponds to the count value n and increases the count value of the counter $PC_A$ by n every time the count value of the counter $PC_B$ increases by n. Consequently, the difference ($[PC_A]-[PC_B]$) in count value does not henceforth fall below the first set value N1, so that the operation of stopping and resuming printing and paper feeding is not repeated.

The printer controller 11*a* of the first printer 11 stops printing and paper feeding when the difference ($[PC_A]-[PC_B]$) in count value exceeds the second set value N2. In this case, if the first printer 11 is in course of printing operation, the first printer 11 supplies a feed request to the second printer 12. The printer controller 12*a* of the second printer 12 judges (1) whether or not a predetermined time has passed without receiving next printing data after receiving a command which indicates the end of printing data, and (2) whether or not a switch for commanding the first printer to print to the end of the printing data is operated. After the feed request is issued, if the predetermined time has passed without receiving next printing data or the switch is operated, the second printer 12 feeds the continuous forms CF. If the difference ($[PC_A]-[PC_B]$) becomes not more than the set value N2R due to the paper feeding by the second printer 12, the first printer 11 resumes printing and paper feeding. In this way, even if printing has been finished by the second printer 12, the first printer 11 can resume printing.

After the resumption of printing and paper feeding by the first printer 11, the second printer 12 feeds the continuous forms CF by the amount which corresponds to the count value n and increases the count value of the counter $PC_B$ by n every time the count value of the counter $PC_A$ increases by n. Consequently, the difference ($[PC_A]-[PC_B]$) in count value does not henceforth exceed the second set value N2, so that the operation of stopping and resuming printing and paper feeding is not repeated.

A mark printing means is provided in the first printer 11 and a mark detecting means is provided in the second printer 12. The mark printing means of the first printer 11 prints a mark on the first surface of the continuous forms, and the printer controller 12*a* of the second printer 12 starts printing on the second surface of the continuous forms CF when the mark detecting means detects the mark. In this way, it is possible to print accurately on the top surface and on the back surface of the continuous forms by a simple structure.

(c) Schematic Explanation of Third Embodiment

Figure 3:
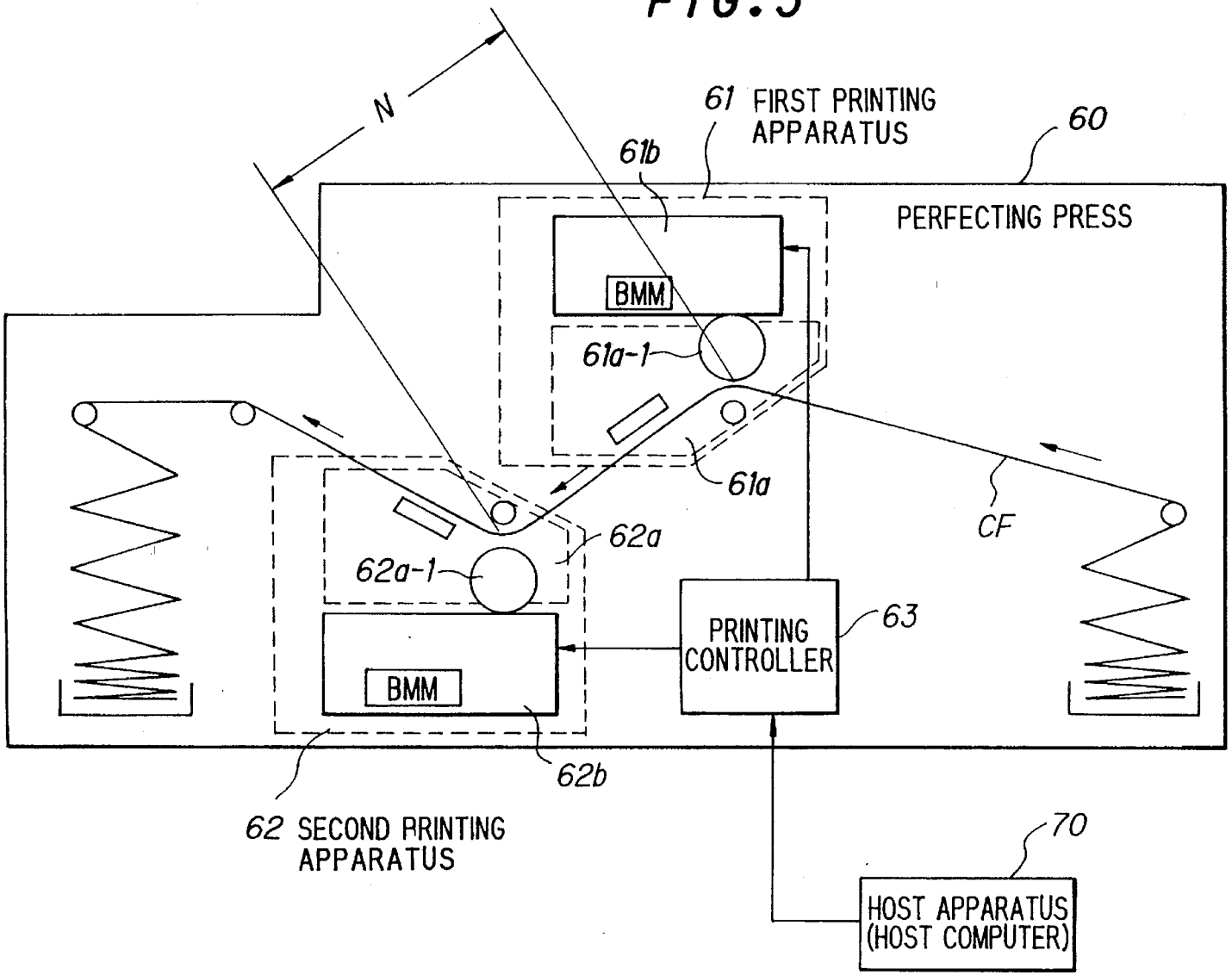
FIG. 3 schematically explains a third embodiment of the present invention.

FIG. 3 schematically explains a third embodiment of the present invention.

In the first and second double-sided printing systems of the present invention, two printers are connected in series so as to conduct double-sided printing. In contrast, in the third embodiment, double-sided printing is executed by two printing portions provided within the double-sided printing apparatus.

In FIG. 3, the reference numeral 60 represents a double-sided printing apparatus, and 70 a host apparatus (host computer) for transferring printing data to the double-sided printing apparatus. In the double-sided printing apparatus 60, the reference numeral 61 denotes a first printing portion for printing on the first surface (top surface) of the continuous forms CF, 62 a second printing portion for printing on the second surface (back surface) of the continuous forms CF, and 63 a printing controller for distributing the printing data which are to be printed on the first surface and the second surface and which are received from the host apparatus 70, to the first and second printing portions 61, 62, respectively. The first and second printing portions 61, 62 have completely the same structure, and they are provided with image forming portions (recording process portions) 61*a*, 62*a*, and process controllers 61*b*, 62*b* for controlling the image forming portions 61*a* and 62*b*, respectively. The image forming portions 61*a*, 62*a* transfer and fix the toner images formed on photosensitive drums 61*a*-1, 62*a*-1 onto the continuous forms CF. Each of the process controllers 61*b*, 62*b* has a bit map memory BMM for storing the image data for N pages which is obtained by converting the printing data into dot image data for each page.

The first printing portion 61 prints on the top surface of the continuous forms CF on the basis of the printing data for the top surface which are input from the printing controller 63. The second printing portion 62 converts the printing data for the back surface into dot printing image data and sequentially stores the dot printing image data in the bit map memory BMM. If it is assumed that the number of pages of the continuous forms existing between the printing portions of the first and second printing portions 61, 62 is N, when the first printing portion 61 has finished printing N pages on the top surface, the printing controller 63 instructs the second printing portion 62 to start printing. The second printing portion 62 then reads out the image data for the back surface which is stored in the bit map memory BMM and starts printing on the back surface of the continuous forms CF. Thereafter, printing is simultaneously conducted on the top surface and the back surface.

In this way, since the bit map memory for storing the image data for N pages is provided in the second printing portion 62 so that the second printing portion 62 starts printing after the first printing portion 61 prints N pages, even if the photosensitive drums 61*a*-1, 62*a*-1 have the same diameter, it is possible to accurately print on the top surface and on the back surface of the continuous forms CF without causing a positional deviation.

When the printing controller 63 instructs the first printing portion 61 to start printing on the top surface of the first page, it instructs the second printing portion 62 to warm up the image forming portion 62*a*. The first printing portion 61 sequentially starts printing on the top surface after warming up the image forming portion 61*a*, and the second printing portion 62 waits for a printing command after warming up the image forming portion 62*a*. When the first printing portion 61 has finished printing N pages on the top surface, the printing controller 63 instructs the second printing portion 62 to start printing on the back surface. Immediately after the second printing portion 62 receives the instruction, it reads out the image data for the back surface from the bit map memory BMM and starts printing on the back surface of the continuous forms CF without the need for warming up the image forming portion 62*a*. In this way, since the second printing portion 61 warms up the image forming portion 62*a* simultaneously with the first printing portion 61, the second printing portion 62 can immediately start printing, thereby enhancing the printing efficiency.

If the continuous forms CF having a different form size (length between the perforations) is used, the number of pages of the continuous form CF existing between the printing positions of the first and second printing portions 61, 62 is not an integer but contains a fraction such as 2.3. In such a case, the printing positions of the first and second printing portions are different on the continuous forms CF. In order to accurately print on the top surface and the back surface without a positional deviation, a simple control is desired. For this purpose, an intermediate buffer is provided which includes an adjusting means for adjusting the number of pages existing between the printing positions of the first printing portion 61 and the second printing portion 62 to exactly an integer. In this way, it is possible to accurately print on the top surface and the back surface without positional deviation by simple control.

(B) FIRST EMBODIMENT

(a) Entire Structure of Double-sided Printing System

Figure 4:
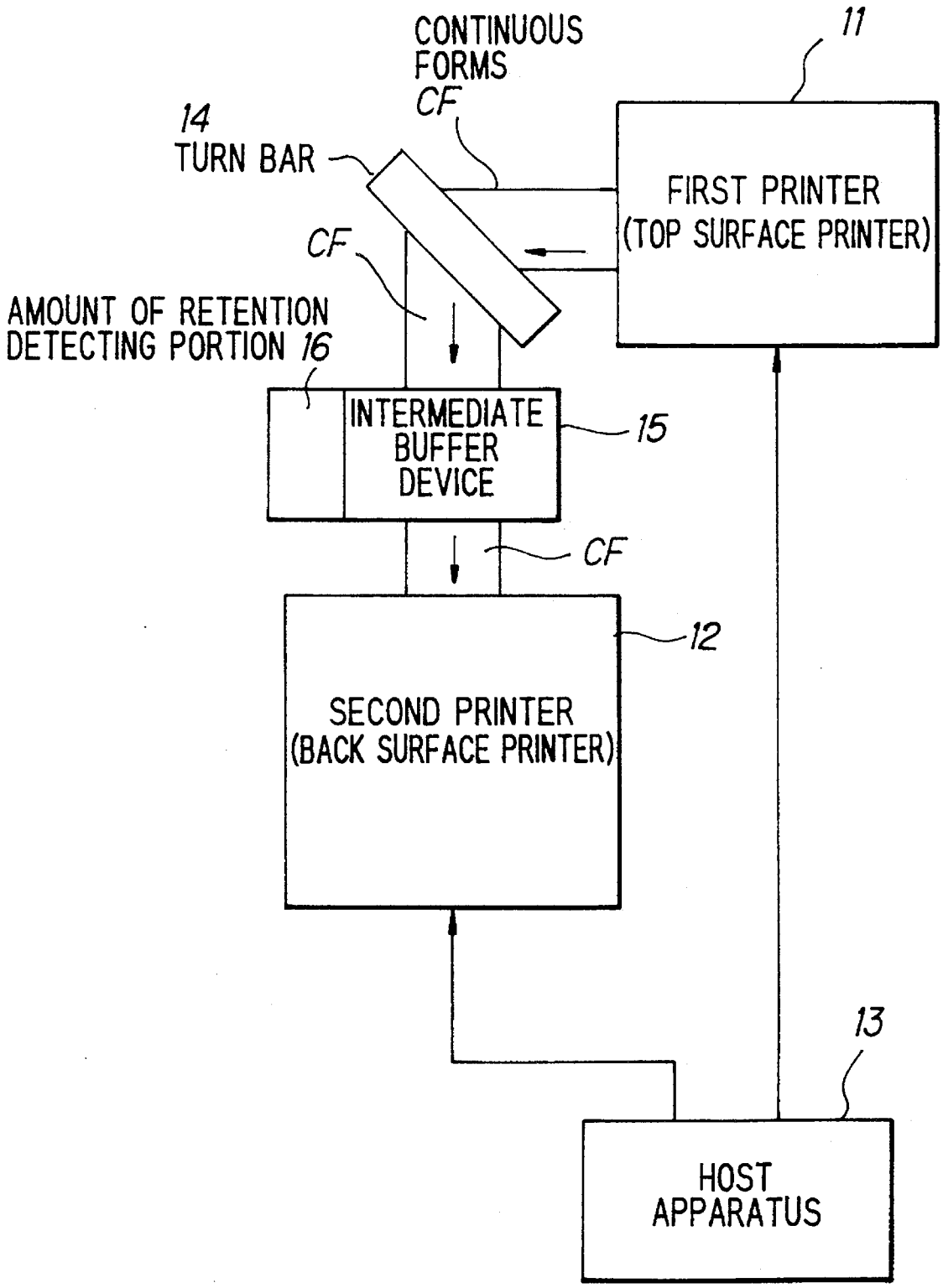
FIG. 4 shows the entire structure of the first embodiment of a double-sided printing system according to the present invention.

FIG. 4 shows the entire structure of a first embodiment of a double-sided printing system according to the present invention.

The reference numeral 11 represents a first printer (page printer) for printing on the top surface of the continuous forms CF, 12 a second printer (page printer) provided at a subsequent stage to the first printer 11 in the direction of paper feeding so as to print on the back surface of the continuous forms CF, 13 a host apparatus for transferring printing data to be printed on the top and back surfaces to the first and second printers 11 and 12, respectively, 14 a reversing mechanism (turn bar) disposed at a subsequent stage to the first page printer 11 so as to reverse the surface of the continuous forms CF, 15 an intermediate buffer device provided at a subsequent stage of the turn bar 14 so as to absorb the difference in printing speed (paper feeding speed) between the first and second printers 11 and 12, and 16 an amount of retention detecting portion provided in the intermediate buffer device 15 so as to detect the amount of retention (amount of sag) of the continuous forms CF in the intermediate buffer device 15. The detecting portion 16 is composed of, for example, a light emitting/light receiving element.

(b) First Page Printer

Figure 5:
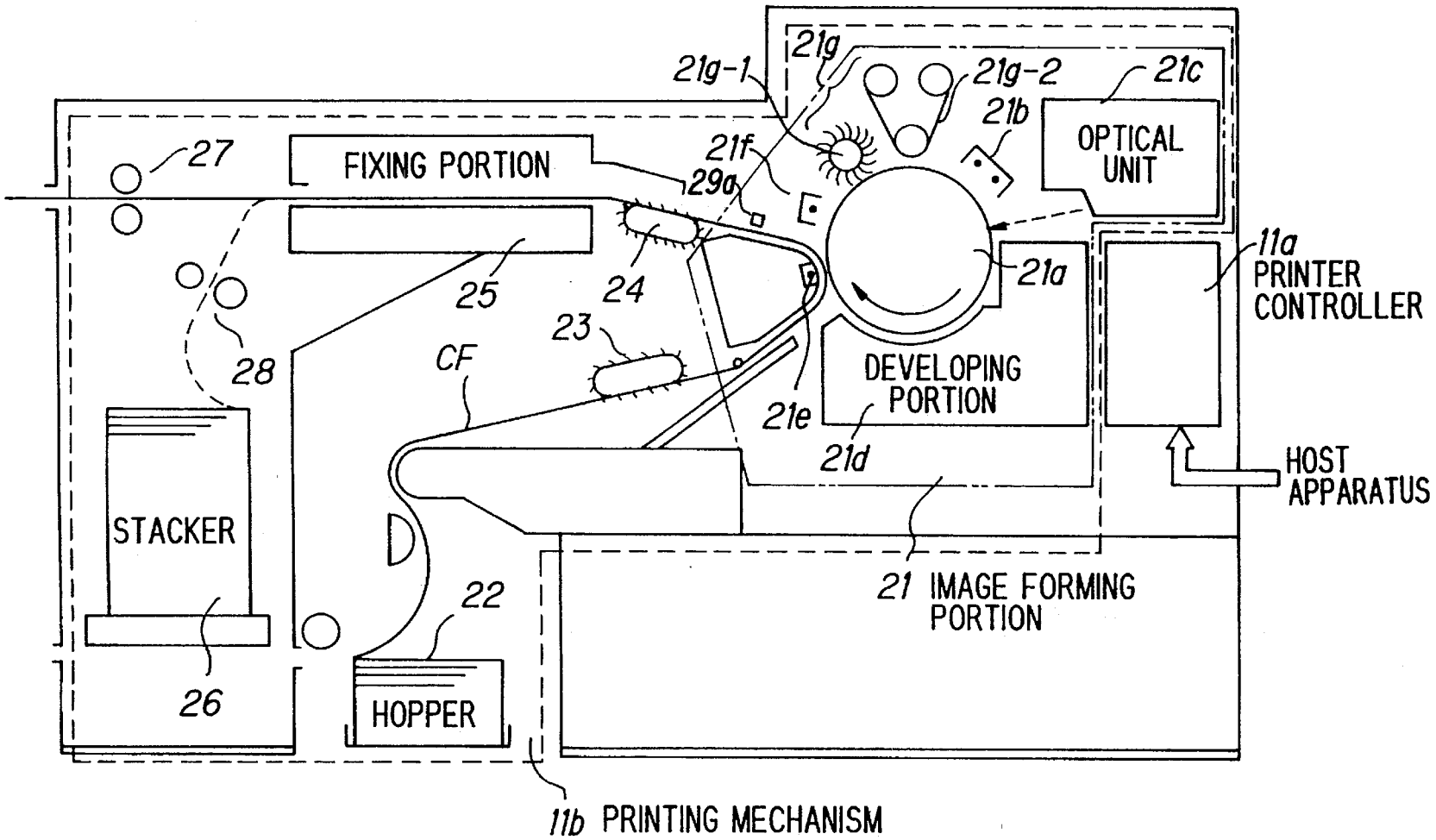
FIG. 5 shows the structure of a first page printer.

The first page printer 11 is provided with a printer controller 11*a* and a printing mechanism 11*b*, as shown in FIG. 5. In the printing mechanism 11*b*, the reference numeral 21 denotes an image forming portions, 22 a hopper for supplying the continuous forms CF, 23, 24 tractors for feeding the continuous forms CF, 25 a fixing portion, 26 a stacker for accommodating the printed continuous forms CF at the time of single-side printing, 27, 28 paper feed rollers and 29*a* a paper feed detecting sensor. The image forming portion 21 prints on the surface of the continuous forms CF with the principle of electrophotography. The reference numeral 21*a* represents a photosensitive drum which has a photoconductive material (photosensitive material) on the surface, 21*b* a pre-electrifier for uniformly electrifying the surface of the photosensitive drum 21*a*, 21*c* an optical unit for exposure which forms an electrostatic latent image by projecting an optical image onto the photosensitive drum 21*a*, 21*d* a developing portion for developing the electrostatic latent image into a toner image, 21*e* a transferring electrifier for transferring the toner image onto the continuous forms CF, 21*f* an optical static eliminator for eliminating the charges on the photosensitive drum 21*a* by projecting light, and 21*g* a cleaner for removing the toner remaining on the photosensitive drum 21*a* and cleaning the photosensitive drum 21*a*. The cleaner 21*g* is provided with a brush 21*g*-1 and a cleaning fleece 21*g*-2. The position of the transferring electrifier 21*e* is the printing position.

When an optical image is projected onto the surface of the photosensitive drum 21*a* which is uniformly positively, for example, electrified by the pre-electrifier 21*b*, the potential at the portion to which the light is projected is lowered, so that an electrostatic latent image is formed. When the developing portion 21*d* rubs the positively electrified toner on the surface of the photosensitive drum 21*a* by rotating a magnet roll (not shown) which is biased at a predetermined developing voltage, the toner moves onto the electrostatic latent image, thereby forming a toner image. Thereafter, corona discharge is caused from the back surface of the continuous form CF at a potential of the opposite (negative) polarity to the polarity of the electrified toner image and the continuous form CF is negatively electrified, so that the toner image is adsorbed and transferred to the continuous form CF. The continuous form CF to which the toner image is transferred is carried to the fixing portion 25, which fixes the toner image with heat. The continuous form CF is then drawn out of the box body of the first page printer 11 and carried toward the second page printer 12. When the first page printer 11 is singly used for single-side printing, the continuous form CF is stored in the stacker 26, as indicated by the broken line in FIG. 5.

After the toner image is transferred to the continuous form CF, the photosensitive drum 21*a* further rotates, and the charges on the photosensitive drum 21*a* are eliminated by the optical static eliminator 21*f*, and the toner remaining on the photosensitive drum 21*a* is removed. Thus, the photosensitive drum 21*a* is ready for the formation of a next electrostatic latent image.

Figure 6:
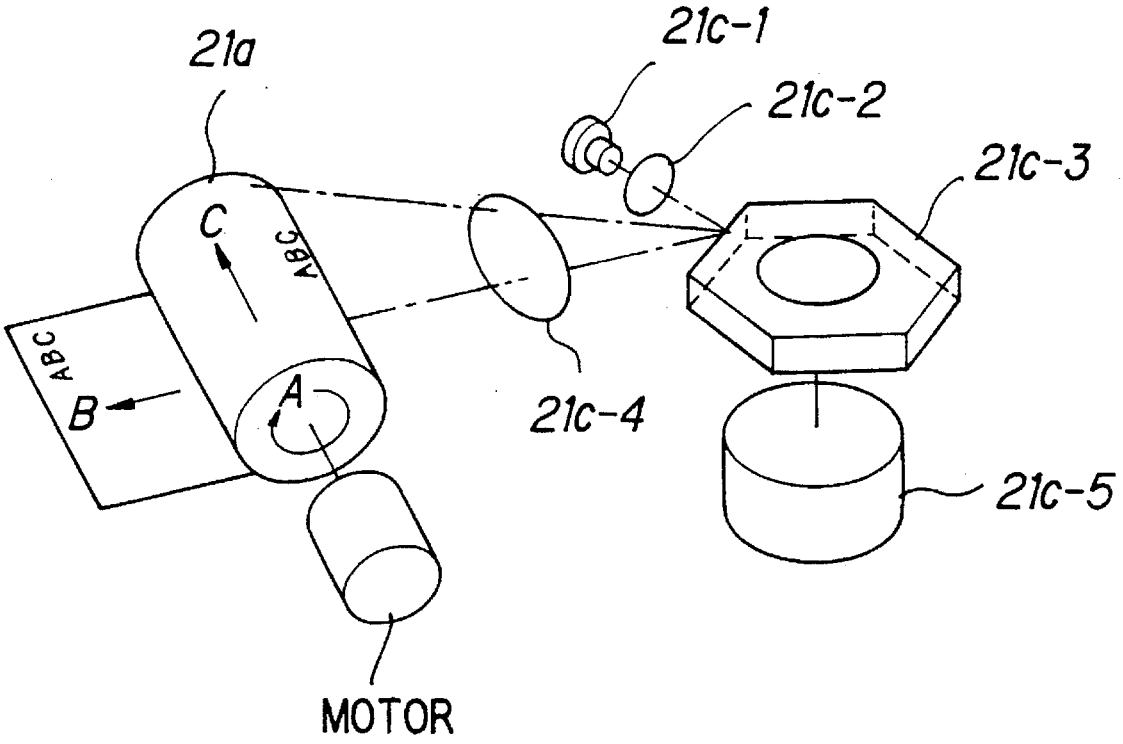
FIG. 6 shows the structure of an optical unit.

FIG. 6 shows the structure of the optical unit 21*c* for exposure. The reference numeral 21*c*-1 represents a laser diode, 21*c*-2 a collimator lens, 21*c*-3 a polygonal mirror for scanning laser light in the longitudinal direction (indicated by the arrow C) of the photosensitive drum 21*a*, 21*c*-4 an FΘ lens (imagery lens), and 21*c*-5 a spindle motor for rotating the polygonal mirror 21*c*-3 at a constant rate. Laser light is turned on and off by turning on and off the laser diode 21*c*-1 in accordance with the dot printing image data. The laser light turned on or off reaches the polygonal mirror 21*c*-3 through the collimator lens 21*c*-2. Since the polygonal mirror 21*c*-3 is rotated at a constant rate by the spindle motor 21*c*-5, the polygonal mirror 21*c*-3 repeatedly moves the incident laser light in the longitudinal direction (indicated by the arrow C) of the photosensitive drum 21*a* through the F-Θ lens 21*c*-4. Therefore, when the laser light which is turned on and off in accordance with the printing information is scanned in the longitudinal direction of the photosensitive drum 21*a*, the optical image of the dot image is projected, so that the electrostatic latent dot image is formed on the surface of the photosensitive drum 21*a*.

(c) Paper Reversing Mechanism

Figure 7A:
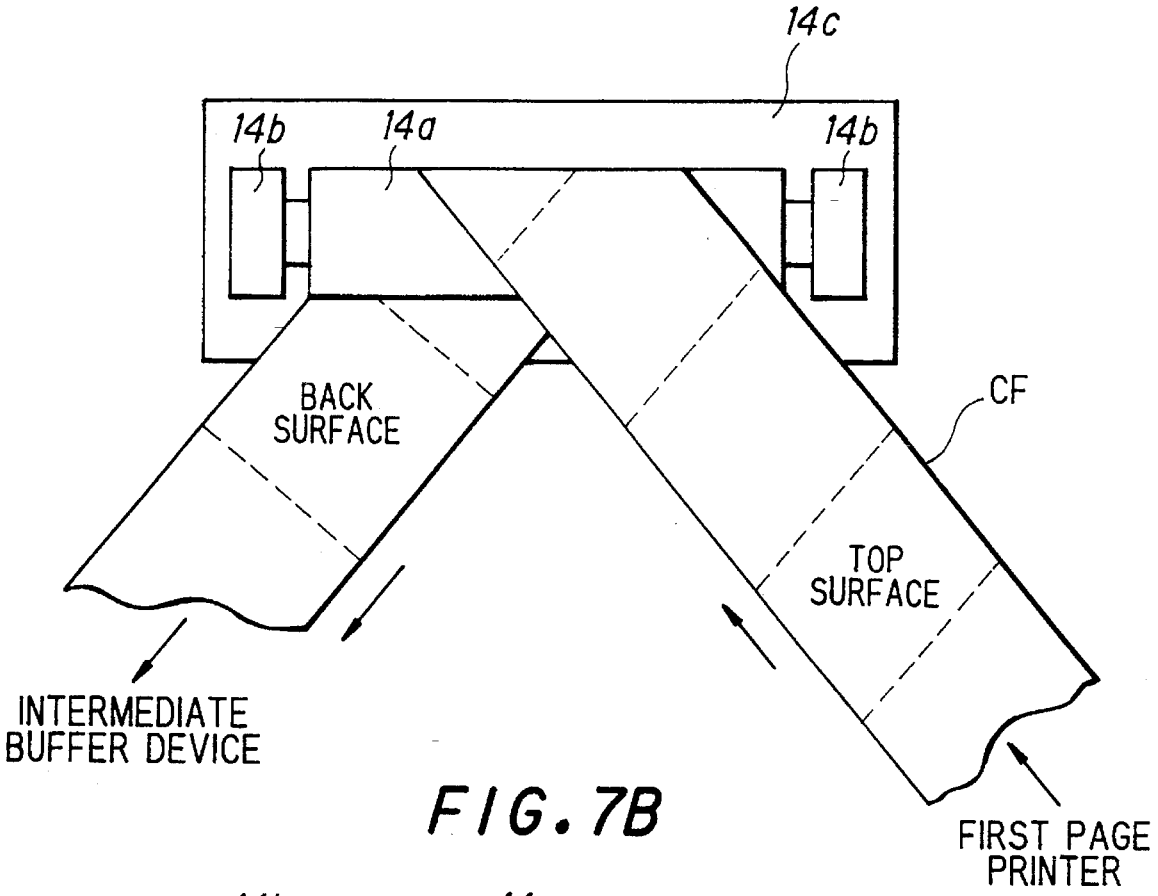
FIGS. 7A and 7B show the structure of a reversing mechanism.
Figure 7B:
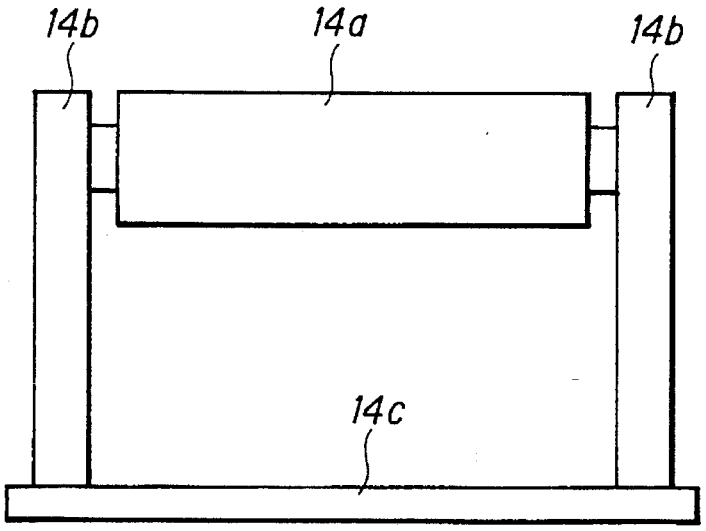

FIGS. 7A and 7B show the structure of the reversing mechanism 14 for reversing the surface of the continuous forms CF, wherein FIG. 7A is a plan view and FIG. 7B is an elevation view thereof. The reference numeral 14*a* represents a cylindrical turn bar, 14*b* a pair of supporting members for rotatably supporting the turn bar 14*a*, and 14*c* a base member. The continuous forms CF supplied from the first page printer 11 are wound around the shaft of the turn bar 14*a* at an inclination of about 45°, and are carried toward the intermediate buffer device 15 with the back surface faced upward.

(d) Intermediate Buffer Device

Figure 8A:
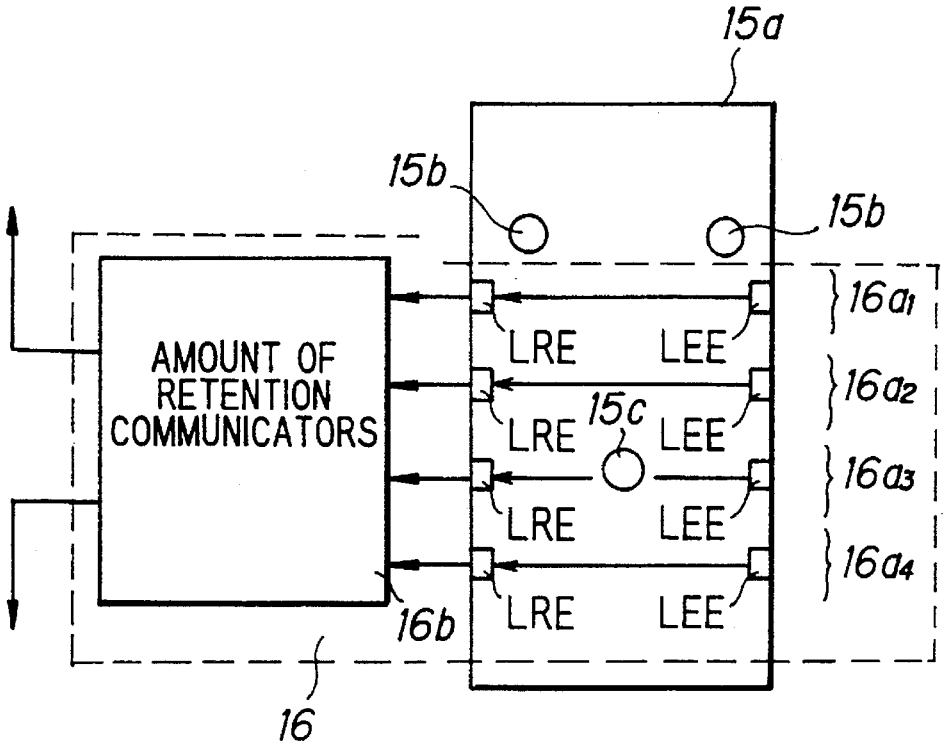
FIGS. 8A and 8B explain an intermediate buffer device.
Figure 8B:
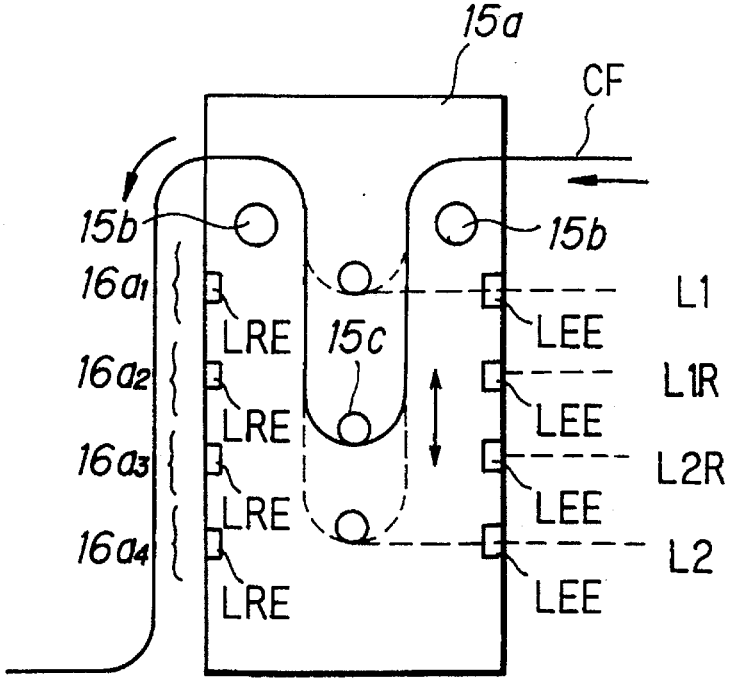

FIGS. 8A and 8B show the structure of the intermediate buffer device 15. The intermediate buffer device 15 keeps an appropriate amount of sag in the forms between the first and second page printers 11 and 12 so as to absorb the difference in printing speed (paper feeding speed) between both printers. The intermediate buffer device 15 is composed of a box body 15*a*, first and second fixed rollers 15*b* provided on the entrance and the exit of the box body for the continuous forms CF, a movable roller 15*c* which vertically moves in accordance with the amount of sag (amount of retention) L, and the amount of retention detecting portion 16 for detecting the amount of retention of the continuous forms CF in the intermediate buffer device 15. The amount of retention detecting portion 16 is provided with four sets of sensors (light emitting elements LEE, light receiving elements LRE) $16a_1$ to $16a_4$, and an amount of retention communicator for inputting the output of each sensor to the printer controllers 11*a*, 12*a* of the first and second printers 11, 12, respectively.

The continuous forms CF are routed as shown in FIG. 8B, and when the amount of retention of the continuous forms CF is small, the movable roller 15 is lifted upward, while when the amount of retention of the continuous forms CF is large, the movable roller 15 is lowered. Consequently, when the movable roller 15*c* is moved above the position at which the first sensor $16a_1$ is disposed, the light receiving element LRE of the first sensor $16a_1$ detects the light from the light emitting element LEE, which indicates that the amount of retention is not more than the first set value L1. On the other hand, when the amount of retention of the continuous forms CF becomes large and the movable roller 15*c* therefore moves below the position at which the fourth sensor $16a_4$ is disposed, the light receiving element LRE of the fourth sensor $16a_4$ does not detect the light from the light emitting element LEE, which indicates that the amount of retention is not less than the second set vale L2. Similarly, the second and third sensors $16a_2$, $16a_3$ detect that the amount of retention becomes not less than an intermediate level L1R and not more than an intermediate level L2R.

(e) Second Page Printer

Figure 9:
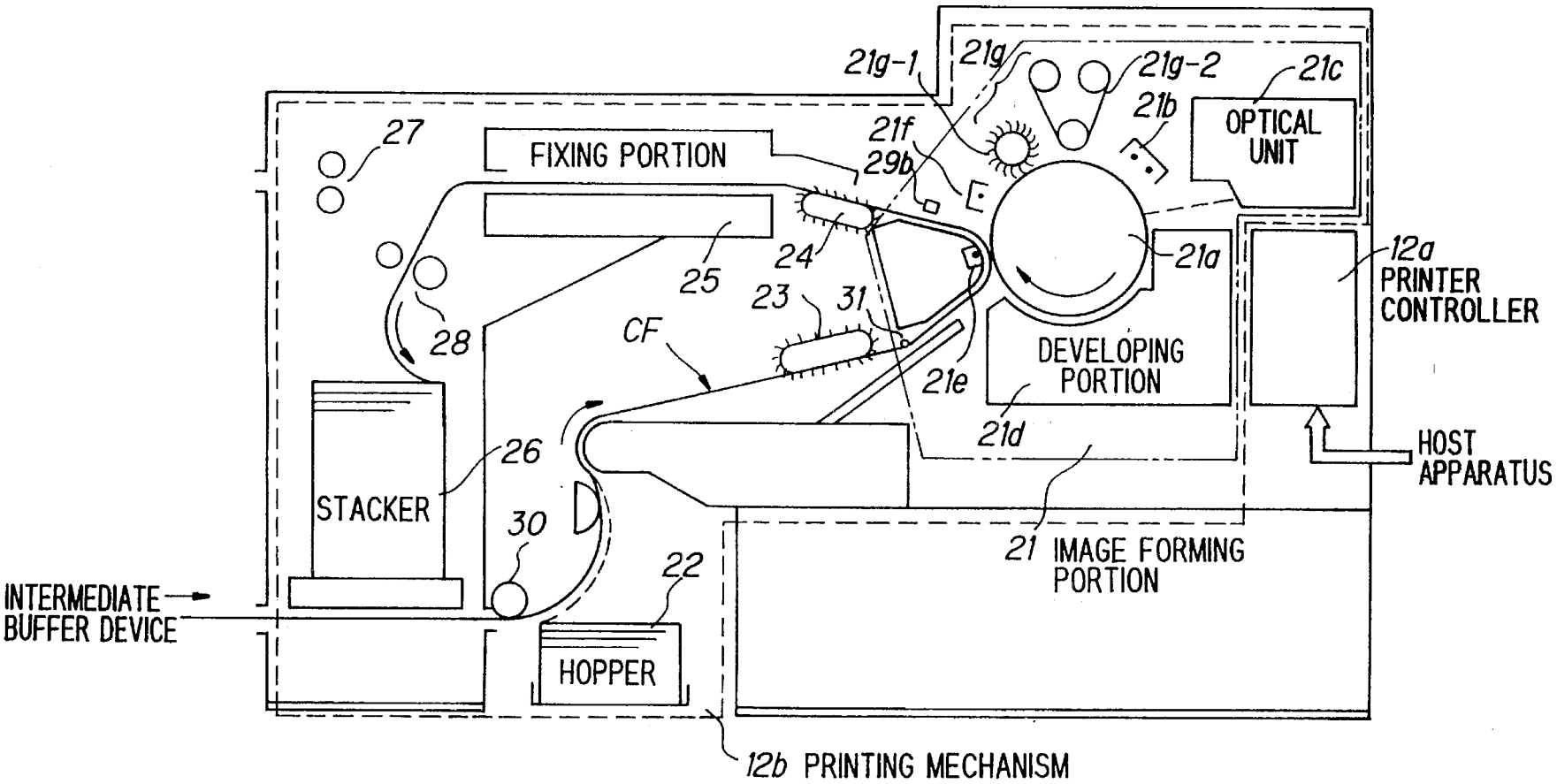
FIG. 9 shows the structure of a second page printer.

FIG. 9 shows the structure of the second page printer 12, which has the same structure as the first page printer 11 shown in FIG. 5. The reference numeral 12*a* represents a printer controller and 12*b* a printing mechanism. The second page printer 12 is different from the first page printer 11 in the passage of the continuous forms CF. The continuous forms CF fed from the intermediate buffer device 15 is led to the paper passage through the roller 30 and carried to the stacker 26 on the passage indicated by the arrows. When the second page printer 12 is singly used for single-side printing, the continuous forms CF are supplied from the hopper 22 as indicated by the broken line.

(f) Structure of Control System in Double-sided Printing System

Figure 10:
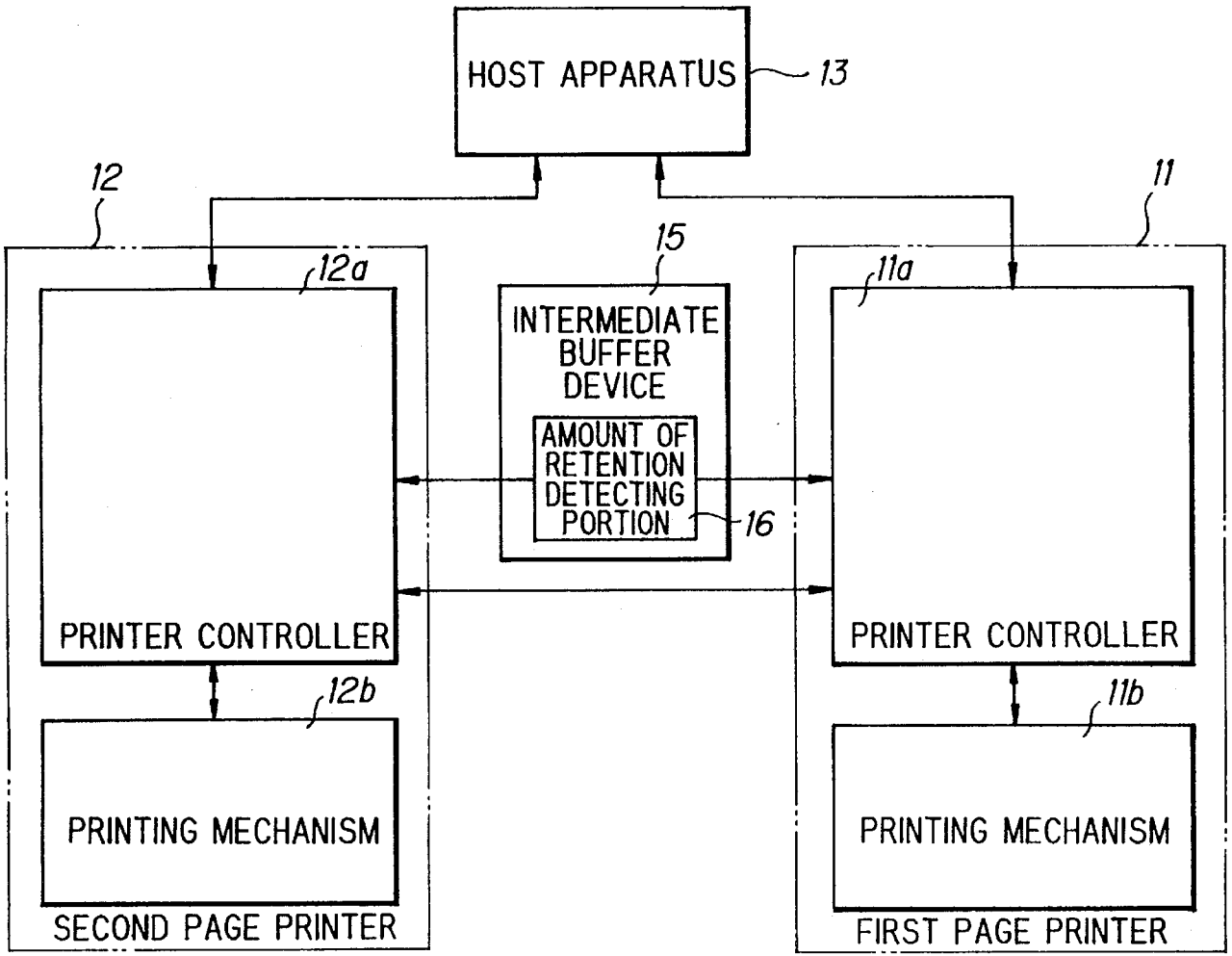
FIG. 10 shows the structure of the control system in the first embodiment shown in FIG. 4.

FIG. 10 shows the structure of the control system in the double-sided printing system. The reference numeral 11 represents a first page printer for printing on the top surface of the continuous forms CF, 12 a second page for printing on the back surface of the continuous forms CF, 13 a host apparatus for transferring printing data which are to be printed on the first and second surfaces to the first and second page printers 11 and 12, respectively, 15 an intermediate buffer device for absorbing the difference in paper feeding speed between the first and second page printers 11 and 12, and 16 an amount of retention detecting portion for detecting the amount of retention of the continuous forms CF in the intermediate buffer device 15. In the first and second page printers 11, 12, the reference numerals 11*a*, 12*a* denote printer controllers for controlling the page printers as a whole, and 11*b*, 12*b* printing mechanisms.

The amount of retention detecting portion 16 inputs the output of each of the sensors $16a_1$ to $16a_4$ (see FIG. 8) to the printer controllers 11*a*, 12*a*. The printer controllers 11*a*, 12*a* monitor the amount of retention Of the continuous forms CF from the outputs of the sensors and stop and resume printing on the basis of the detected amount of retention, as will be described later.

The printer controller 11*a* and the printer controller 12*a* are communicable with each other. One printer controller supplies a start switch press-down signal, a stop switch press-down signal, a paper discharge switch press-down signal and a printer state signal to the other printer controller so that the first and second page printers 11, 12 can simultaneously stop or resume start printing.

The printer controllers 11*a*, 12*a* control the printing mechanisms 11*b*, 12*b*, respectively, so as to turn on/off various motors and various electrifiers, and to input a printing image. The printer controllers 11*a*, 12*a* also are input signals from various sensors and control the printing mechanism 11*b*, 12*b* on the basis of the sensor signals.

(g) Printer Controller

Figure 11:
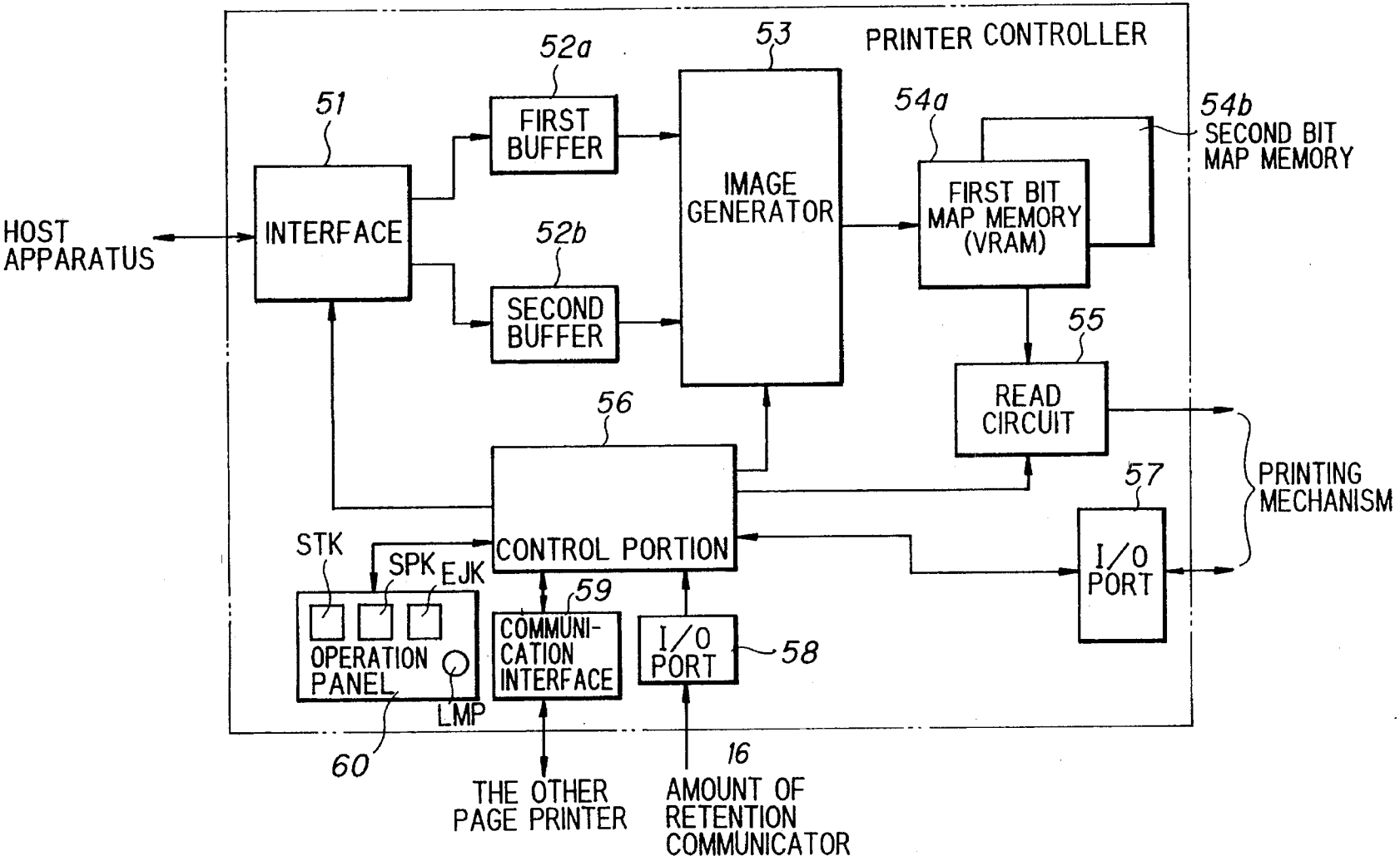
FIG. 11 shows the structure of the printer controller in the first embodiment shown in FIG. 4.

FIG. 11 shows the structure of the printer controller 11*a* (12*a*).

The reference numeral 51 represents an interface for supplying and receiving data to and from the host apparatus, 52*a*, 52*b* first and second buffers for alternately storing printing data (character codes or the like) for one page which is supplied from the host apparatus, 53 an image generator for generating a dot printing image data from the printing data, 54*a*, 54*b* first and second bit map memories (VRAM) for alternately storing printing image data for one page which is output from the image generator 53, and 55 a read circuit for alternately reading the image data for one screen (one page) by a raster scan system from the first and second bit map memories 54*a*, 54*b* and inputting the read image data to the optical unit 21*c* of the image forming portion 21 (see FIGS. 5 and 9). The reference numeral 56 denotes a control portion for controlling the printer as a whole, 57 an I/O port for outputting a control signal (motor ON/OFF signal, electrifier ON/OFF signal, etc.) to the printing mechanism 11*b* (12*b*) and inputting various sensor signals and other signals from the printing mechanism 11*b* (12*b*), 58 an I/O port for receiving a sensor signal from the amount of retention detecting portion 16, 59 a communication interface for communicating data with the printer controller of the other page printer, and 60 an operation panel.

The operation panel 60 is provided with a start key STK for making the page printer 11 (12) ready (READY state), a stop key SPK for changing the READY state of the page printer to the NOT READY state, an eject key for paper discharge, and a lamp LMP for indicating the READY/NOT READY state of the page printer 11 (12). A start switch press-down signal, a stop switch press-down signal, a paper discharge switch press-down signal and a printer state signal are supplied to the other printer controller through the communication interface 59 under the control by the control portion 56.

The interface 51 stores the printing data for the i-th page which is transferred from the host apparatus 13 in the first buffer 52*a*. The image generator 53 generates image data on the basis of the printing data and stores it in the first bit map memory 54*a*, and the read circuit 55 reads the image from the first bit map memory 54*a* and inputs the read image to the image forming portion 21 so as to form the electrostatic latent image for the i-th page on the photosensitive drum 21*a*.

In parallel with the generation of the printing image by the image generator 53, the interface 51 receives the printing data for the (i+1)th page from the host apparatus 13 and stores it in the second buffer 52*b*. In parallel with the reading of the printing image data from the first bit map memory 54*a*, the image generator 53 generates printing image data on the basis of the printing data stored in the second buffer memory and stores it in the second bit map memory 54*b*. Thereafter, the read circuit 55 reads the printing image data from the second bit map memory 54*b* under the control by the control portion 56 and inputs the read data to the image forming portion 21 so as to form the electrostatic latent image for the (i+i)th page on the photosensitive drum 21*a*. These operations are alternately repeated, so that the data for the top surface are printed on a first form, a second form, . . . , of the continuous forms CF loaded on the first printer 11 and the data for the back surface are printed on a first form, a second form, . . . of the continuous forms CF loaded on the second printer 12.

(h) Printing Data from Host Apparatus

Figure 12:
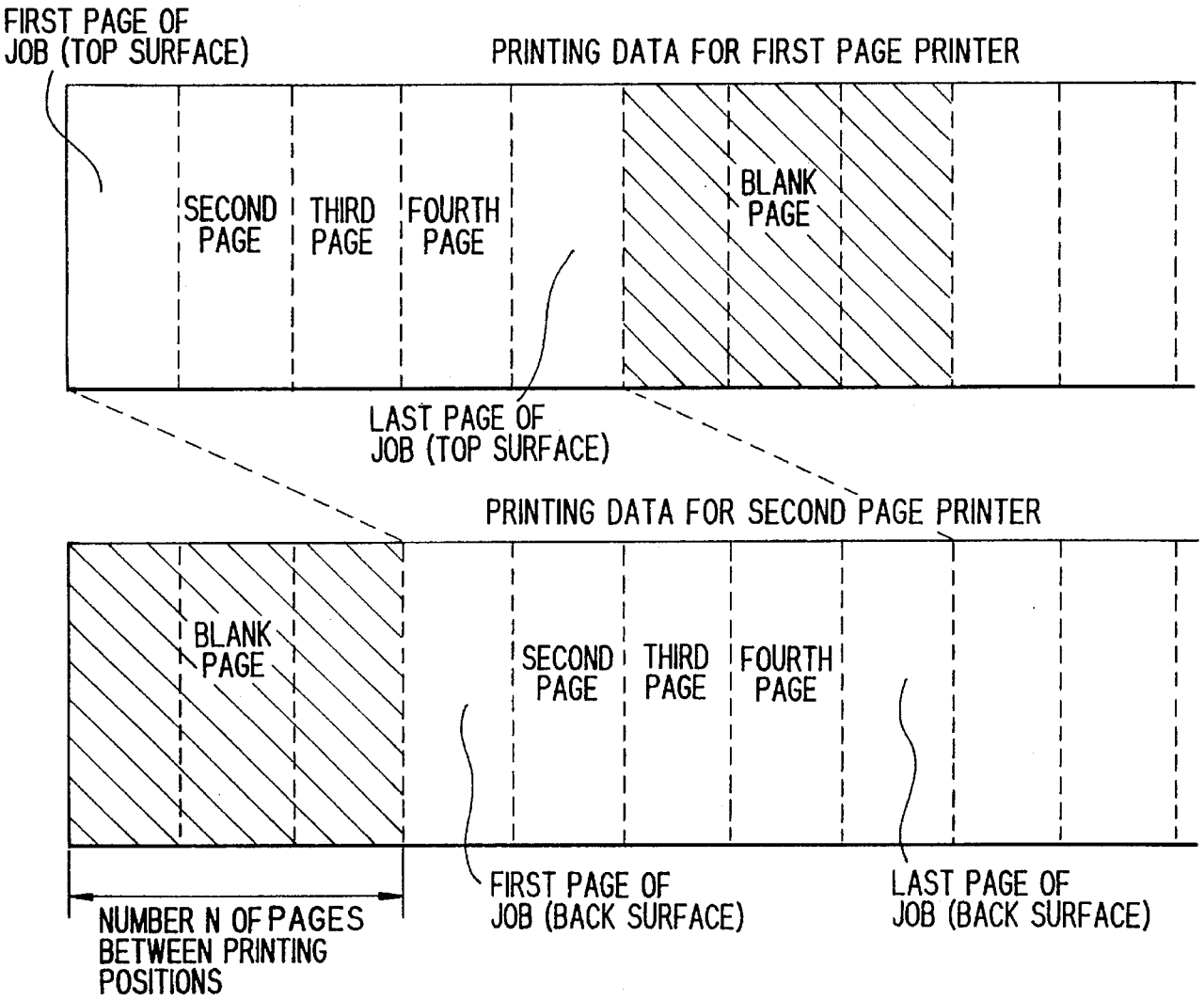
FIG. 12 explains the printing data supplied from a host apparatus in the first embodiment shown in FIG. 4.

If it is assumed that the number of pages between the transferring electriflers 21*e* (printing positions) in the first and second printers 11, 12 when the continuous forms CF are set on the paper passage is N, the host apparatus 13 adds blank data for N pages to end of all the printing data which are to be printed on the first surface and supplies the total data to the first printer 11, and adds blank data for N pages to the beginning of all the printing data which are to be printed on the second surface and supplies the total data to the second printer 12. FIG. 12 explains the printing data for the first and second printers 11, 12 on the assumption that N=3. Since the number N of pages between the printing positions in the double-sided printing system is determined when the continuous form CF is set at the printing positions of the first and second printer, the control portion 56 supplies the number N of pages to the host apparatus 13 after the power is made or the start key is pressed down. The host apparatus 13 then recognizes the number N of blank pages and adds blank data for N pages to the printing data.

In this manner, since the printing data with blank data for N pages added thereto are input to the first and second page printers 11, 12 and printing is simultaneously started by the first and second page printers 11, 12, it is possible to print on the back surface by the second printer 12 exactly at the portion which is printed by the first printer 11. For example, it is possible to print an odd page ((2n+1)th page, n=0, 1, 2, . . . ) on the top surface of the continuous forms CF by the first printer 11 and print an even page (2(n+1)th page) on the back surface thereof by the second printer 12.

(i) Setting of Continuous Forms

When the continuous forms CF are set, the continuous forms CF drawn from the hopper 22 of the first page printer 11 are set on the paper passage and a paper load key (not shown) is operated. The printer controller 11*a* then controls the paper feeding system so as to feed the continuous form CF by M1 pages from the position of the transferring electrifier 21*e*.

Thereafter, the continuous forms CF drawn out of the box body of the first page printer 11 are set on the paper passage of the second page printer 12 through the intermediate buffer device 15, and a paper load key of the second page printer 12 is operated. The printer controller 12*a* then controls the paper feeding system so as to feed the continuous form CF by M2 pages from the position of the transferring electrifier 21*e*.

In this manner, the continuous forms CF are set, and the number of pages between the transferring electrifiers 21*e* of the first and second page printers 11, 12 becomes (M1−M2)=N.

(j) Printing Control Based on the Amount of Retention of Continuous Forms

Figure 13:
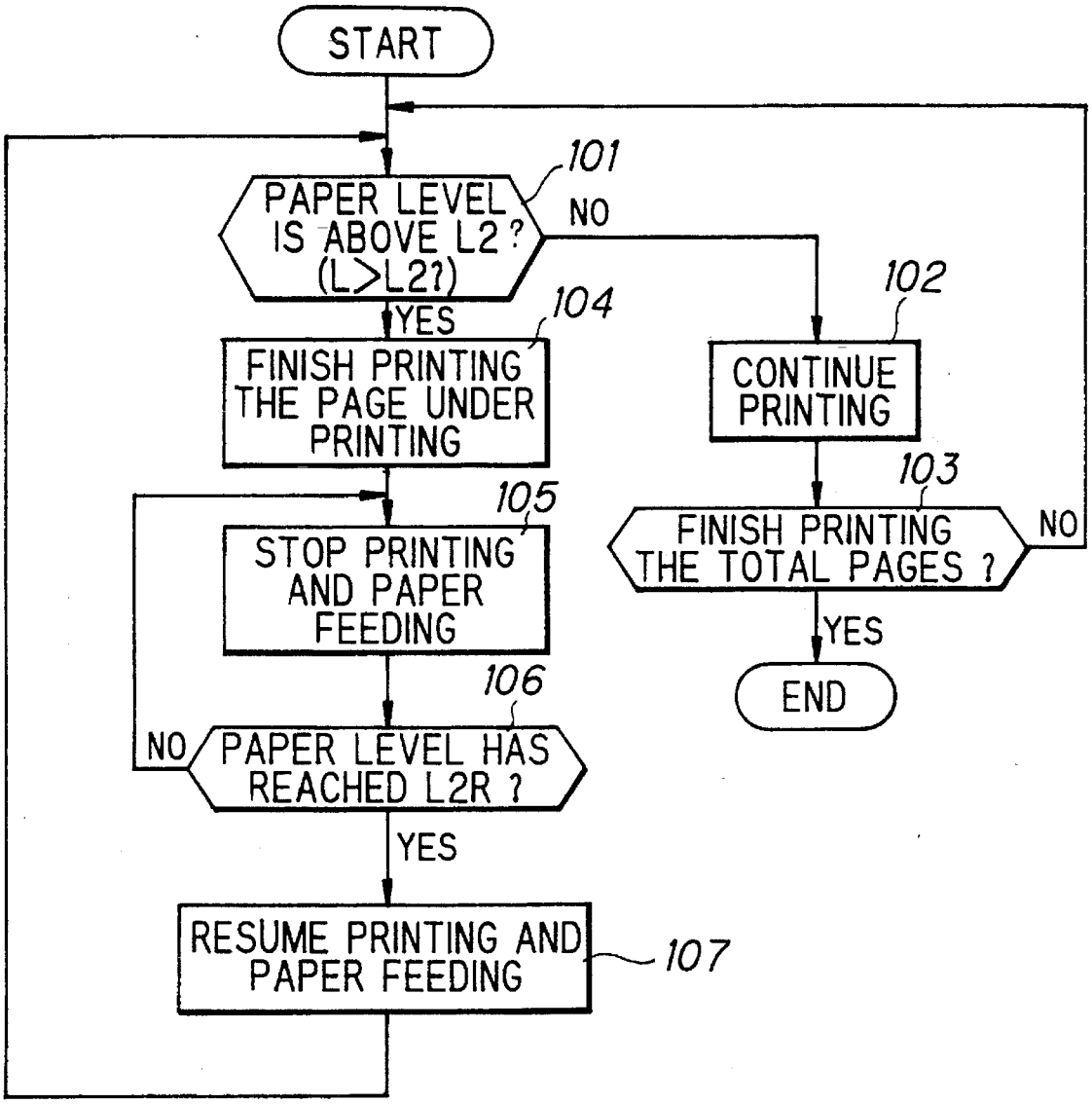
FIG. 13 is a flowchart of the process by the first page printer based on the amount of retention of the continuous forms.
Figure 14:
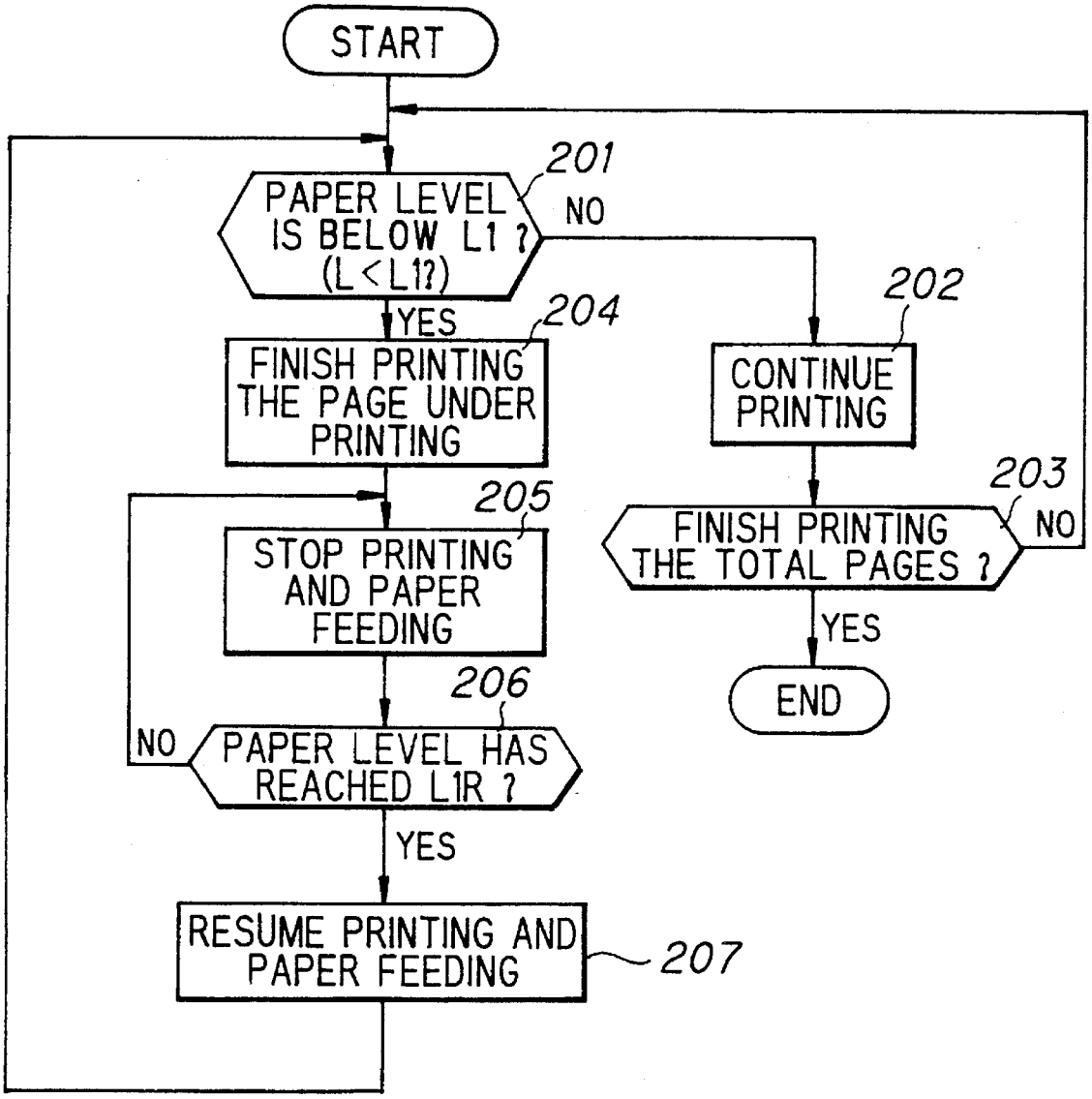
FIG. 14 is a flow chart of the process by the second page printer based on the amount of retention of the continuous forms.

FIG. 13 is a flow chart of the process by the first page printer 11 based on the amount of retention of the continuous forms, and FIG. 14 is a flow chart of the process by the second page printer 12 based on the amount of retention of the continuous forms.

(j-1) Printing Control in the First Page Printer Based On the Amount of Retention of Continuous Forms When the first and second page printers 11, 12 are in course of printing, the control portion 56 of the first page printer 11 monitors the sensor signal of the amount of retention detecting portion 16 so as to judge whether or not the amount of retention L of the continuous forms CF in the intermediate buffer device 15 exceeds L2. When the amount L of retention increases, the movable roller 15*c* is lowered, and when the amount of retention is beyond L2, the light receiving element LRE of the fourth sensor $16a_4$ does not detect light. The control portion 56 therefore judges whether or not the amount of retention is more than L2 from the sensor signal of the fourth sensor $16a_4$ (step 101).

If the amount of retention of the continuous forms CF is not more than L2, the printing operation is continued (step 102). Judgement is then made as to whether or not the total pages have been printed (step 103), and if the answer is YES, the printing operation is finished. If the answer is NO, the process returns to the step 101.

If the amount of retention of the continuous forms CF is more than L2 at the step 101, the page under printing is printed (step 104), and thereafter printing and paper feeding by the first page printer 11 is stopped (step 105). The fact that the amount L of retention exceeds L2 means that the second page printer 12 has stopped printing for one cause or another.

When the cause is removed and printing is resumed by the second page printer 12, the amount L of retention of the continuous forms CF decreases. The control portion 56 monitors the amount of retention detecting portion 16 so as to judge whether or not the amount L of retention has reached L2R. When the amount of retention of the continuous forms CF decreases, the movable roller 15*c* is lifted, and when the amount L of retention reaches L2R, the light receiving element LRE of the third sensor $16a_3$ detects light. The control portion 56 therefore judges whether or not the amount of retention has reached L2R from the sensor signal of the third sensor $16a_3$ (step 106). When the amount L of retention has reached L2R, the control portion 56 resumes printing and paper feeding by the first page printer 11 (step 107).

As described above, if the second page printer 12 has stopped printing for one cause or another, the first page printer 11 also stops printing. When the cause is removed and printing is resumed by the second page printer 12, and when the amount L of retention becomes an appropriate amount, printing by the first page printer 11 is resumed. In consequence, it is possible to simultaneously print by the first and second page printers 11, 12 with an appropriate amount of paper retained in the intermediate buffer device 15.

(j-2) Printing Control In the Second Page Printer Based On the Amount of Retention of Continuous Forms When the first and second page printers 11, 12 are in course of printing, the control portion 56 of the second page printer 12 monitors the sensor signal of the amount of retention detecting portion 16 so as to judge whether or not the amount of retention L of the continuous forms CF in the intermediate buffer device 15 falls below L2. When the amount L of retention decreases, the movable roller 15*c* is lifted, and when the amount L of retention is below L1, the light receiving element LRE of the first sensor $16a_1$ detects light. The control portion 56 therefore judges whether or not the amount of retention is less than L1 from the sensor signal of the first sensor $16a_1$ (step 201).

If the amount of retention of the continuous forms CF is not less than L1, the printing operation is continued (step 202). Judgement is then made as to whether or not the total pages have been printed (step 203), and if the answer is YES, the printing operation is finished. If the answer is NO, the process returns to the step 201.

If the amount of retention of the continuous forms CF is less than L1 at the step 201, the page under printing is printed (step 204), and thereafter printing and paper feeding by the second page printer 12 is stopped (step 205). The fact that the amount L of retention falls below L1 means that the first page printer 11 has stopped printing for one cause or another.

When the cause is removed and printing is resumed by the first page printer 11, the amount L of retention of the continuous forms CF increases. The control portion 56 monitors the amount of retention detecting portion 16 so as to judge whether or not the amount L of retention has reached L1R. When the amount of retention of the continuous forms CF increases, the movable roller 15*c* is lowered, and when the amount L of retention reaches L1R, the light receiving element LRE of the second sensor $16a_2$ does not detect light. The control portion 56 therefore judges whether or not the amount L of retention has reached L1R from the sensor signal of the second sensor $16a_2$ (step 206). When the amount L of retention has reached L1R, the control portion 56 resumes printing and paper feeding by the second page printer 12 (step 207).

As described above, if the first page printer 11 has stopped printing for one cause or another, the second page printer 12 also stops printing. When the cause is removed and printing is resumed by the first page printer 11, and when the amount L of retention becomes an appropriate amount, the second page printer 12 resumes printing. In consequence, it is possible to simultaneously print by the first and second page printers 11, 12 with an appropriate amount of paper retained in the intermediate buffer device 15.

(k) Control of Starting and Stopping Printing

Figure 15:
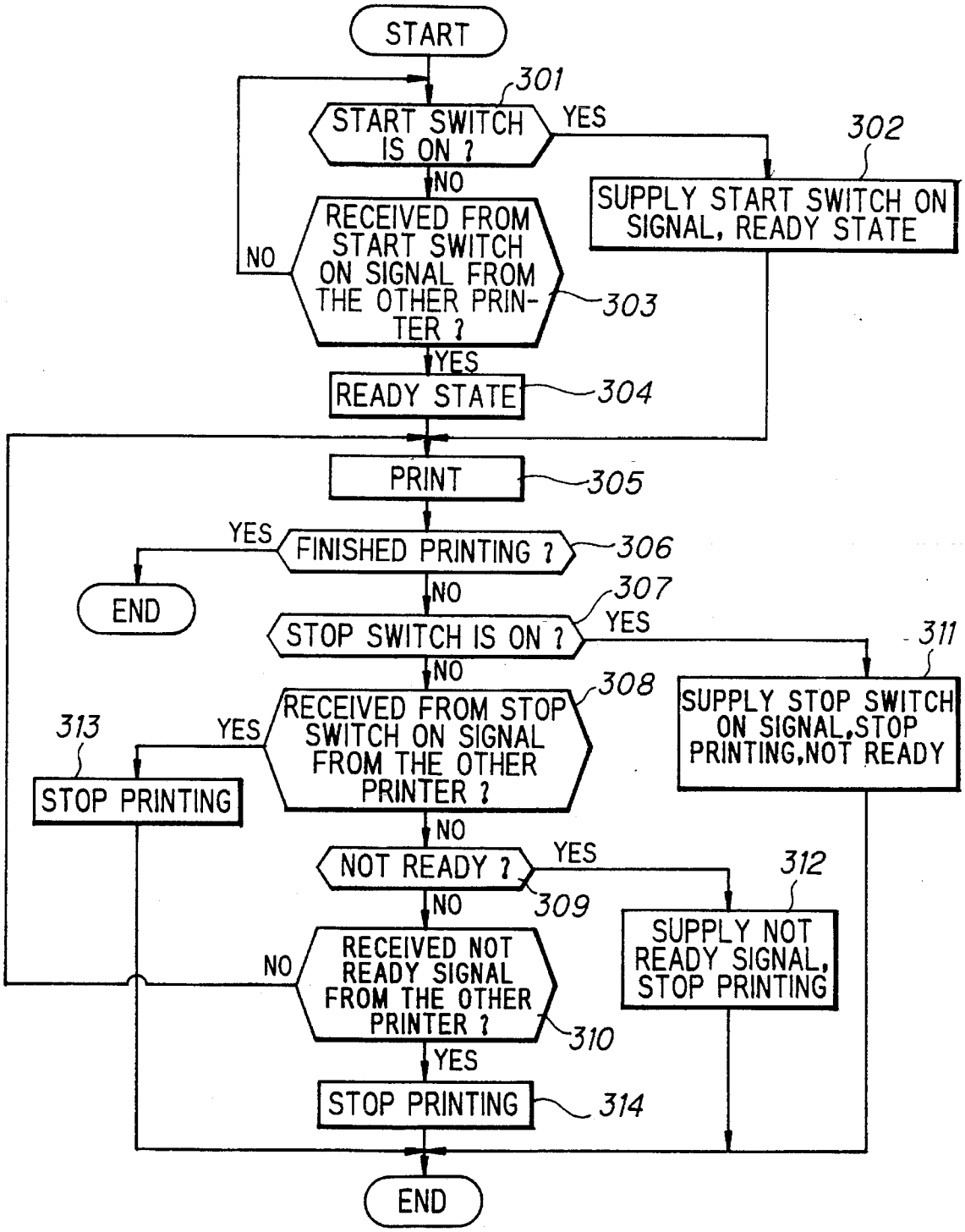
FIG. 15 is a flow chart of a printing starting and stopping process.

FIG. 15 is a flow chart of a printing starting and stopping process in the first and second page printers 11, 12.

The control portion 56 judges whether or not the start key STK of its own printer is operated (start switch is turned on) (step 301), and when the start switch is turned on, the control portion 56 outputs a start switch ON signal to the other page printer so as to simultaneously make both page printers 11, 12 ready (READY state) and turns on the lamp LMP (step 302). If the start switch of its own printer is not on, the control portion 56 waits for a start switch ON signal from the other printer (step 303). When the control portion 56 receives the start switch ON signal, it simultaneously makes both page printers 11, 12 ready (READY state), and turns on the lamp LMP (step 304).

If printing data are transferred from the host apparatus 14 in this state, the first and second printers 11, 12 start printing on the basis of the transferred printing data (step 305). If printing is not finished (step 306), judgement is made as to whether the stop switch is on, whether a stop switch ON signal has been received from the other printer, and whether its own printing apparatus has assumed a state (NOT READY state) in which the printer is not ready due to shortage of toner or the like (steps 307 310). If the answer is NO at any of these steps, printing is continued. If there is no problem henceforth, printing of the total pages is finished (step 306).

If the stop key SPK of its own printer has been operated, the control portion 56 supplies the stop switch ON signal to the other printer so as to simultaneously change the READY state of both page printers 11, 12 to the NOT READY state (stop printing), and turns off the lamp LMP (step 311).

When the stop switch ON signal has been received from the other printer, the control portion 56 also changes the READY state of its own printer to the NOT READY state (stop printing), and turns off the lamp LMP (step 313).

If its own printing apparatus has assumed a state (NOT READY state) in which the printer is not ready due to shortage of toner or other hardware troubles, the control portion 56 stops printing and at the same time supplies a NOT READY signal to the other printer (step 312).

When the control portion 56 receives the NOT READY signal from the other printer, it stops printing and changes the READY state of its own page printer to the NOT READY state (step 314).

In this manner, it is possible to simultaneously start or stop printing by the first and second page printers, thereby removing the problem caused when only one page printer is operated.

Although the double-sided printing system is composed of two page printers in this embodiment, it goes without saying that the double-sided printing system can be composed of printers other than page printers. In addition, page printers disposed in separate box bodies are used in this embodiment, but it goes without saying that the double-sided printing apparatus may be composed of two printing portions and an intermediate buffer device arranged in one box body.

(c) SECOND EMBODIMENT

(a) Entire Structure of Double-sided Printing System

Figure 16:
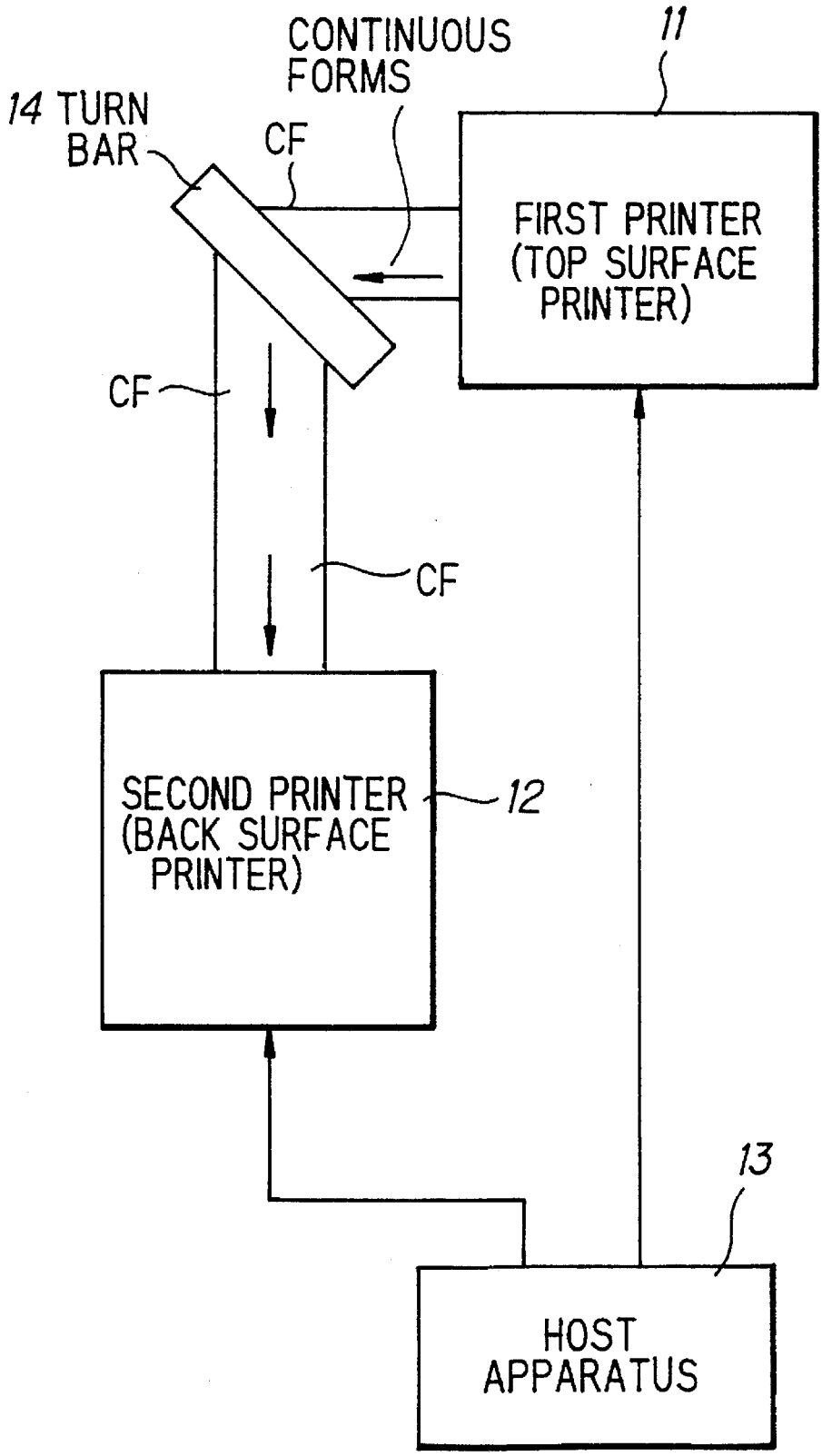
FIG. 16 shows the entire structure of a second embodiment of a double-sided printing system according to the present invention.

FIG. 16 shows the entire structure of a second embodiment of a double-sided printing system according to the present invention. The same reference numerals are provided for the elements which are the same as those in the first embodiment shown in FIG. 4. The reference numeral 11 represents a first printer (page printer), 12 a second printer (page printer), 13 a host apparatus, and 14 a reversing mechanism (turn bar) for reversing the surface of the continuous forms CF. The second embodiment is different from the first embodiment in that the intermediate buffer device 15 is not provided. In the second embodiment, a sensor for detecting the amount of feed of the continuous forms which will be described later, and counters $PC_A$, $PC_B$ for counting the amount of feed of the continuous forms are used in place of the amount of retention detecting portion 16.

The first and second printers 11, 12 have the structures shown in FIGS. 5 and 9, respectively, in the same way as in the first embodiment. The reversing mechanism 14 has the structure shown in FIG. 7. The reversing mechanism is not always necessary. This is because if one of the printers 11, 12 is rotated 180 degrees so that both printers are arranged opposite to each other with the stackers faced to each other, the surface of the continuous forms CF is reversed without any reversing mechanism. In this manner, it is possible to reduce the installation space.

(b) Structure of Control System in Double-sided Printing System

Figure 17:
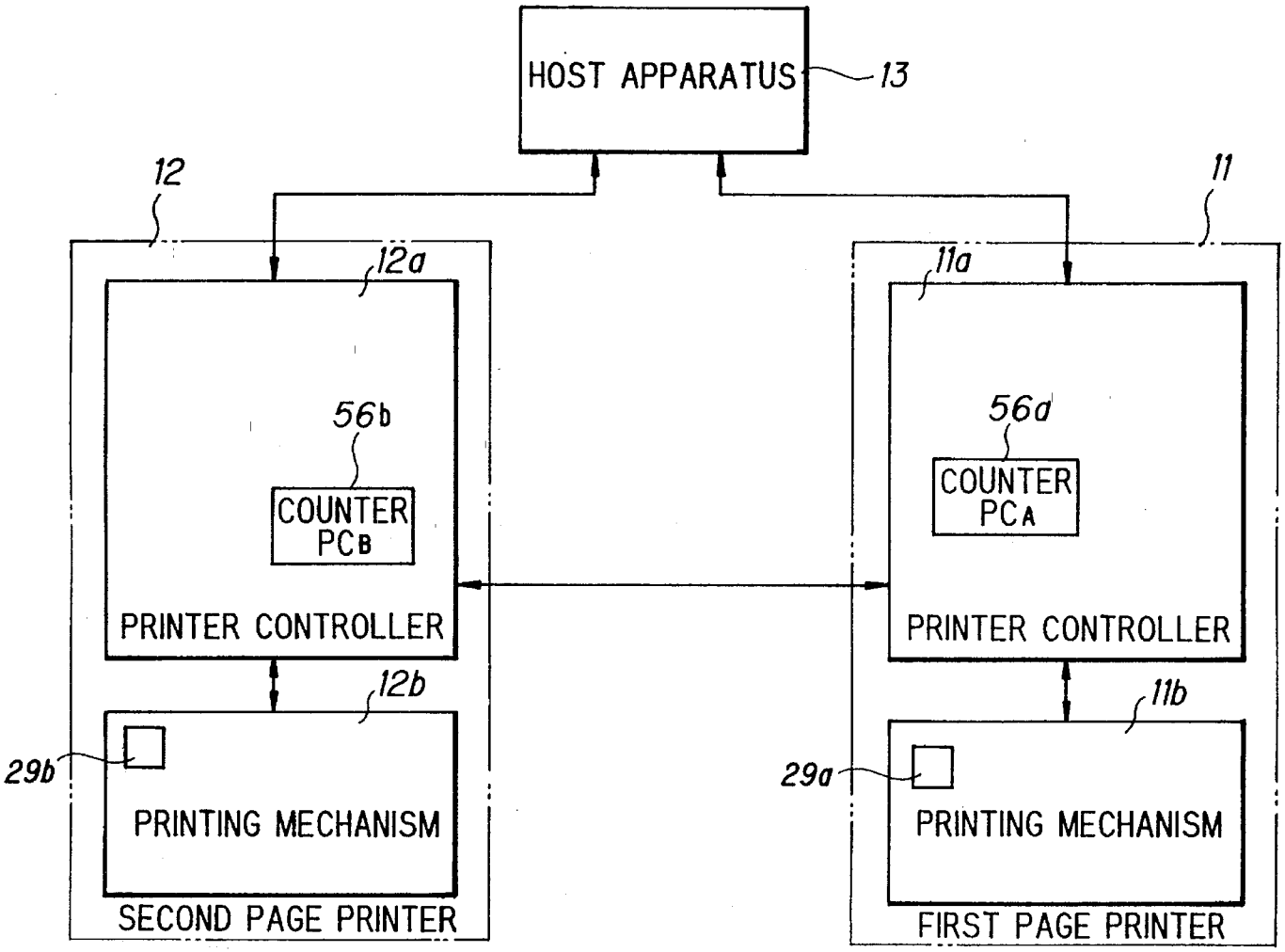
FIG. 17 shows the structure of the control system in the second embodiment shown in FIG. 16.

FIG. 17 shows the structure of the control system in the double-sided printing system. The reference numeral 11 represents a first page printer for printing on a first surface (top surface) of the continuous forms, 12 a second page printer for printing on the second surface (back surface) of the continuous forms, and 13 a host apparatus for transferring printing data which are to be printed on the first and second surfaces to the first and second page printers 11 and 12, respectively. In the first and second page printers 11, 12, the reference numerals 11*a*, 12*a* denote printer controllers for controlling the respective page printers 11, 12 as a whole, and 11*b*, 12*b* printing mechanisms. In the printing mechanisms 11*b*, 12*b*, the reference numeral 29*a*, 29*b* denotes a sensor for detecting the amount of feed of the continuous forms in each printer, 56*a*, 56*b* counters ($PC_A$, $PC_B$) for counting the amount of feed of the continuous forms in the first and second printers 11, 12 after the continuous forms are loaded on the first and second printers 11, 12.

The printer controller 11*a* of the first printer 11 and the printer controller 12*a* of the second printer 12 are communicable with each other, and supply to each other (1) press-down signals for various switches (start switch, stop switch, READY switch, total page printing command switch, paper discharge switch, etc.), (2) a printer state signal, (3) the count value of the counters $PC_A$, $PC_B$. The printer controllers 11*a*, 12*a* control the printing mechanisms 11*b*, 12*b*, respectively, so as to turn on/off various motors and various electrifiers, and to input a printing image. The printer controllers 11*a*, 12*a* also are input signals from various sensors and control the printing mechanism 11*b*, 12*b* on the basis of the sensor signals.

(c) Printer Controller

Figure 18:
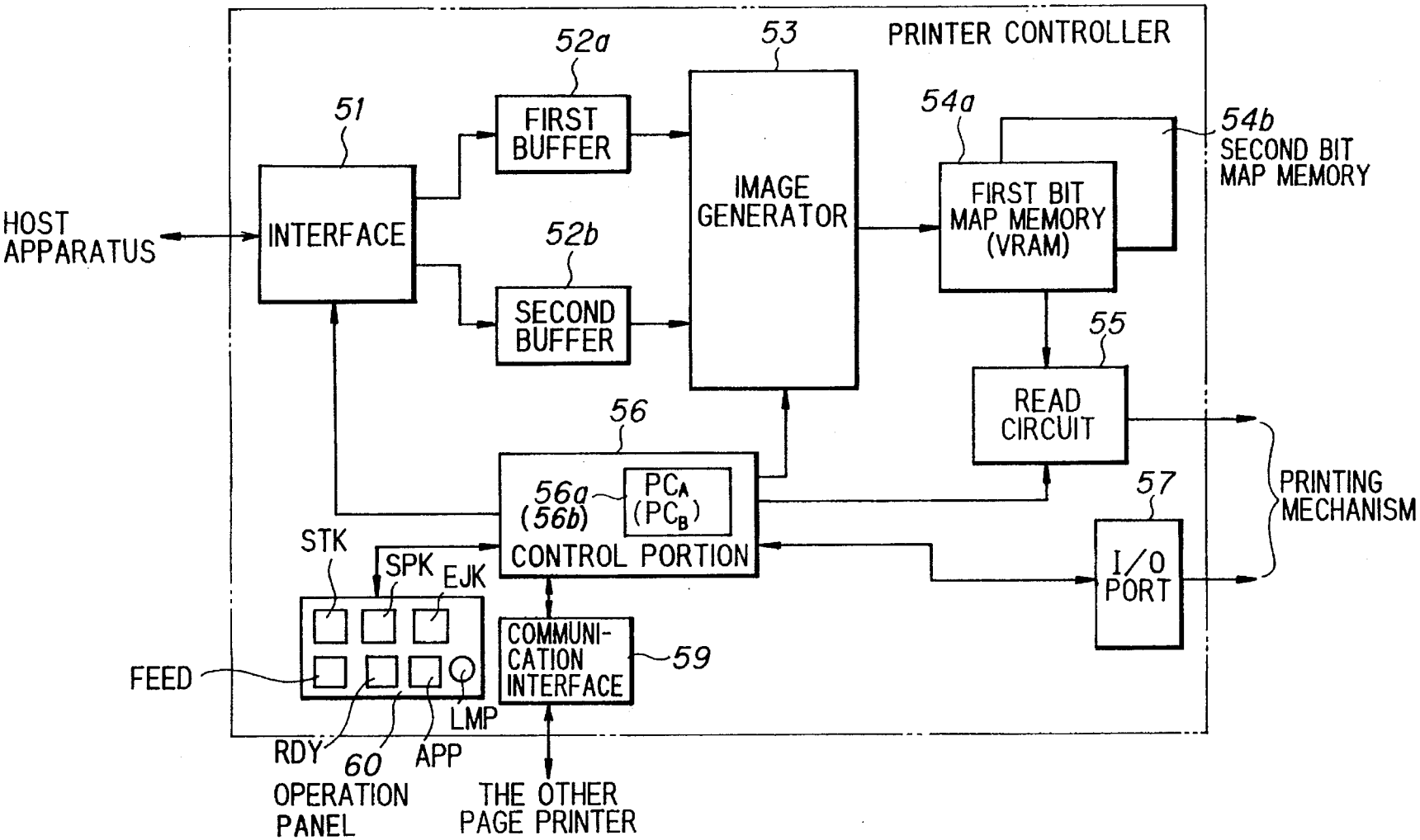
FIG. 18 shows the structure of the printer controller in the second embodiment shown in FIG. 16.

FIG. 18 shows the structure of the printer controller 11*a* (12*a*). The same reference numerals are provided for the elements which are the same as those shown in FIG. 11. The structure shown in FIG, 18 is different from that shown in FIG. 11 in the following points.

(1) The control portion 56 is provided with the counters 56*a*, 56*b* ($PC_A$, $PC_B$) for counting the amount of feed of the continuous forms (e.g., number of forms).

(2) The operation panel 60 is provided with a feed switch FEED for feeding the continuous forms, a READY switch RDY for making the printer ready and a total page printing command switch APP for instructing the printer to print all pages.

(3) The control portion 56 supplies the count value of the counter $PC_A$ or $PC_B$ to the control portion 56 of the other printer through the communication interface 59.

(4) The control portion 56 controls printing on the basis of the count values of the counters $PC_A$, $PC_B$.

(d) Printing Data From Host Apparatus

Figure 19A:
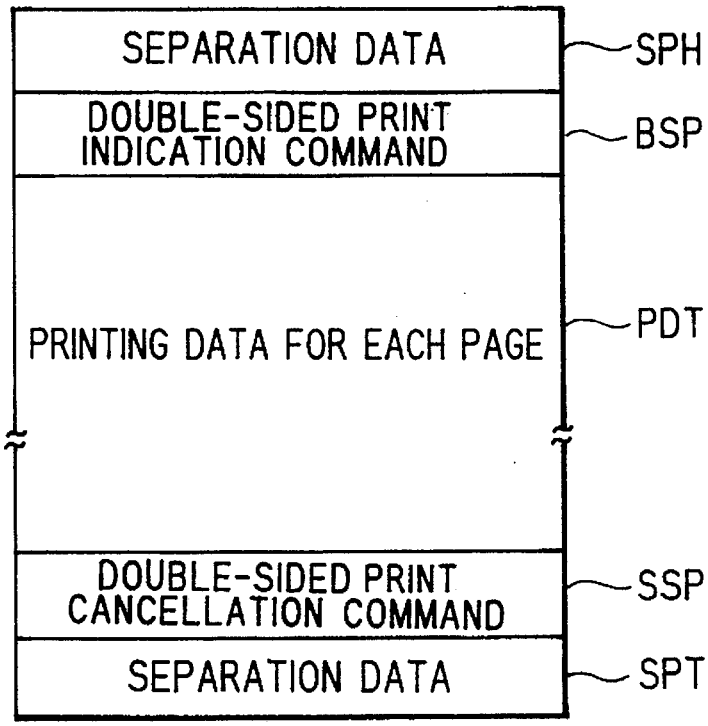
FIGS. 19A to 19C explain the printing data supplied from the host apparatus in the second embodiment shown in FIG. 16.
Figure 19B:
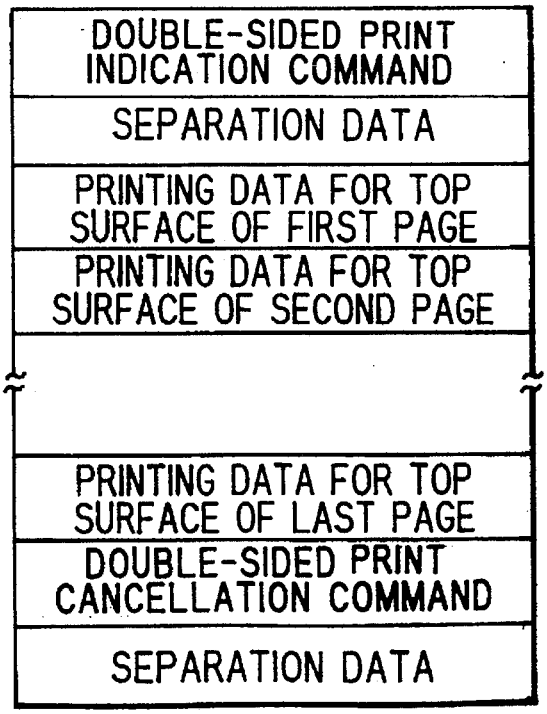
Figure 19C:
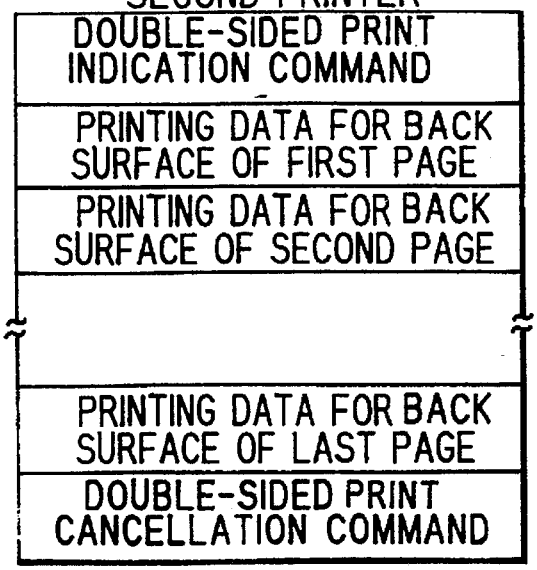

Printing data (see FIG. 19A) for each printing job are separated into printing data for the first and second printers 11, 12 (FIG. 17), as shown in FIGS. 19B and 19C and input to the respective printers 11, 12. The symbol SPH denotes separation data which is to be printed at the head of the job so as to identify a printed matter for each job, BSP a double-sided print indication command for demanding double-sided printing, PDT printing data (user program data) for each page, SSP a double-sided print cancellation command for demanding single-side printing, and SPT separation data which is to be printed at the end of the job so as to identify a printed matter for each job. The first separation data is printed on the top surface, and next printing data are alternately printed on the top surface and the back surface. The last separation data is printed on the top surface. Even if the printing data is finished on the top surface, the last separation data is generally printed on the top surface. At the time of starting double-sided printing, the double-sided print indication command or a similar command is supplied, and at the end of double-sided printing, the double-sided print cancellation command SSP or a similar command such as EOT (End of Transmission) and Mark Form (End of Job) is supplied. The separation data is sometimes omitted.

The printing information shown in FIG. 19B is input to the interface 51 (FIG. 18) of the printer controller 11*a* in the first printer 11, and it is appropriately input to the first and second buffers 52*a*, 52*b*. The printing information shown in FIG. 19C is input to the interface 51 of the printer controller 12*a* in the second printer 12, and it is appropriately input to the first and second buffers 52*a*, 52*b*.

(e) Printing Control

Figure 20:
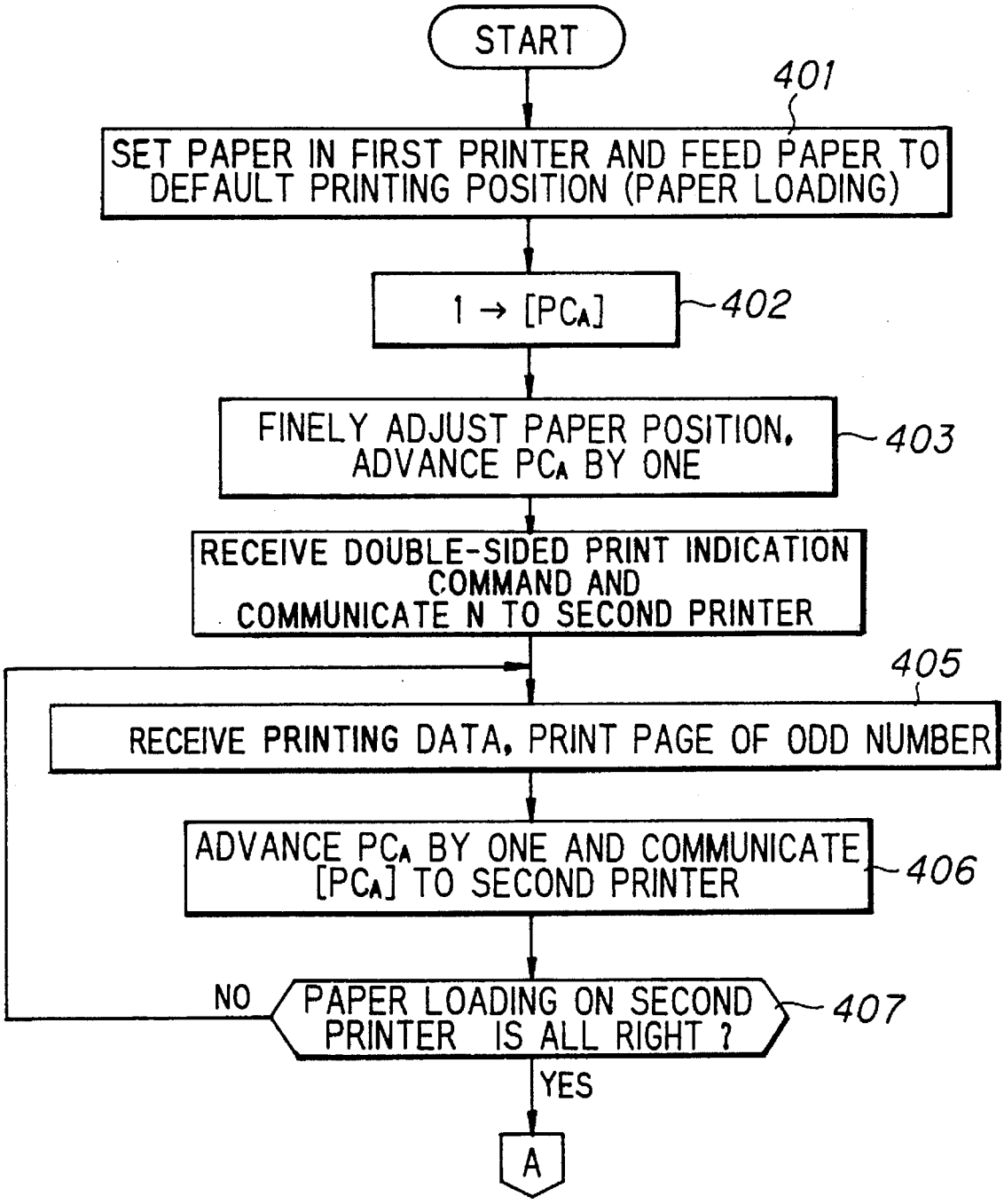
FIG. 20 is a flow chart of a first printing control process.
Figure 21:
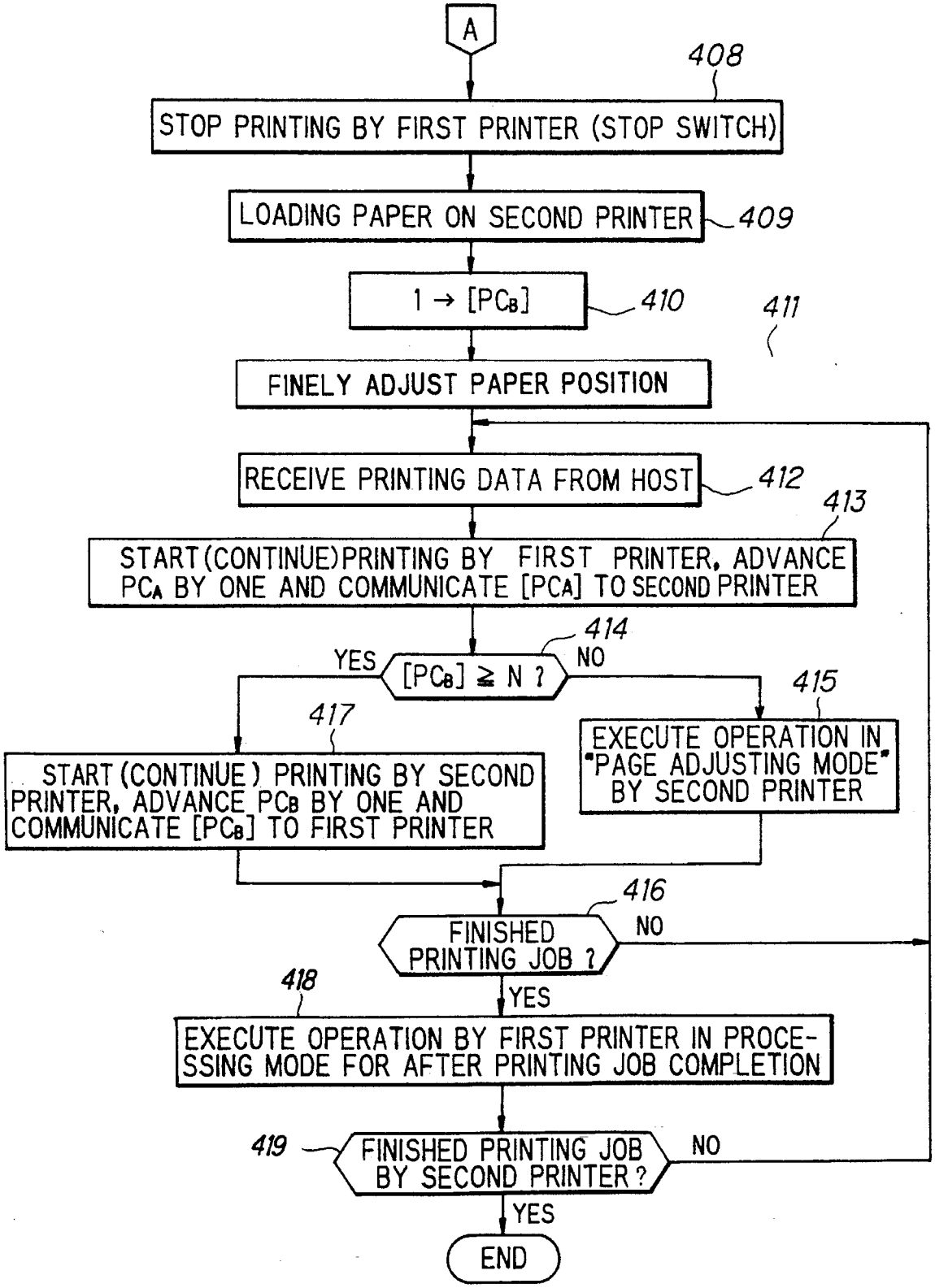
FIG. 21 is a flow chart of the first printing control process continued from that shown in FIG. 20.

FIGS. 20 and 21 are a flow chart of a first printing control process.

The continuous forms CF are set in the first printer 11 and a paper loading switch (not shown) is operated so as to feed the continuous forms to the default printing position (preset printing position) (paper loading, step 401). The paper loading operation is the operation of feeding the continuous forms in order to adjust the printing position of the paper as desired.

The count value of the counter 56*a* (hereinafter referred to as $PC_A$) of the first printer 11 is set to the initial value (=1)(1→[$PC_A$], step 402). In the case of changing the printing position of the paper after the page counter $PC_A$ is initialized, a paper feed knob is turned (fine adjustment) or the feed switch FEED is pressed so as to feed the continuous forms to a desired position (step 403). Notch is provided on the side of a tractor, so that it is possible to print at a desired position by adjusting the position of the paper at which printing is to be started to the notch.

If the amount of feed of the continuous forms CF fed by the feed switch FEED exceeds the length of one page, the counter $PC_A$ counts one every time one page is fed. Even if 1.1 pages or 1.2 pages are fed by operating the feed switch FEED, the fraction 0.1 or 0.2 is discarded and only one is add to the counter $PC_A$.

After the completion of the paper setting operation, the READY switch RDY of the first printer 11 is pressed up so as to inform the host apparatus (host computer or the like) 13 of the on-line state. The host apparatus 13 then supplies the printing information (separation data is not contained here) shown in FIGS. 19B and 19C to the printer controllers 11*a*, 12*a* of the first printer 11 and the second printer 12, respectively.

The printer controller 11*a* of the first printer 11 executes the double-sided print indication command which is first supplied from the host apparatus 13 and supplies the count value (=N) of the counter $PC_A$ at that time to the printer controller 12*a* of the second printer 12 (step 404). The second printer 12 recognizes from the count value N that the first page is printed on the N-th page.

The interface 51 of the first printer 11 then receives the printing data (FIG. 19B) from the host apparatus 13, generates the dot image data by using the printing data, and prints the data on the top surface of the continuous forms (step 405). The printer controller 11a of the first printer 11 advances the count value [$PC_A$] of the counter $PC_A$ by one and supplies the new count value [$PC_A$] to the second printer 12 every time one page of the continuous forms is fed (step 406).

Judgement is then made as to whether or not an appropriate number of pages which favorably allows the continuous forms to be loaded on the second printer 12 (step 407) have been printed, and if the answer is NO, the process returns to the step 405 to repeat the subsequent processing.

If the answer is YES at the step 407, the stop switch SPK of the first printer 11 is operated so as to stop printing by the first printer 11 (step 408). The appropriate number of pages which favorably allows the continuous forms to be loaded on the second printer 12 is determined by investigating in advance the appropriate number of pages which are to be drawn out of the paper discharge of the first printer 11 when the two printers 11, 12 are installed. However, since this amount is not strict, the operation is easy. For example, it is considered to be appropriate when five to eight pages of the continuous forms are stacked on the floor. The stop switch SPK may be manually operated without any trouble in a normal printing operation. It is naturally possible to adopt a structure for automatically stopping printing by the first printer 11 when the amount of the continuous forms preset in the first printer 11 is output.

When the operation of the first printer 11 is suspended, the continuous forms are loaded on the second printer 12 at the printing position (step 409), and the count value of the counter 56*a* ($PC_B$) is set to the initial value (1) (1→[$PC_B$], step 410). If necessary, the paper feed knob is rotated so as to finely adjust the printing position in the range which does not influence the count value of the counter $PC_B$ (step 411).

When fine adjustment is finished in this way, the READY switches RDY of the first printer 11 and the second printer 12 are operated so as to inform the host apparatus 13 that both printers 11, 12 are in the on-line state. The host apparatus 13 then supplies printing data to the first and second printers 11, 12 (step 412). It is possible to adopt a structure for activating both printers 11, 12 when the READY switch RDY of either of the printers 11, 12 is operated.

The first printer 11 resumes printing the received data for a page of an odd number on the top surface, advances the count value [$PC_A$] of the counter $PC_A$ by one every time one page is fed, and at the same time supplies the count value [$PC_A$] to the second printer 12 (step 413).

The printer controller 12*a* of the second printer 12 judges whether or not the count value [$PC_B$] of the counter $PC_B$ is equal to N (the first page is printed on the N-th page by the first printer 11) (step 414). If the answer is in the negative, the second printer 12 feeds the continuous forms in the "page adjusting mode" until the count value [$PC_B$] of the counter $PC_B$ of the second printer 12 becomes N (step 415). The "page adjusting mode" is a mode for feeding the continuous forms by the amount corresponding to the increment n (n is an integer of not less than 1, for example, 1) of the count value of the counter $PC_A$ of the first printer 11 every time the count value of the counter $PC_A$ increases by n and increasing the count value of the counter $PC_B$ by n. Judgement is then made as to whether or not the first printer 11 has finished the printing job (step 416), and if it has not been finished, the processing at the step 412 and thereafter is repeated.

When the count value of the counter $PC_B$ becomes equal to N while the first printer 11 continues printing or as a result of feeding the continuous forms in the "page adjusting mode", the printer controller 12*a* of the second printer 12 prints the printing data received on the back surface and simultaneously advances the count value of the counter $PC_B$ one by one (step 417). Judgement is then made as to whether or not the first printer 11 has finished the printing job (step 416), and if it has not been finished, the processing at the step 412 and thereafter are repeated. If the printing job has been finished by the first printer 11, the first printer 11 executes the operation in a later-described afterprocessing mode which is to be adopted after the end of a printing job (step 418). Judgement is then made as to whether or not the second printer 12 has finished the printing job (step 419), and if it has not been finished, the processing at the step 412 and thereafter is repeated.

In this manner, it is possible to print pages of even numbers exactly on the back surfaces of the corresponding pages of odd numbers.

(f) Another Printing Control

Figure 22:
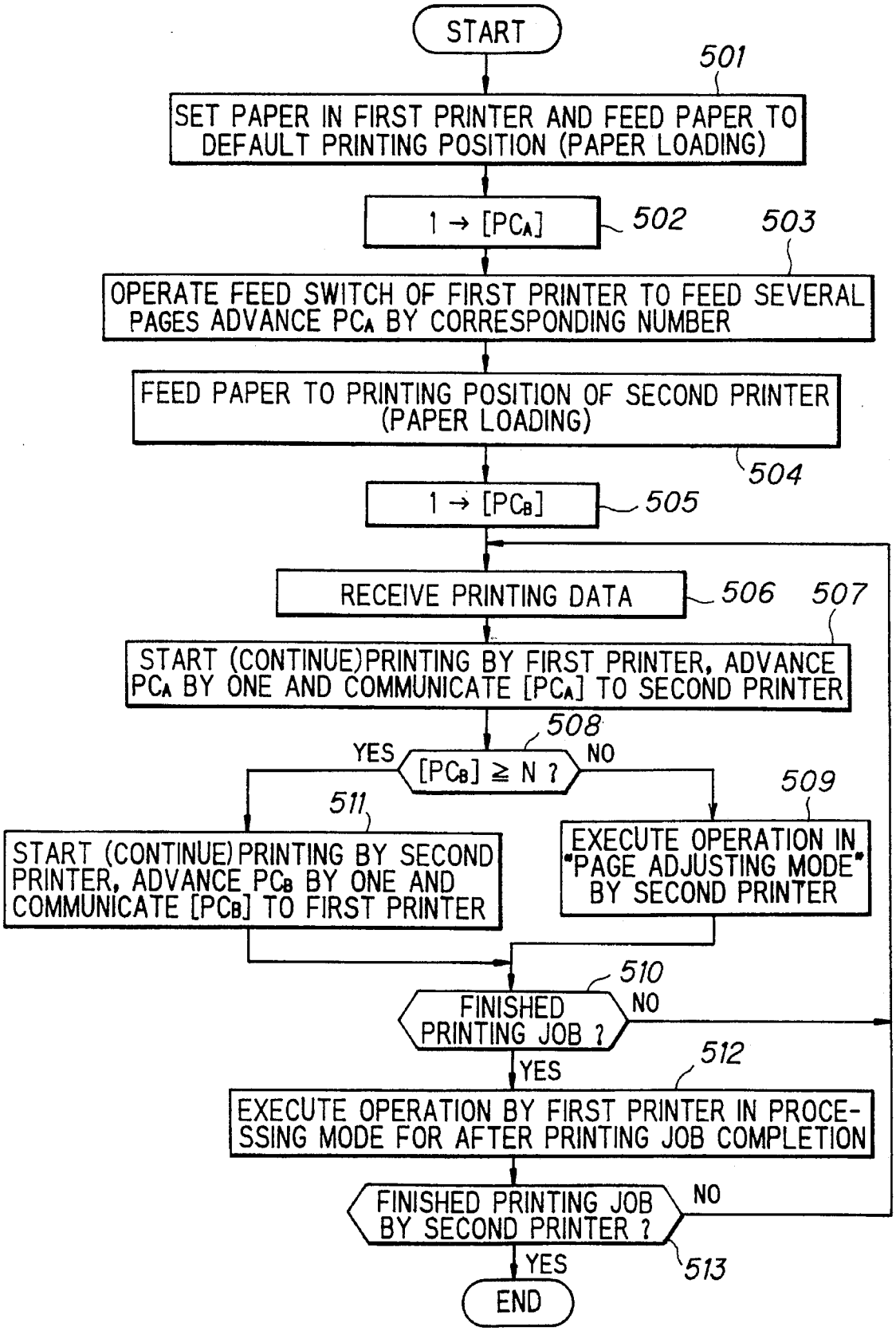
FIG. 22 is a flowchart of a second printing control process.

FIG. 22 is a flow chart of a second printing control process.

According to the first printing control process, since it is possible to start printing when the continuous forms are loaded on the first printer, the continuous forms are used efficiently without wasting. It is, however, necessary to stop printing by the first printer 11 in order to load the continuous forms on the second printer 12 at the point of time where loading of the continuous forms on the second printer 12 becomes possible. For this operation, the worker cannot leave the printers until he loads the continuous forms on the second printer 12, and the troublesome operation of loading continuous forms is required twice.

As a countermeasure, in a second printing control process, continuous forms are simultaneously loaded on the first and second printers 11, 12 before printing.

The continuous forms are set in the first printer 11 and the paper loading switch is operated so as to feed the continuous forms to the printing position (paper loading, step 501). The count value [$PC_A$] of the counter $PC_A$ of the first printer 11 is set to the initial value (=1)(1→[$PC_A$], step 502). Thereafter, the feed switch FEED of the first printer 11 is pressed so as to feed the continuous forms by several pages until it is possible to load the continuous forms on the second printer 12, and the count value [$PC_A$] of the counter $PC_A$ is advanced by one every time one page is fed (step 503).

The continuous forms are then loaded on the second printer 12 at the printing position (step 504), and at this time the count value [$PC_A$] of the counter $PC_A$ becomes N. Thereafter, the count value [$PC_B$] of the counter $PC_B$ of the second printer 12 is set to the initial value (=1)(1→[$PC_B$], step 505). The READY switches RDY of the first printer 11 and the second printer 12 are operated so as to inform the host apparatus 13 that both printers 11, 12 are in the on-line state. The host apparatus 13 then supplies printing data to the first and second printers 11, 12 (step 506).

The first printer 11 starts printing the received data for a page of an odd number on the top surface, advances the count value [$PC_A$] of the counter by one every time one page is fed, and at the same time supplies the new count value [$PC_A$] to the second printer 12 (step 507).

The printer controller 12*a* of the second printer 12 judges whether or not the count value [$PC_B$] of the counter $PC_B$ is equal to N (the first page is printed on the N-th form by the first printer 11) (step 508). If the answer is in the negative, the second printer 12 feeds the continuous forms in the "page adjusting mode" until the count value [$PC_B$] of the counter $PC_B$ of the second printer 12 becomes N (step 509). In other words, the continuous forms are fed by the amount corresponding to the increment n (n is an integer of not less than 1, for example, 1) of the counter $PC_A$ of the first printer 11 every time the count value of the counter $PC_A$ increases by n and increases the count value of the counter $PC_B$ by n. Judgement is then made as to whether or not the first printer 11 has finished the printing job (step 510), and if it has not been finished, the processing at the step 506 and thereafter is repeated.

When the count value of the counter $PC_B$ becomes equal to N while the first printer 11 continues printing or as a result of feeding the continuous forms in the "page adjusting mode", the printer controller 12*a* of the second printer 12 prints the printing data received on the back surface and simultaneously advances the count value of the counter $PC_B$ one by one (step 511). Judgement is then made as to whether or not the first printer 11 has finished the printing job (step 510), and if it has not been finished, the processing at the step 506 and thereafter is repeated. If the printing job has been finished by the first printer 11, the first printer 11 executes the operation in a later-described afterprocessing mode which is to be adopted after the end of a printing job (step 512). Judgement is then made as to whether or not the second printer 12 has finished the printing job (step 513), and if it has not been finished, the processing at step 506 and thereafter are repeated.

In this manner, it is possible to execute double-sided printing after only one loading operation without stopping the printing operation by the first printer and to print pages of even numbers exactly on the back surfaces of the corresponding pages of odd numbers.

(g) Double-sided Printing and Single-side Printing Control

Double-sided printing is not always necessary in all pages. Some pages are to be printed only on the top surfaces or on the back surfaces. If the number of pages which require single-side printing is only one to several, the host apparatus may supply a skip page command to the printer which is not required to print, thereby feeding the corresponding number of blank pages. However, if the number of pages which require single-side printing is several ten to several hundred, it is advantageous to cancel the double-sided print indication command and to supply a single-side printing command so as to stop supply of printing data from the host apparatus to the printer which has no job. In general single-side printing, not the back surface but the top surface are printed in most cases.

Accordingly, in the present invention, a double-sided print indication command and a double-sided print cancellation command are provided as commands to be supplied from the host apparatus. In the case of a double-sided printing job, the host apparatus supplies printing data sandwiched between the double-sided print indication command and the double-sided print cancellation command to the first and second printers (see FIG. 19). On the other hand, in the case of single-side printing, the double-sided print cancellation command is supplied to the first and second printers prior to printing data for a single surface so as to make the first and second printers ready for single-side printing.

Figure 23:
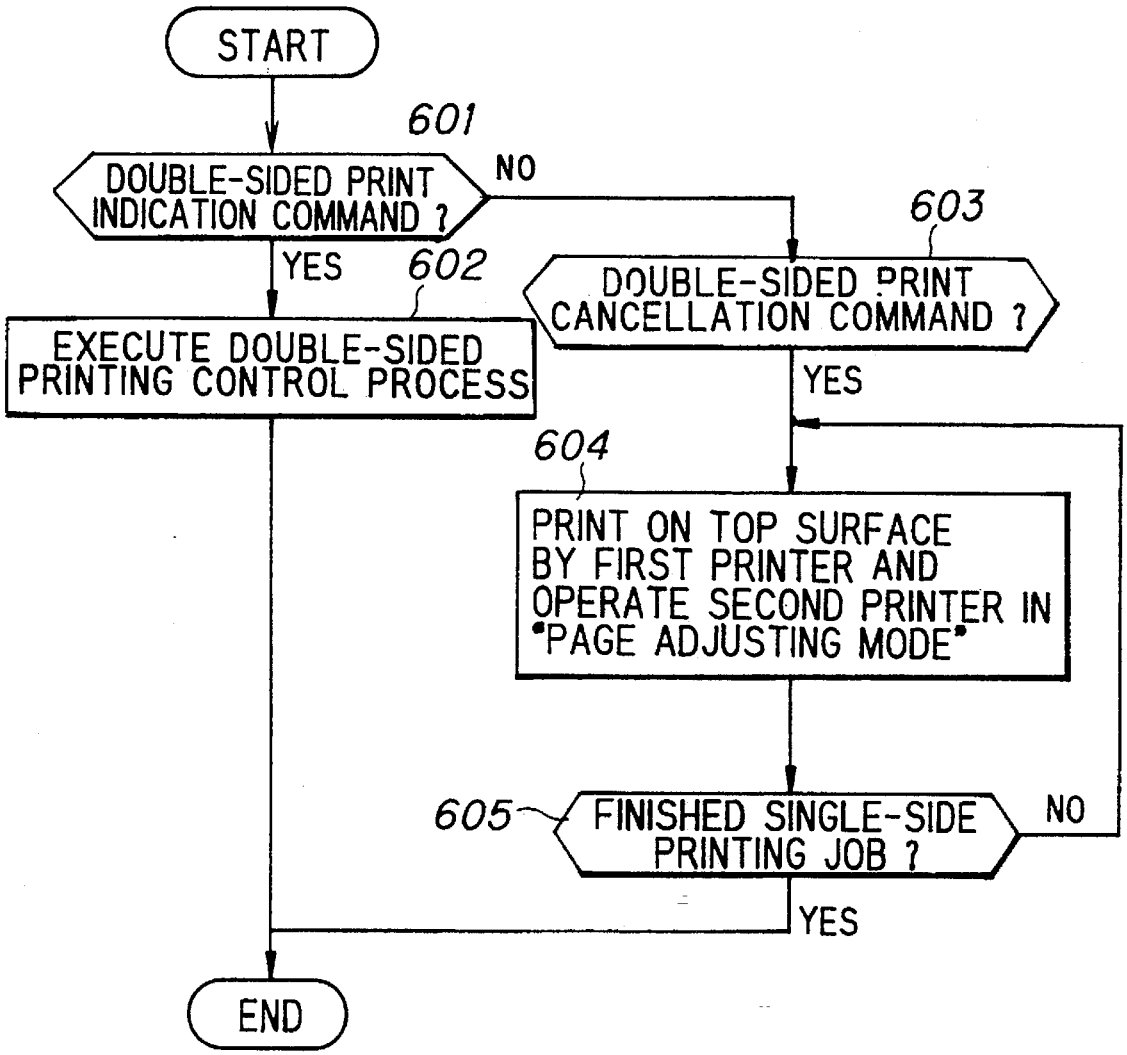
FIG. 23 is a flow chart of a single-side printing and double-sided printing control process.

FIG. 23 is a flow chart of a single-side printing and double-sided printing control process.

The first and second printers 11, 12 judge whether or not the double-sided print indication command is issued from the host apparatus 13 (step 601), and if the answer is YES, the double-sided printing control, which is explained with reference to FIG. 22, is executed (step 602). Briefly speaking, the following operations are executed.

(1) The printer controller 11*a* of the first printer 11 supplies the count value N of the counter $PC_A$ at the point of time where the double-sided print indication command is executed, to the printer controller 12*a* of the second printer 12, and thereafter executes printing the pages of odd numbers on the top surface.

(2) The printer controller 12*a* of the second printer 12 feeds the continuous forms by the amount corresponding to the increment n of the counter $PC_A$ every time the count value of the counter $PC_A$ increases by n until the count value of the counter $PC_B$ becomes equal to the supplied count value N. When the count value of the counter $PC_B$ becomes equal to N, the second printer 12 starts printing a page of an even number on the back surface.

When the double-sided print cancellation command is issued (step 603), the first and second printers 11, 12 assume a single-side printing state. In this case, the first printer 11 prints the input print data for all pages on the top surface and advances the count value of the counter $PC_A$ by one every time one form is fed. The second printer 12 executes the operation in the "page adjusting mode". That is, the second printer 12 feeds the continuous forms by the amount corresponding to the increment n of the counter $PC_A$ of the first printer 11 every time the count value of the counter $PC_A$ increases by n, and increases the count value of the counter $PC_B$ by n (step 604). The second printer 12 repeats this operation until the single-side printing job by the first prints 11 is finished (steps 605, 604).

(h) Printing Control Based On Amount of Retention of Continuous Forms

During double-sided printing, the first printer 11 and the second printer 12 supply the count values $[PC_A]$, $[PC_B]$ of the counters $PC_A$, $PC_B$ to each other. The counter $PC_A$ counts the amount of feed of the continuous forms in the first printer 11 as the number of pages, and the counter $PC_B$ counts the amount of feed of the continuous forms in the second printer 12 as the number of pages. At the starting time, N pages of the continuous forms are existent between the first and the second printers 11, 12. However, the amount of continuous forms between the first and second printers 11, 12 changes due to the difference in printing speed between the two printers, so that the amount of retention of the continuous forms sometimes becomes too small or too large.

It is possible to represent the amount of continuous forms existing between the first and second printers 11, 12 by the difference $([PC_A]-[PC_B])$ between the count values $[PC_A]$, $[PC_B]$ of the counters $PC_A$, $PC_B$. If it is assumed that the difference corresponding to the level L1 in FIG. 1 is N1, the difference corresponding to the level L2 is N2, the difference corresponding to the level L1R is N1R, and the difference corresponding to the level L2R is N2R, printing control based on the amount of retention of the continuous forms similar to the printing control in the first embodiment is possible.

Figure 24:
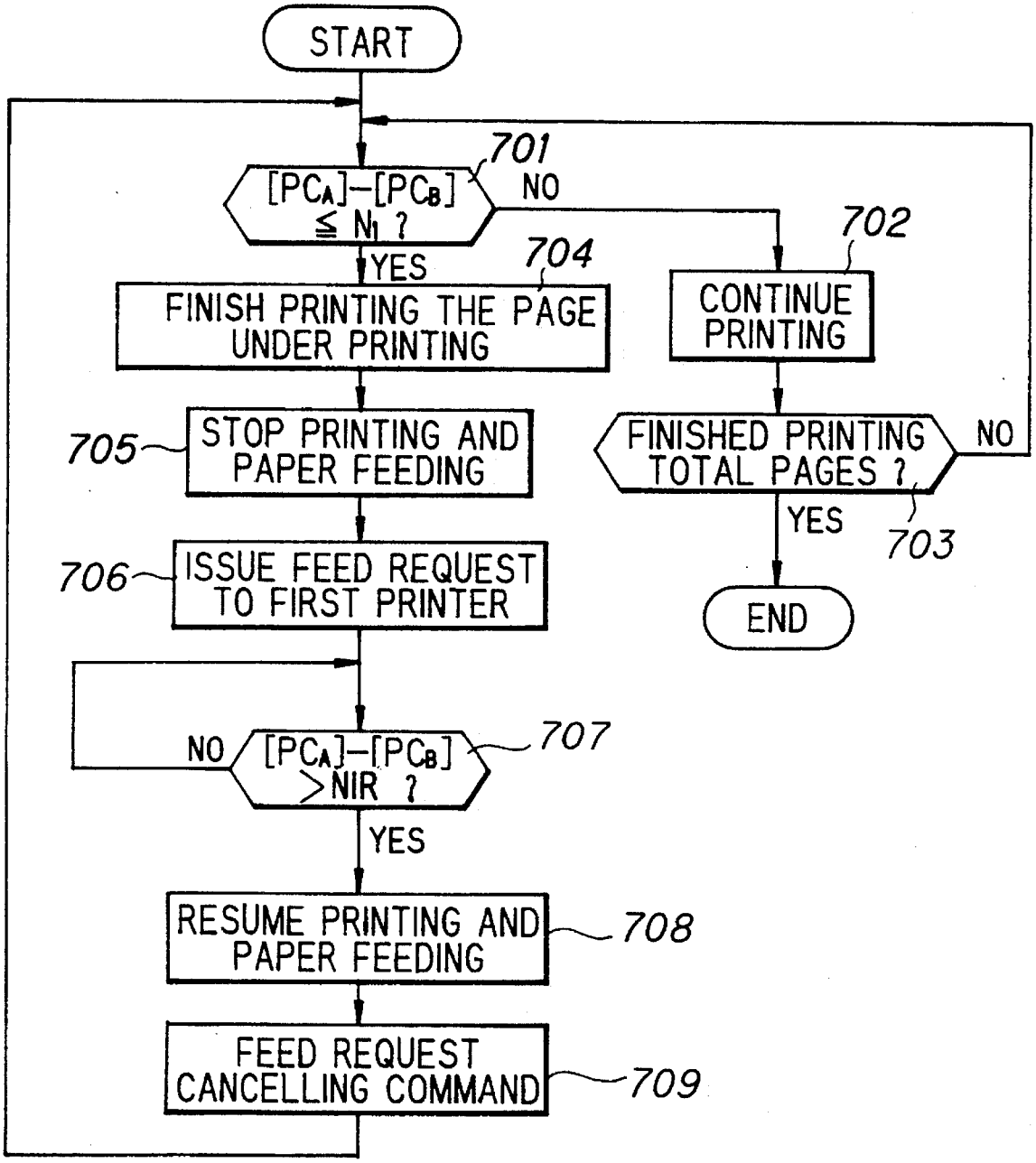
FIG. 24 is a flow chart of the process executed by the second printer when the amount of retention of the continuous forms becomes small.
Figure 25:
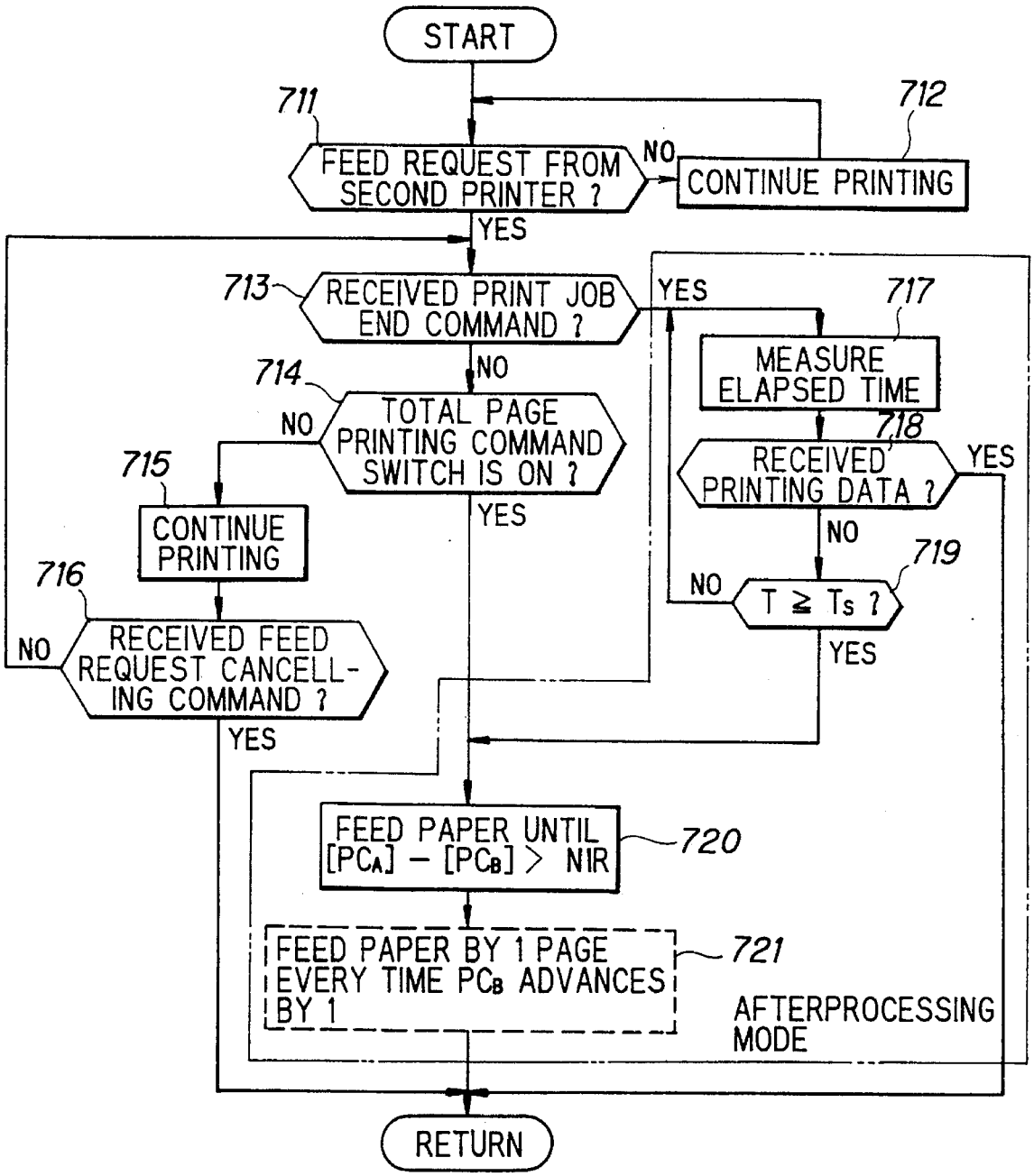
FIG. 25 is a flow chart of the process executed by the first printer when the amount of retention of the continuous forms becomes small.

(h-1) Printing Control When the Amount of Retention of the Continuous Forms Becomes Small FIGS. 24 and 25 are flow charts of the process executed by the first printer 11 and the second printer 12 when the amount of retention of the continuous forms becomes small.

When the printing speed of the second printer 12 is higher than that of the first printer 11, the amount of retention of the continuous forms between the first and second printers 11, 12 reduces, and the difference between the count values $[PC_A]$, $[PC_B]$ of the counters $PC_A$, $PC_B$ also proportionally reduces. The control portion 56 of the second printer 12 constantly judges whether or not the difference $([PC_A]-[PC_B])$ is below the first set value N1 (step 701). If the answer is in the negative, the printing operation is continued (step 702), and judgement is then made as to whether or not the printing of all pages has been finished (step 703). If the answer is YES, the process is finished, while if the answer is NO, the process returns to the step 701.

If the difference is below N1 at the step 701, the control portion 56 of the second printer 12 prints the page under printing (step 704), and thereafter stops paper feeding and printing (step 705). If the back surface is in course of printing, the control portion 56 issues a feed request to the control portion 56 of the first printer 11 (step 706).

The second printer 12 is suspended until the difference $([PC_A]-[PC_B])$ exceeds the third set value N1R (step 707). If the difference $([PC_A]-[PC_B])$ exceeds N1R after the continuous forms are fed by the first printer 11, the control portion 56 resumes printing and paper feeding by the second printer 12 (step 708), and cancels the feed request (step 709). The process returns to the start so as to continue printing.

The control portion 56 of the first printer 11 constantly judges whether or not a feed request is supplied from the second printer 12 (step 711), and if there is no feed request, the first printer 11 continues printing (step 712). On the other hand, if the difference $([PC_A]-[PC_B])$ falls below N1 and a feed request is issued from the second printer 12, the control portion 56 of the first printer 11 judges whether or not the first printer 11 has received the command which corresponds to a printing job end command (step 713). If the answer is NO, judgement is made as to whether or not the total page printing command switch APP is on (step 714). If the answer is NO, printing is continued (step 715). Judgement is then made as to whether or not a feed request cancelling command has been issued from the second printer 12 (step 716), if the command has been issued, the process returns to the start so as to repeat the subsequent processing. The fact that the feed request cancelling command has been issued from the second printer 12 means that the difference $([PC_A]-[PC_B])$ has naturally become more than N1R as a result of feeding the continuous forms by the first printer 11, or that all the printing job has been finished by the second printer 12.

On the other hand, if the command which corresponds to a printing job end command has been received at the step 713, the continuous forms are not fed thenceforth by the first printer 11 unless next printing data is received. In this case, the difference $([PC_A]-[PC_B])$ never exceeds N1R, so that printing on the back surface by the second printer 12 is not finished. Consequently, when a printing job end command or the like is received, the subsequent processing is executed in an afterprocessing mode which is to be adopted after the end of a printing job. In the afterprocessing mode, the time elapsed after the printing job end command is received is measured (step 717). Whether or not next printing data has been received is then judged (step 718), and if the answer is in the negative, whether or not the elapsed time T has reached a preset time Ts is judged (step 719).

If $T<Ts$, the process returns to the step 717 and the subsequent processing is repeated. If next printing data is received before T reaches Ts, since the continuous forms are fed by the first printer 11 and $([PC_A]-[PC_B])$ exceeds N1R, the process returns to the start and the subsequent processing are repeated.

If T has reached Ts at the step 719 without receiving next printing data, the control portion 56 automatically feeds the continuous forms until $[PC_A]-[PC_B])$ exceeds N1R. The second printer 12 then starts printing (step 720). The process then returns to the start and the subsequent processing are repeated. If the total page printing command switch APP is on at the step 714, the processing at the step 720 is also executed and the process then returns to the start.

According to the processing at the step 720, $[PC_A]-[PC_B])$ falls below N1 again after several pages are printed. As a result, the above-described operations are repeated, so that high-speed printing is impossible. As a countermeasure, step 721 is provided in the present invention. When the second printer 12 resumes printing because $([PC_A]-[PC_B])$ exceeds N1R after the continuous forms are fed by the first printer 11, the second printer 12 periodically supplies the count value of the counter $PC_B$ to the first printer 11. The first printer 11 feeds the continuous forms by one form and advances the count value of the counter $PC_A$ by 1 every time the count value $[PC_B]$ advances by 1. This operation is repeated until the second printer 12 finishes printing (step 721). In this way, it is possible to print to the end without stopping after printing is resumed.

When the first printer 11 feeds the continuous forms until $([PC_A]-[PC_B])$ exceeds N1R at the step 720, the second printer 12 must skip printing on the back surface of the fed pages. Therefore, the control portion 56 of the first printer 11 stores the count values of the counter $PC_A$ before and after feeding the continuous forms at the step 720, and supplies the count value to the second printer 12 so that the second printer 12 skips printing on the back surface of the corresponding fed pages.

Figure 26:
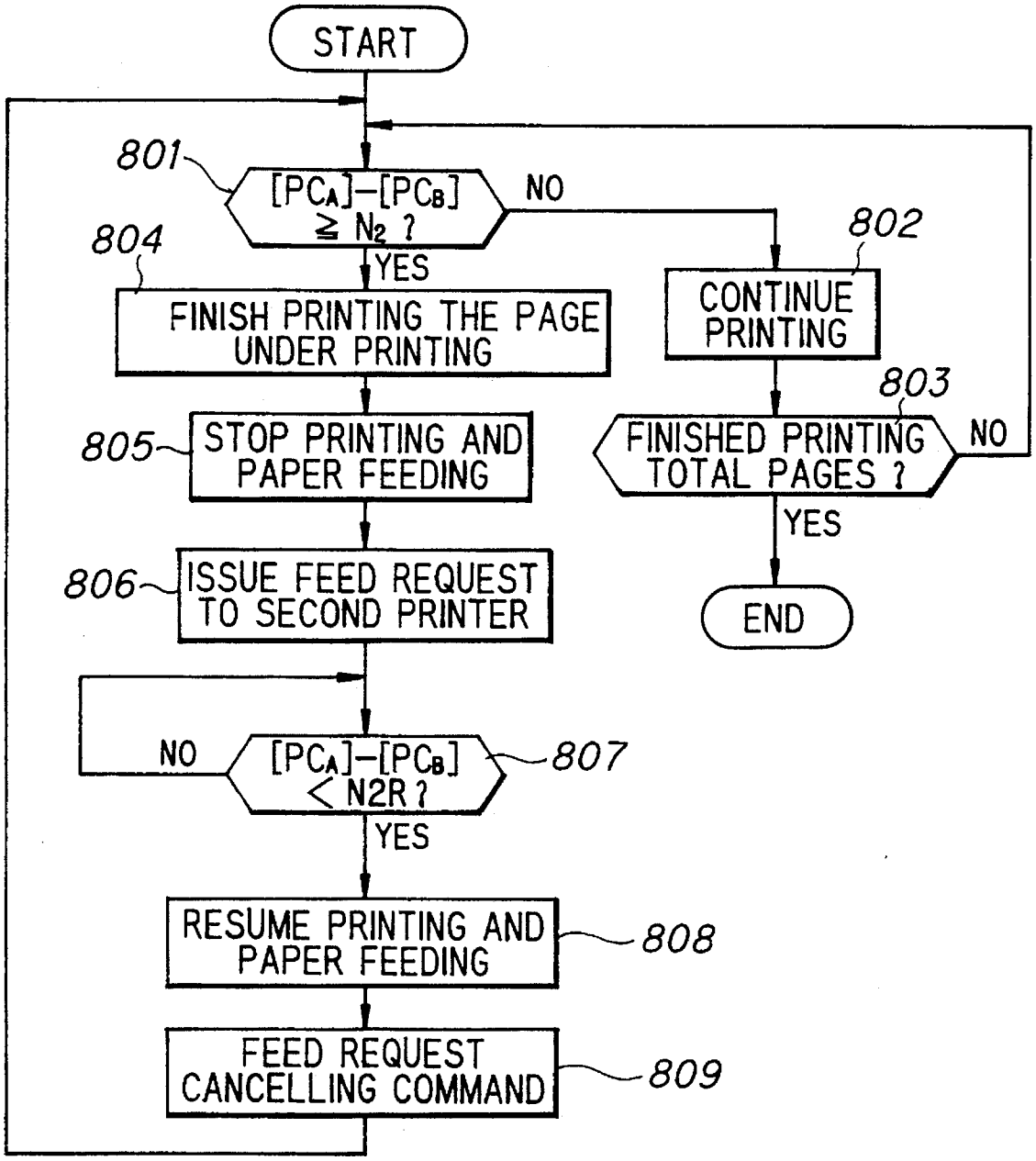
FIG. 26 is a flow chart of the process executed by the first printer when the amount of retention of the continuous froms becomes large.
Figure 27:
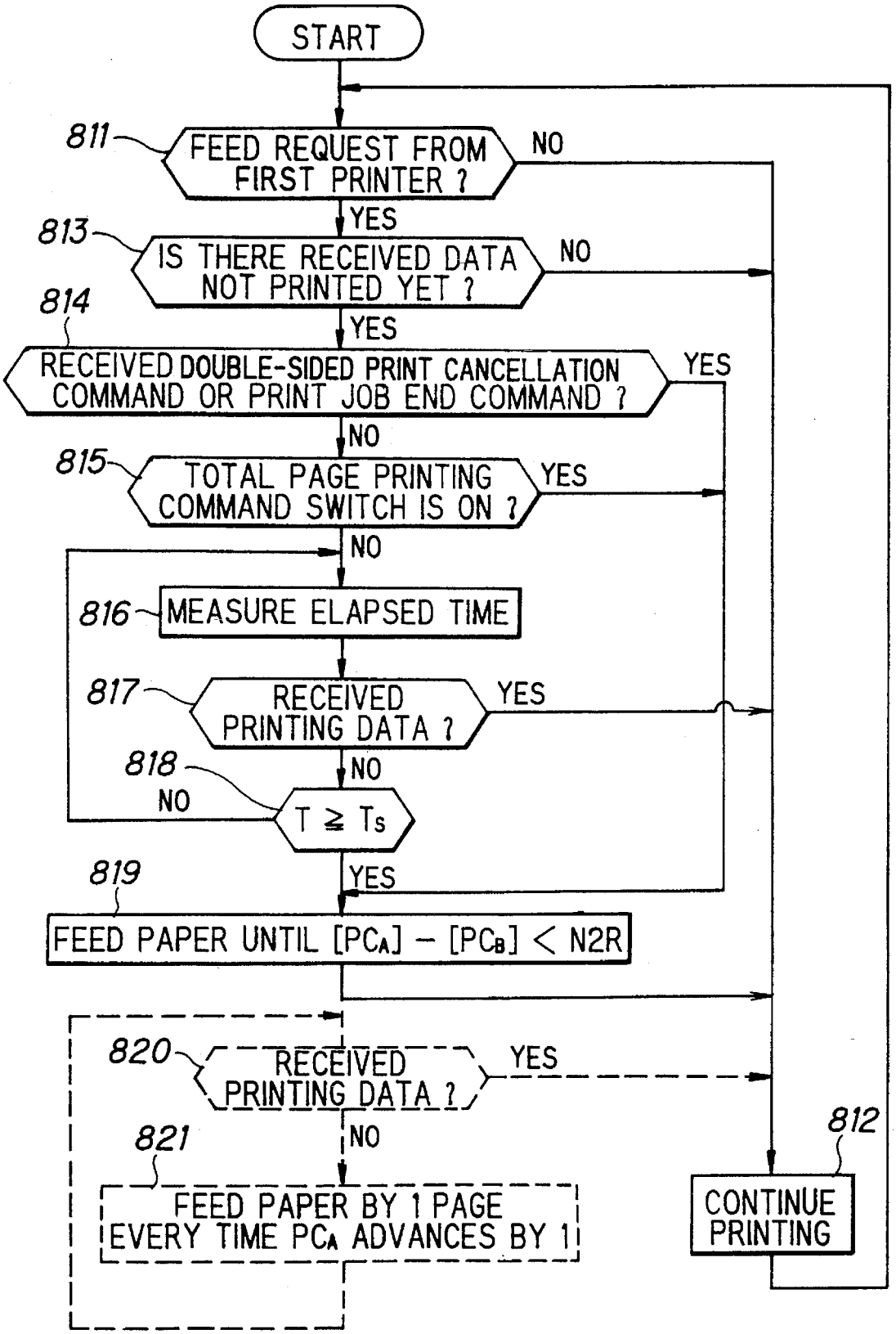
FIG. 27 is a flow chart of the process executed by the second printer when the amount of retention of the continuous forms becomes large.

(h-2) Printing Control When the Amount of Retention of the Continuous Forms Becomes Large FIGS. 26 and 27 are flow charts of the process executed by the first printer 11 and the second printer 12 when the amount of retention of the continuous forms becomes large.

When the printing speed of the first printer 11 is higher than that of the second printer 12, the amount of retention of the continuous forms between the first and second printers 11, 12 increases, and the difference between the count values $[PC_A]$, $[PC_B]$ of the counters $PC_A$, $PC_B$ also proportionally increases. The controlling portion 56 of the first printer 11 constantly judges whether or not the difference $([PC_A]-[PC_B])$ is more than the second set value N2 (step 801). If the answer is in the negative, the printing operation is continued (step 802), and judgement is then made as to whether or not the printing of all pages has been finished (step 803). If the answer is YES, the process is finished, while if the answer is NO, the process returns to the step 801.

If the difference is more than the second set value N2 at the step 801, the control portion 56 of the first printer 11 prints the page under printing (step 804), and thereafter stops paper feeding and printing (step 805). If the top surface is in course of printing, the control portion 56 issues a feed request to the control portion 56 of the second printer 12 (step 806).

The first printer 11 is suspended until the difference $([PC_A]-[PC_B])$ falls below the fourth set value N2R after the continuous forms are fed by the second printer 12 (step 807). If the difference $([PC_A]-[PC_B])$ falls below N2R, the control portion 56 resumes printing and paper feeding by the first printer 11 (step 808), and cancels the feed request (step 809). The process returns to the start so as to continue printing.

The control portion 56 of the second printer 12 constantly judges whether or not a feed request is supplied from the first printer 11 (step 811), and if there is no feed request, continues printing by the second printer 12 (step 812). On the other hand, if the difference $([PC_A]-[PC_B])$ exceeds N2 and a feed request is issued from the first printer 11, data which has not yet been printed are printed (steps 813, 812, 811). Thereafter, judgement is made as to whether or not a double-sided print cancellation command or a printing job command has been received (step 814). If the answer is NO, judgement is made as to whether or not the total page printing command switch APP of the first printer 11 or the second printer 12 is on (step 815). If the answer is NO, the elapsed time is measured (step 816). Judgement is then made as to whether or not next printing data is received (step 817). If the answer is NO, whether or not the elapsed time T has reached a preset time Ts is judged (step 818).

If $T<Ts$, the process returns to the step 816 and the subsequent processing is repeated. If next printing data is received before T reaches Ts, printing is continued (step 812) and the process then returns to the step 811 so as to repeat the subsequent processing.

On the other hand, if there is data which has not been processed at the step 813, printing is continued (step 812) and the process then returns to the step 811 so as to repeat the subsequent processing.

If the double-sided print cancellation command or a printing job end command has been received at the step 814, or if $T \geqq Ts$ at the step 818, the control portion 56 automatically feeds the continuous forms until $([PC_A]-[PC_B])$ falls below N2R. The first printer 11 then starts printing (steps 819, 812). Printing is thereafter continued. The process then returns to the start and the processing at the step 811 and thereafter are repeated. If the total page printing command switch APP is on at the step 815, the processing at the step 819 is also executed and printing is continued. The process then returns to the start and the processing at the step 811 and thereafter is repeated.

According to the processing at the step 819, $[PC_A]-[PC_B]$ exceeds N2 again after printing several pages. As a result, the above-described operations are repeated, so that high-speed printing is impossible. As a countermeasure, in the present invention, steps 820 and 821 are provided. When the first printer 11 resumes printing because $([PC_A]-[PC_B])$ falls below N2R after the continuous forms are fed by the second printer 12, the second printer 12 feeds the continuous forms by one page and advances the count value of the counter $PC_B$ by 1 every time the count value $[PC_A]$ of the counter $PC_A$ which is periodically supplied to the second printer 12 advances by 1. This operation is repeated until the second printer 12 receives printing data (steps 820, 821). These operations are executed until the end of the printing job by the first printer 11. In this way, it is possible to print to the end without stopping after printing is resumed.

(i) Printing Control Using a Mark

In the above-described printing control, the count values of the counters $PC_A$ and $PC_B$ are utilized. Alternately, the following structure may be adopted.

The first printer 11 prints a mark on the first page and the second printer 12 detects the printed mark and then prints on the back surface of the first page. According to this structure, it is possible to print accurately on the top surface and on the back surface even if it is necessary to cut off several forms due to breakage or the like before the continuous forms are loaded on the second printer 12.

A mark is printed in the following manner.

The control portion 56 of the first printer 11 (1) controls the image forming portion 53 so as to generate a mark image in accordance with a double-sided printing command input from the host apparatus 13, (2) stores the mark image in the first bit map memory **54*a* together with the top-surface image data for the first page, and (3) thereafter reads the image from the bit map memory 54*a*** so as to print the mark.

A mark detector 31 (see FIG. 9) for projecting light on the continuous forms and detecting the mark from the reflected light is disposed on the paper passage. The mark detector 31 is disposed at the position where the toner image formed on the photosensitive drum **21*a*** after the detection of the mark can be transferred accurately to the back surface of the first page at the transferring position.

As the mark, OMR mark, bar code, numeral, symbol, etc. are usable. If a simple OMR mark such as a black square or a simple symbol is used as the mark, it is possible to simplify the structure of the mark detector 31. If a bar code or a numeral for OCR is used as the mark, it is possible to prevent an error in detection.

Figure 28A:
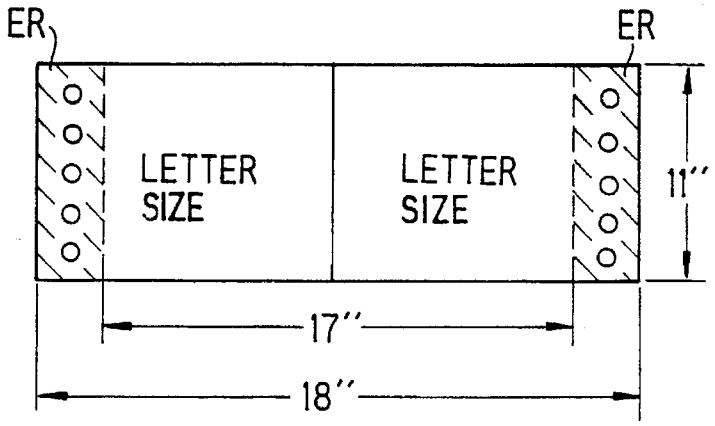
FIGS. 28A to 28C explain the position for recording a mark.
Figure 28B:
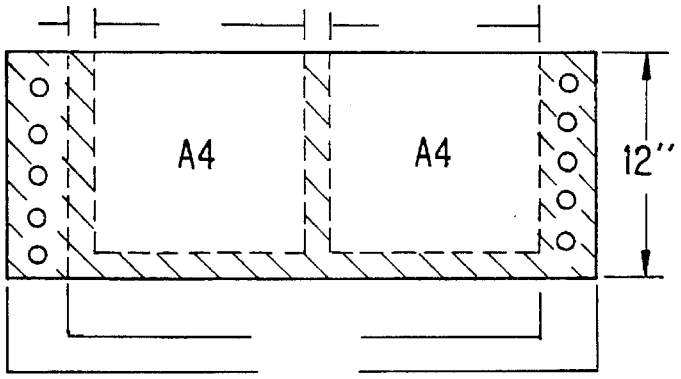
Figure 28C:
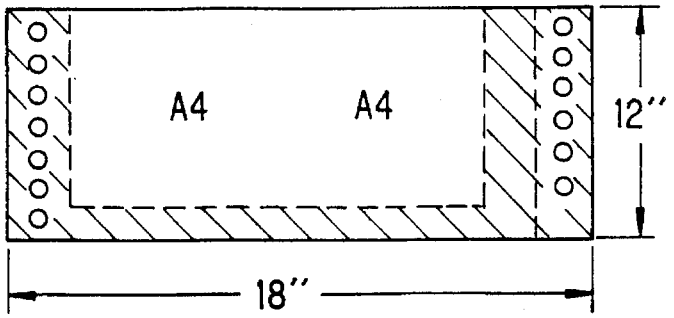

The mark is recorded outside of the user printing region. For example, the mark is printed in the hatched portion in FIGS. 28A, 28B and 28C. FIG. 28A shows an example of a mark recording region in the case in which two sheets of a letter size (11"×8.5") are cut out of the continuous forms of the size shown in FIG. 28A. Both side edges ER of the continuous forms having sprocket holes constitute the mark recording region. FIGS. 28B and 28C show examples of a mark recording region in the case in which two sheets of paper of the size A4 (297 mm×210 mm) are cut out of the continuous forms of the size shown in FIGS. 28B and 28C.

The mark is generally recorded on the first page. However, if printing of the second page on the back surface is started after the mark recorded on the first page is detected, it is sometimes impossible to print the second page accurately on the back surface depending upon the physical dimensions, the arrangement or the structure of the recording unit. In such a case, the mark is recorded on the page preceding to the first page.

Figure 29:
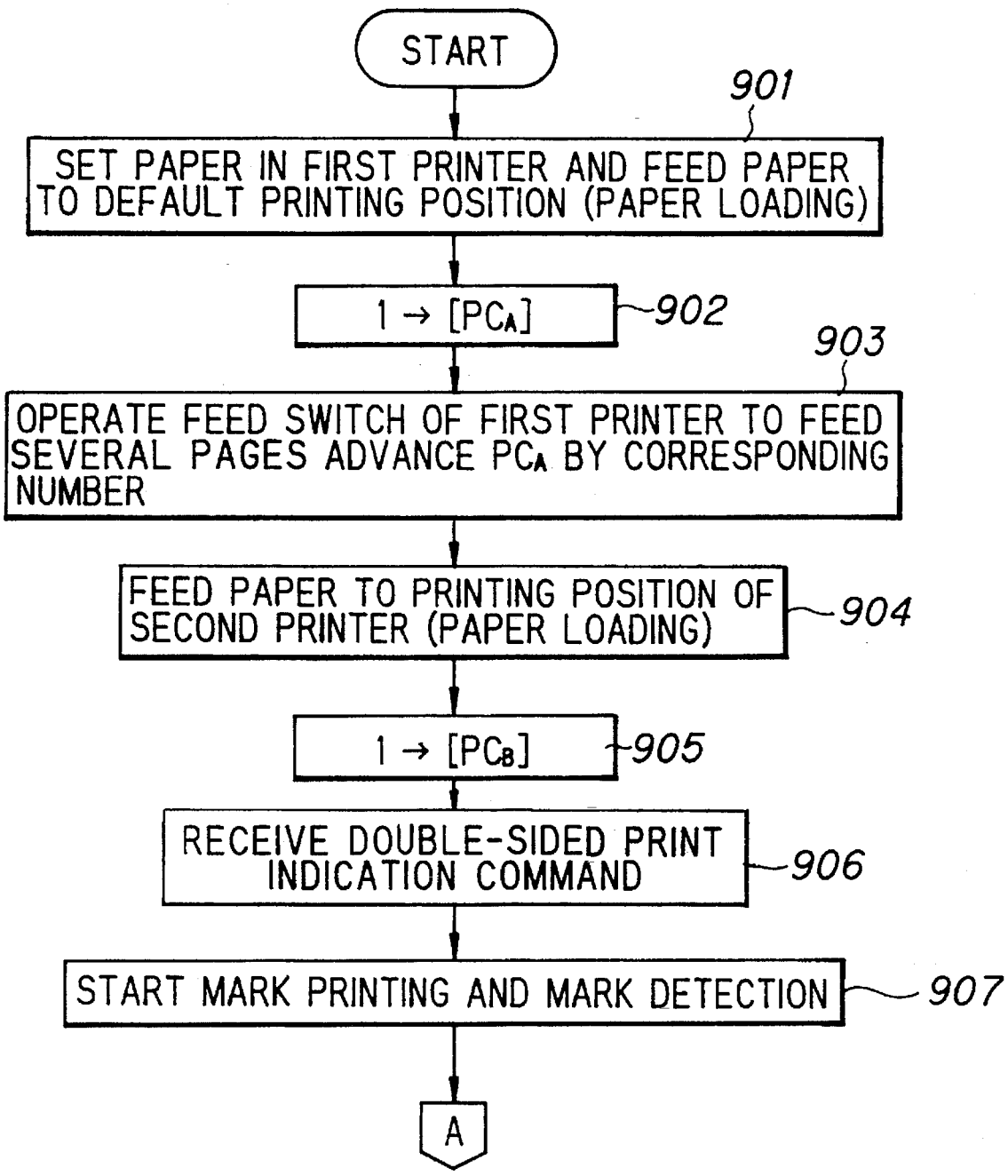
FIG. 29 is a flow chart of a printing control process using a mark.
Figure 30:
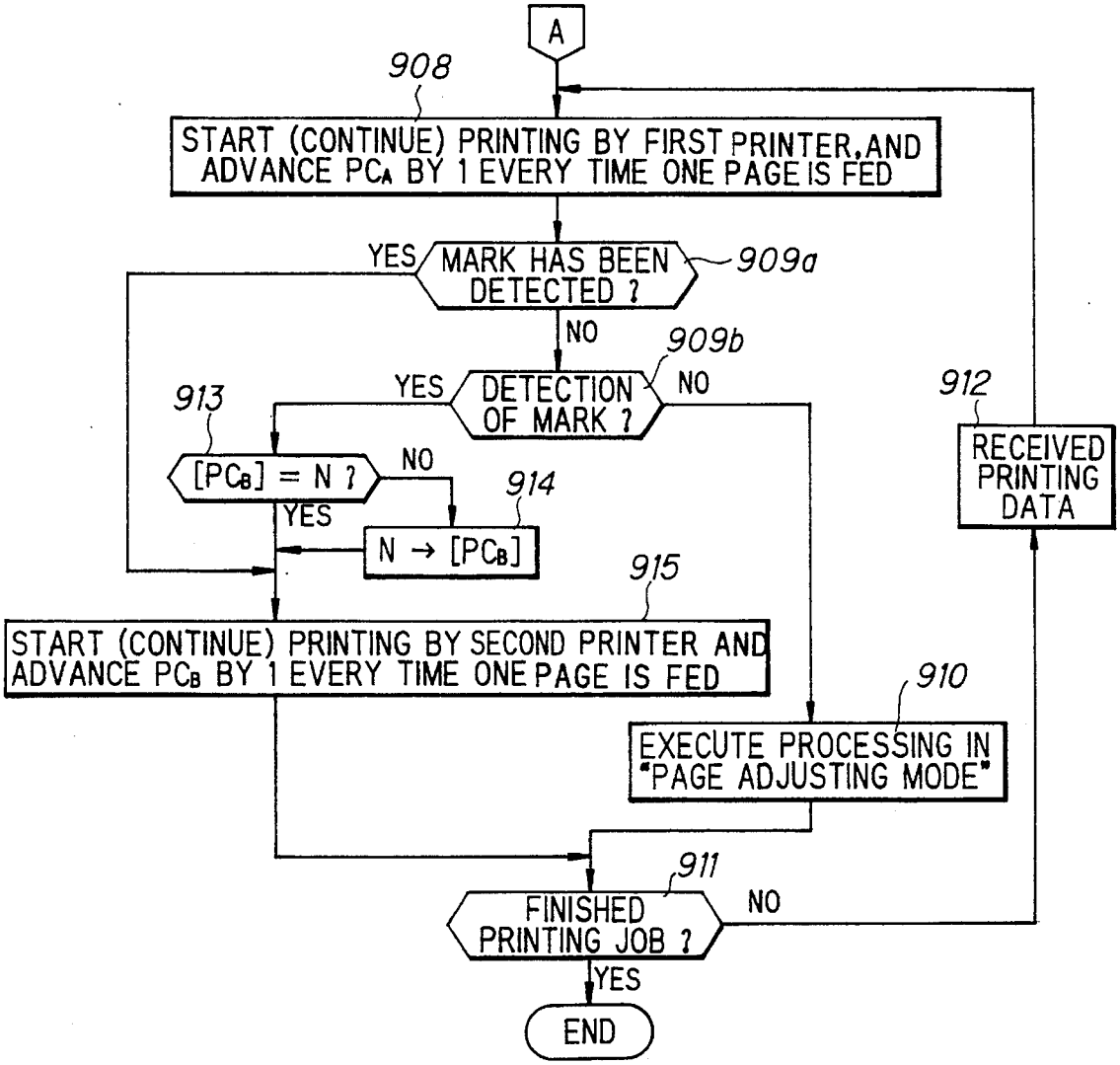
FIG. 30 is a flow chart of the printing control process using a mark continued from that shown in FIG. 29.

FIGS. 29 and 30 are a flow chart of a printing control process using a mark.

The continuous forms are set in the first printer 11 and the paper loading switch is operated so as to feed the continuous forms to the printing position (paper loading, step 901). The count value [$PC_A$] of the counter $PC_A$ of the first printer 11 is set to the initial value (=1)(1→[$PC_A$], step 902). Thereafter, the feed switch FEED of the first printer 11 is pressed so as to feed the continuous forms by several pages, and the count value [$PC_A$] of the counter $PC_A$ is advanced by one every time one page is fed (step 903).

The continuous forms are then loaded on the second printer 12 at the printing position (step 904), and the count value [$PC_B$] of the counter $PC_B$ of the second printer 12 is set to the initial value (=1)(1→[$PC_B$], step 905). The READY switches RDY of the first printer 11 and the second printer 12 are operated so as to inform the host apparatus 13 that both printers 11, 12 are in the on-line state. The host apparatus 13 then supplies a double-sided printing command to the first and second printers 11, 12 (step 906).

The first printer 11 prints a mark on the first page when it receives the double-sided printing command, and supplies the count value [$PC_A$](=N) to the second printer 12. The second printer 12 starts detecting the mark when it receives the double-sided printing command (step 907).

The first printer 11 starts printing the received data for a page of an odd number on the top surface, advances the count value [$PC_A$] of the counter by one every time one page is fed, and at the same time supplies the count value [$PC_A$] to the second printer 12 (step 908).

The printer controller 12*a* of the second printer 12 judges whether or not the mark recorded on the first page has been detected (step 909*a*). If the answer is NO, judgement is made as to whether or not the mark is detected (step 909*b*). If the answer is in the negative at the step 909*b*, the second printer 12 feeds the continuous forms in the "page adjusting mode". That is, the continuous forms are fed by the amount corresponding to the increment n (n is an integer of not less than 1, for example, 1) of the counter $PC_A$ of the first printer 11 every time the count value of the counter $PC_A$ increases by n, and increases the count value of the counter $PC_B$ by n (step 910). Judgement is then made as to whether or not the first printer 11 has finished the printing job (step 911), and if it has not been finished, the first printer 11 receives printing data and continues printing (steps 912, 908).

When the mark detector 31 of the second printer 12 has detected the mark while the first printer 11 continues printing, the printer controller 12*a* of the second printer 12 judges whether or not the count value [$PC_B$] of the counter $PC_B$ is equal to N (step 913). If the answer is in the negative, [$PC_B$] is corrected to N (step 914). The printer controller 12*a* of the second printer 12 prints the printing data for the second page on the back surface of the continuous form, and advances the count value of the counter $PC_B$ by one (step 915). Judgement is then made as to whether or not the printing job has been finished (step 911), and if it has not been finished, the processing at the step 912 and thereafter is repeated. Since the mark has been detected at step 909*a*, the processings at the steps 908→909*a*→915→911→912 are repeated thenceforth.

In this way, the start of printing by the second printer 12 is controlled by using a mark, and it is possible to execute double-sided printing after only one loading operation without stopping the printing operation by the first printer 11.

When a double-sided printing command is issued, the printer controller 12*a* of the second printer 12 feeds the continuous forms by the amount corresponding to the increment n (generally n=1) of the counter $PC_A$ of the first printer 11 every time the count value of the counter $PC_A$ increases by n until the mark is detected as described above (step 910). At the time of double-sided printing, when the mark is detected, printing on the second surface is started (step 915). When a double-side print cancellation command which demands single-side printing is issued, the second printer 12 feeds the continuous forms by the amount corresponding to the increment n of the counter $PC_A$ of the first printer 11 every time the count value of the counter $PC_A$ increases by n until the single-side printing job is finished.

After the mark is detected, when the difference between the count values [$PC_A$] of the counter $PC_A$ and the count value [$PC_B$] of the $PC_C$ falls below N1, the second printer 12 stops printing and paper feeding and resumes printing and paper feeding when the difference ([$PC_A$]−[$PC_B$] exceeds the third set value N1R which is larger than the first set value N1. On the other hand, when the difference exceeds the second set value N2, the first printer 11 stops paper feeding and printing and resumes paper feeding and printing when the difference falls below the set value N2R which is smaller than the second set value N2.

In this embodiment, the counters $PC_A$ and $PC_B$ count the amount of feed of the continuous forms as the number of pages (between the perforations). Alternatively, the amount of feed of continuous forms may be counted by any other unit such as feet, inches, and ⅙ inches.

(D) THIRD EMBODIMENT

(a) Entire Structure

Figure 31:
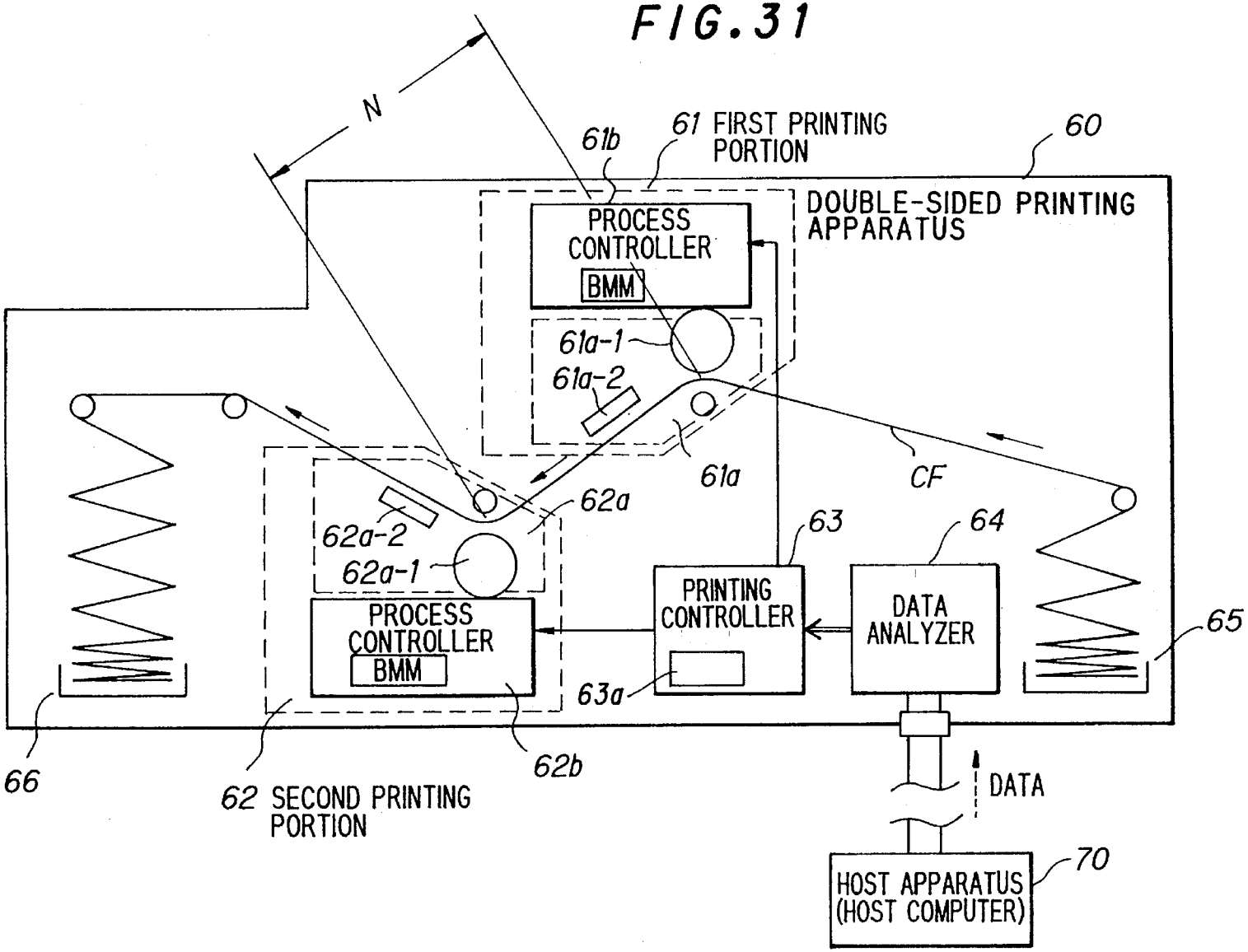
FIG. 31 shows the structure of a double-sided printing apparatus as a third embodiment of the present invention.

FIG. 31 shows the structure of a double-sided printing apparatus as a third embodiment of present invention.

In the first and second embodiments of a double-sided printing system of the present invention, two printers are connected in series for double-sided printing, but in the third embodiment, two printing portions for double-sided printing are provided within a double-sided printing apparatus.

In FIG. 31, the reference numeral 60 represents a double-sided printing apparatus, and 70 a host apparatus (host computer) for transferring printing data to the double-sided printing apparatus. In the double-sided printing apparatus 60, the reference numeral 61 denotes a first printing portion for printing on the first surface (top surface) of the continuous forms CF, 62 a second printing portion for printing on the second surface (back surface) of the continuous forms CF, and 63 a printing controller for distributing the printing data which are to be printed on the first surface and the second surface from the host apparatus 70 to the first and second printing portions 61, 62, respectively. The reference numeral 64 represents a data analyzer for analyzing the printing data received from the host apparatus 70 and converting the printing data into printable data (page information or the like), 65 a hopper for supplying the continuous forms CF folded along the respective perforations, and 66 a stacker for accommodating the printed continuous forms CF in a folded state. The print controller 63 discriminates the printing data for the top surface from the printing data for the back surface, generates the dot printing image data by using the printing data and inputs the top-surface data to the first printing portion 61 and the back-surface data to the second printing portion 62.

Figure 32:
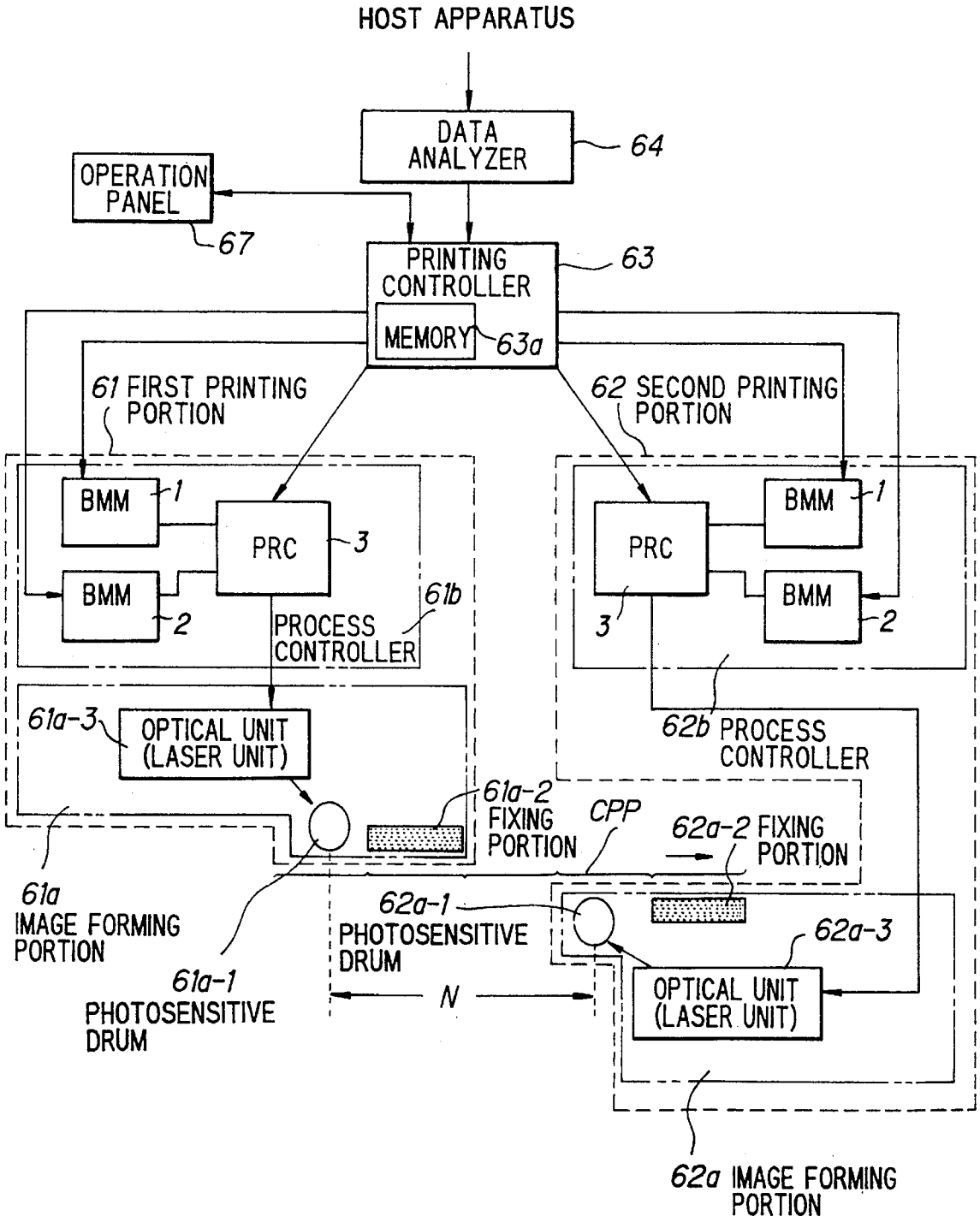
FIG. 32 shows the structure of the control system in the third embodiment shown in FIG. 31.

The first and second printing portions 61, 62 have completely the same structure, and they are provided with image forming portions (recording process portions) 61*a*, 62*a*, and process controllers 61*b*, 62*b* for controlling the image forming portions 61*a* and 62*b*, respectively. The image forming portions 61*a*, 62*a* have the same structure as the first and second printers 11, 12 in the first embodiment (see FIGS. 5 and 9) and print by transferring the toner images formed on photosensitive drums 61*a*-1, 62*a*-1 onto the continuous forms CF and fixing them by fixing devices 61*a*-2, 62*a*-2. Each of the process controllers 61*b*, 62*b* has a bit map memory BMM for storing the image data for each page. (b) Structure of Control System FIG. 32 shows the structure of a control system for the double-sided printing apparatus. The reference numeral 61 represents the first printing portion, 62 the second printing portion, 63 the printing controller, 64 the data analyzer, and 67 an operation panel for inputting various data and displaying the state of the apparatus. The reference numerals 61*a*, 61*b* represent the image forming portions which are composed of the photosensitive drums 61*a*-1. 62*a*-1, the fixing devices 61*a*-2, 62*a*-2 and the optical units (laser units) 61*a*-3, 62*a*-3 for projecting optical images on to the photosensitive drums so as to form electrostatic latent images. Each of the optical units (laser units) 61*a*-3, 62*a*-3 has the same structure as shown in FIG. 6.

The reference numerals 61*b*, 62*b* denote the process controller. Each process controller 61*b* (62*b*) has a first bit map memory BMM 1 for storing an image corresponding to a character, a second bit map memory BMM 2 for storing an image corresponding to a graphic, and a control portion (PRC)3 for controlling the image forming portion 61*a* (62*a*) in accordance with a command (printing command, warming up command, etc.) from the printing controller 63. The process controller 61*b* (62*b*) may also generates a dot image by using the printing data in place of the printing controller 63 and store the image in the bit map memories BMM1 and BMM2.

Figure 33A:
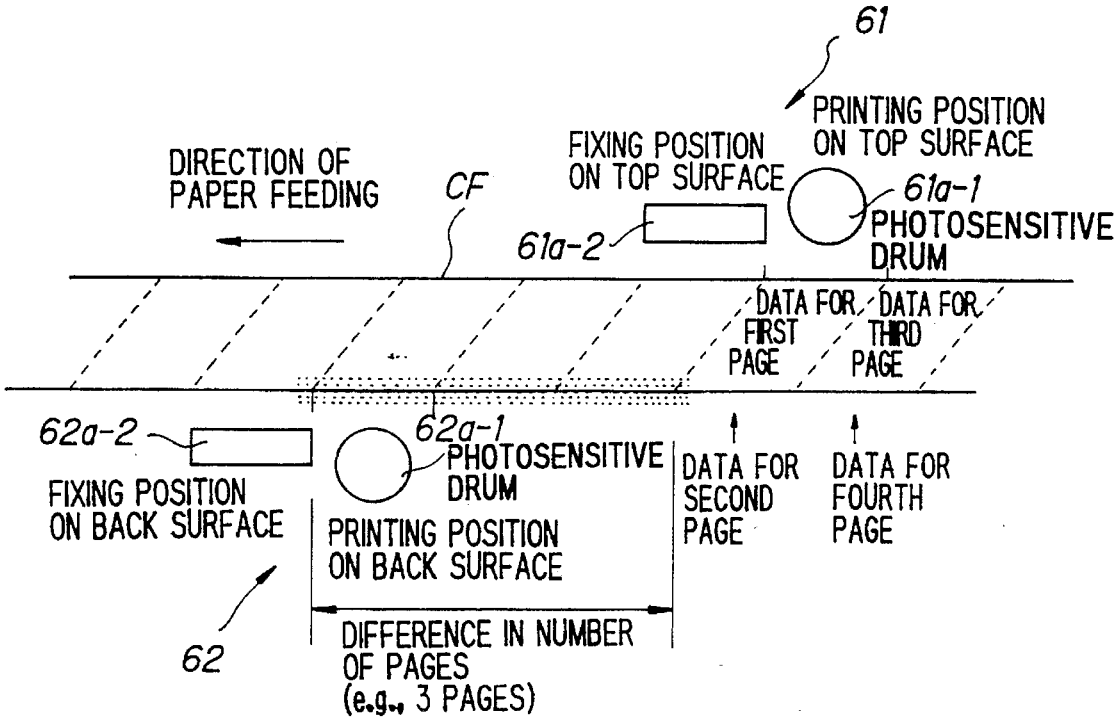
FIGS. 33A and 33B explain the printed pages on the top surfaces and the back surfaces of the continuous forms in the third embodiment shown in FIG. 31.
Figure 33B:
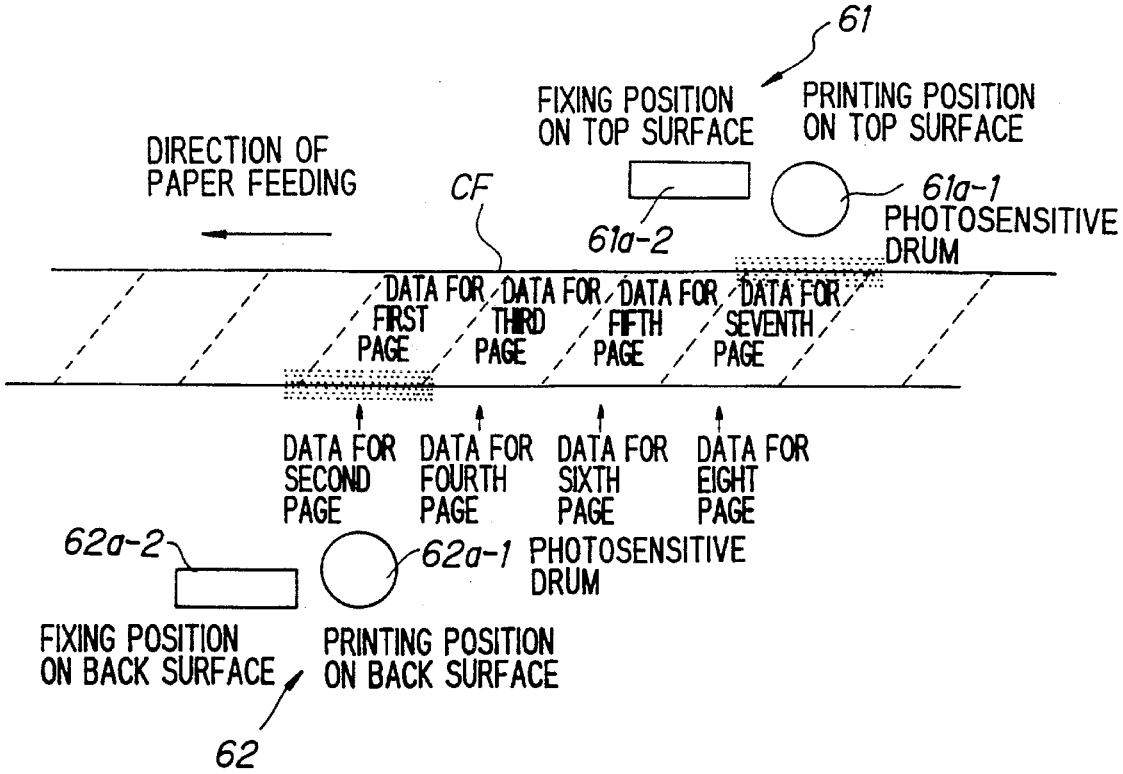

The first printing portion 61 prints on the top surface of the continuous forms CF on the basis of the printing data for the a page of an odd number, and the second printing portion 62 prints on the back surface of the continuous forms CF on the basis of the printing data for the a page of an even number. The number pages of the continuous forms CF existing between the printing positions of the first and second printing portions 61, 62 is just N. Therefore, after the first printing portion 61 prints N pages, the second printing portion starts printing a page of an even number (second page) on the back surface. FIG. 33A shows the state in which the first printing portion 61 starts printing the first page on the top surface when N=3. FIG. 33B shows the state in which the first printing portion 62 has finished printing the first, third and fifth pages on the top surface of the continuous forms CF and the back surface of the first page has reached the second printing portion 62. At this point of time, the printing controller 63 instructs the first and second printing portions 61, 62 to print, so that the seventh page is printed on the top surface and the second page is printed on the back surface. Thereafter, (2n+1)th pages are similarly printed on the top surface of the continuous forms CF and 2nth pages on the back surface.

Figure 34:
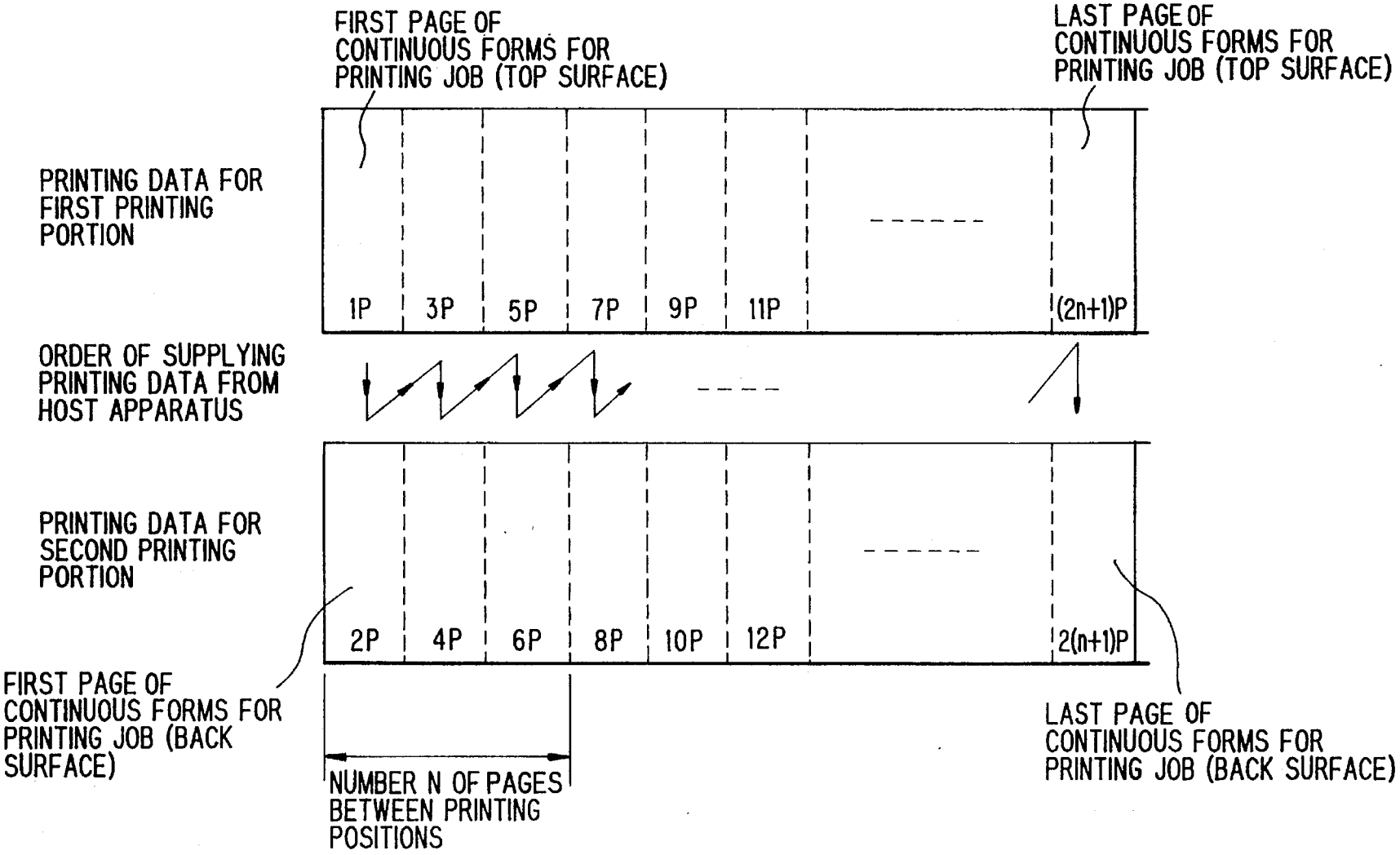
FIG. 34 explains the printing data supplied from a host apparatus in the third embodiment shown in FIG. 31.

The printing data are sequentially supplied from the host apparatus 70 as the data for the first page, second page, third page, fourth page, fifth page, . . . , as shown in FIG. 34. Consequently, the bit map memories BMM1, BMM2 of the second printing portion 62 are provided with storage regions for storing image data for N pages.

(c) Operation

When the continuous forms CF are set in the double-sided printing apparatus and the apparatus is ready for printing, the printing data are supplied from the host apparatus 70 in the order shown in FIG. 34. The data analyzer 64 analyzes the received data, converts them into printable data and supplies them to the printing controller 63. The printing controller 63 discriminates the printing data for the top surface from the printing data for the back surface, generates dot printing image data by using the printing data and inputs the data to the bit map memories BMM1, BMM2 of the process controllers 61*b*, 62*b* 61 of the first and second printing portions 61 and 62, respectively. The control portion (PRC)3 of the first printing portion 61 reads out the image data from the bit map memories BMM1, BMM2 and inputs the data to the optical unit 61*a*-3. The optical unit 61*a*-3 generates an optical image on the basis of the image data, and projects the optical image onto the photosensitive drum 61*a*-1 so as to form an electrostatic latent image on the photosensitive drum 61*a*-1. Thereafter, the first page is printed on the surface of the continuous forms CF by an electrophotography process.

The first printing portion 61 prints the third and fifth pages, and the second printing portion 62 stores the image data for the second, fourth and sixth pages in the bit map memories BMM 1, 2.

When the first printing portion 61 has finished printing N (=3) pages on the top surface, the printing controller 63 inputs the image data for the seventh page to the first printing portion 61 and at the same time instructs the second printing portion 62 to print the second page. The first and second printing portions 61, 62 then read out the top-surface image data for the seventh page and the back-surface image data for the second page which are stored in the bit map memories BMM 1, 2 and print the read data on the top surface and the back surface of the continuous forms CF simultaneously. Thereafter, (2n+1)th pages are similarly printed on the top surface of the continuous forms CF and 2nth pages on the back surface.

As described above, since the bit map memories BMM 1, 2 for storing the image data for N pages are provided in the second printing portion 62 so that the second printing portion 62 starts printing after the first printing portion 61 prints N pages, even if the photosensitive drums 61*a*-1, 62*a*-1 have the same diameter, it is possible to accurately print on the top surface and the back surface of the continuous forms CF without causing a positional deviation.

(d) Function of Avoiding a Physical Gap at the Time of Starting Printing

The image forming portions 61*a*, 62*a* do not start printing immediately after the printing command is issued, but it is necessary to rotate the photosensitive drums 61*a*-1, 62*a*-1 several revolutions in order to uniformly electrify the photosensitive drums 61*a*-1, 62*a*-1. In other words, what is called the warm-up time is necessary. For example, in the printing job shown in FIG. 34, at the time of printing on the top surface, (1) the image forming portion 61*a* is first warmed up in accordance with the printing command for the first page. (2) The first page is then printed. (3) the third, fifth, . . . pages are thereafter printed without the need for warm-up immediately after the printing command. On the other hand, at the time of printing on the back surface, (1) the data for the second, fourth and sixth pages are stored in the bit map memories BMM 1, 2. (2) When the first printing portion 61 has printed the fifth page, the printing controller 63 instructs the second printing portion 62 to print the second page and the first printing portion 61 to print the seventh page. (3) The first printing portion 61 immediately starts printing, but the second printing portion 62 warms up the image forming portion 62*a* and then starts printing the second page. According to this structure, printing of the second page is delayed by the time corresponding to the warm-up time and, hence, the actually printed page deviates from the printing position on the back surface.

If the first printing portion 61 is stopped printing until the end of the warm-up of the second printing portion 62 in order to prevent such deviation of the printed page, the printing speed is lowered. In the present invention, however, the deviation caused by the warm-up of the second printing portion 62 in the related art is prevented without stopping printing by the first printing portion 61.

More specifically, the printing controller 63 instructs the second printing portion 62 to warm up the image forming portion 62*a* when the printing controller 63 commands the first printing portion 61 to start printing the first page.

The first printing portion 61 prints the first page after warming up the image forming portion 61*a*, while the second printing portion 62 warms up the image forming portion 62*a* and waits for a printing command.

Thereafter, the first printing portion 61 prints the third and fifth pages on the basis of the printing data input from the host apparatus 70, and the second printing portion 62 stores the image data for the second, fourth and sixth pages in the bit map memories BMM 1, 2.

When the first printing portion 61 has finished printing N (=3) pages on the top surface, the printing controller 63 inputs the image data for the seventh page to the first printing portion 61 and at the same time instructs the second printing portion 62 to print the second page. The first printing portion 61 then reads out the top-surface image data for the seventh page which is stored in the BMM 1, 2 and prints the read data on the top surface of the continuous forms CF. The second printing portion 62, which has finished warming up the image forming portion 62*a*, reads out the back-surface image data for the second page which is stored in the BMM 1, 2 and prints the read data on the back surface of the continuous forms CF immediately after the reception of the printing command.

Thereafter, (2n+1)th pages are similarly printed on the top surface of the continuous forms CF and 2nth pages on the back surface.

Figure 35:
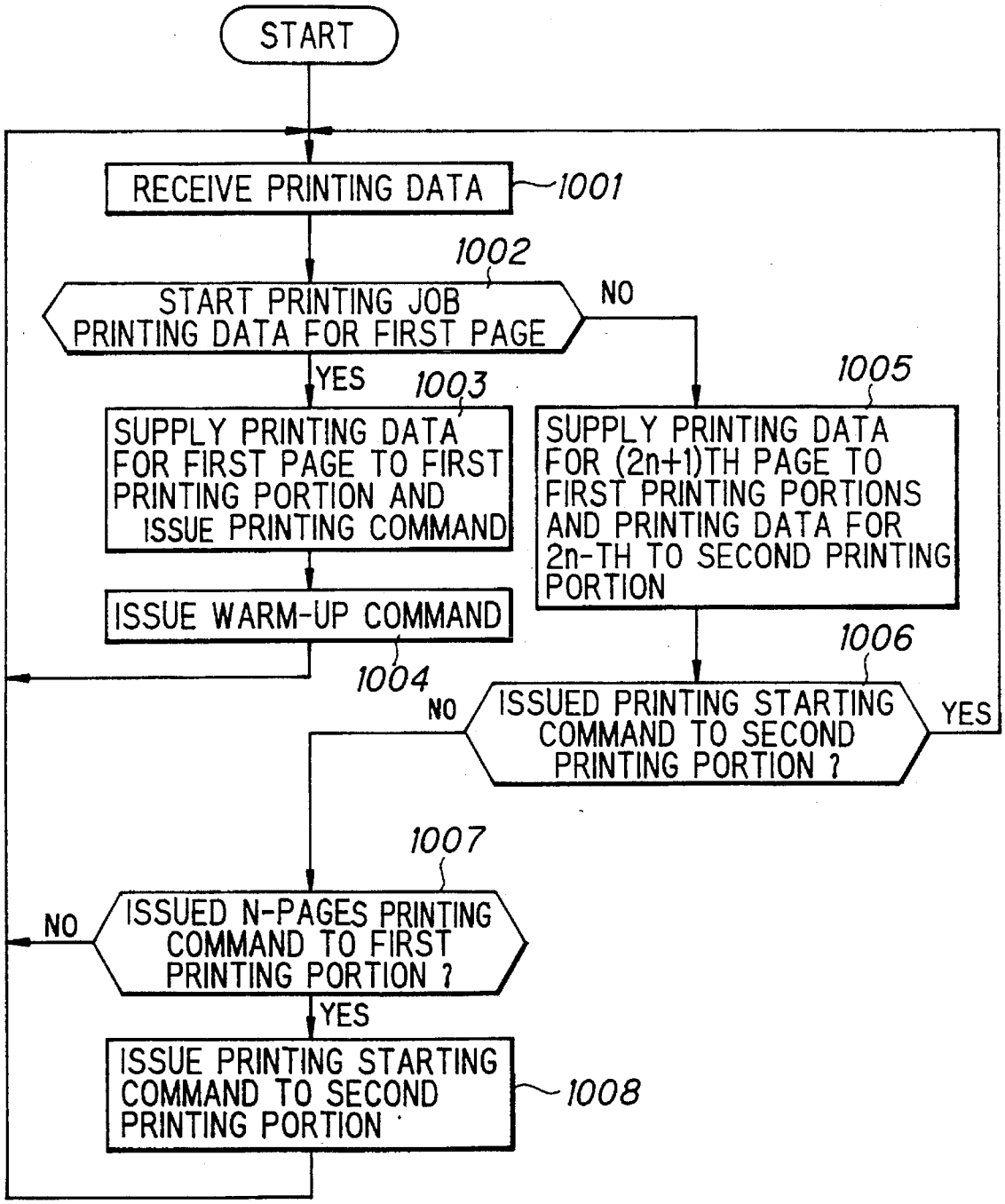
FIG. 35 is a flow chart of a printing control process including a warm-up operation in the third embodiment shown in FIG. 31.

FIG. 35 is a flow chart of the process for preventing a positional deviation of a printed portion due to warm-up.

When the printing controller 63 receives printing data (step 1001), it judges whether or not the received data is the printing data for the first page (step 1002), and if the answer is in the affirmative, the printing controller 63 generates image data by using the printing data, inputs the data to the first printing portion 61, simultaneously instructs the first printing portion 61 to print (step 1003) and the second printing portion 62 to warm up the image forming portion 62*a* (step 1004), and waits for the next printing data.

If the printing data is the data for the second or a latter page at the step 1002, the printing controller 63 generates image data by using the printing data for the 2nth page and inputs the data to the second printing portion 62, or generates image data by using the data for the (2n+1)th page, inputs the data to the first printing portion 61 and issued a printing command to the first printing portion 61 (step 1005). Judgement is then made as to whether or not a printing command has ever been issued to the second printing portion 62 (step 1006), and if no printing command has ever been issued, the printing controller 63 judges whether or not the first printing portion 61 has been instructed to print N pages (step 1007), and if the answer is NO, the process returns to the start so as to wait for next printing data. On the other hand, if the answer is YES at the step 1007, the printing controller 63 instructs the second printing portion 62 to print the second page (step 1008), and the process returns to the start so as to repeat the subsequent processing. The answer at the step 1006 then becomes YES, so that double-sided printing is executed by the first and second printing portions 61, 62.

Figure 36A:
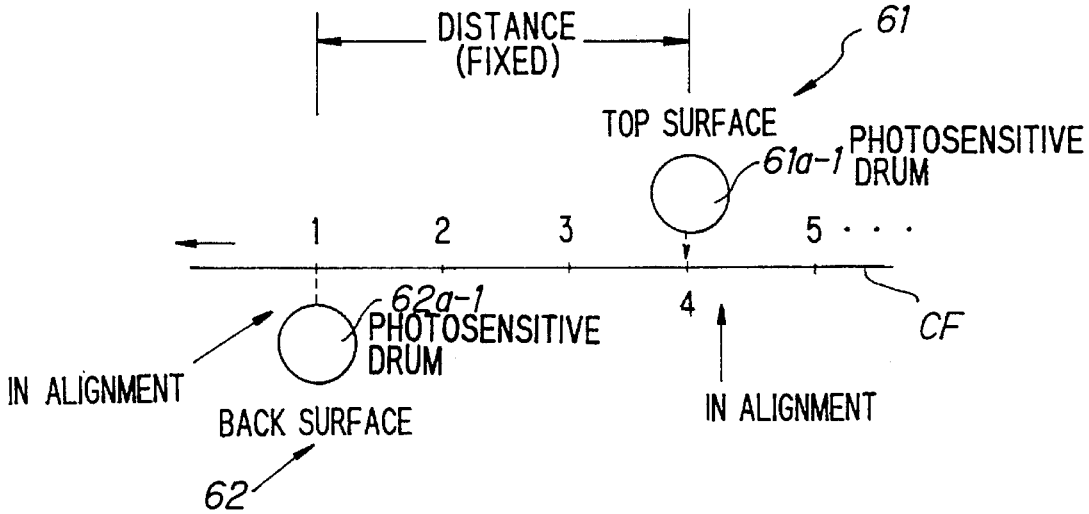
FIGS. 36A and 36B explain the relationship between the size of the continuous forms and the printing position in the third embodiment shown in FIG. 31.
Figure 36B:
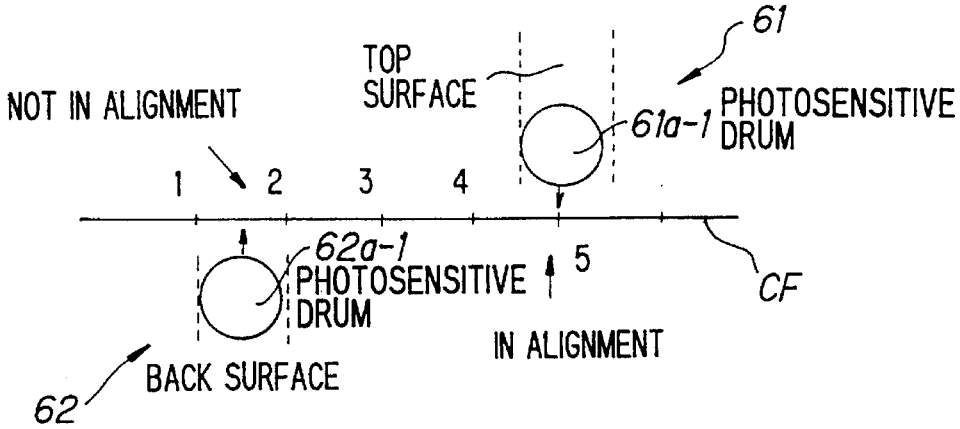

(e) Mechanism of Preventing Positional Deviation of Printed Portion Due to Difference In Page Size If the page size (length between the perforations) of the continuous forms used is different, the number of pages existing between the printing positions of the first and second printing portions 61, 62 is not exactly an integer but contains a fraction such as 3.3. In such a case, the printing positions of the continuous forms CF by the first and second printing portions 61, 62 are different from each other. In FIG. 36A, the number of pages existing between the printing positions is just 3. In FIG. 36B, however, the number of pages existing between the printing positions is 3.5. In this case, it is difficult to control so that the printed portions are the same on the top surface and on the back surface.

Figure 36C:
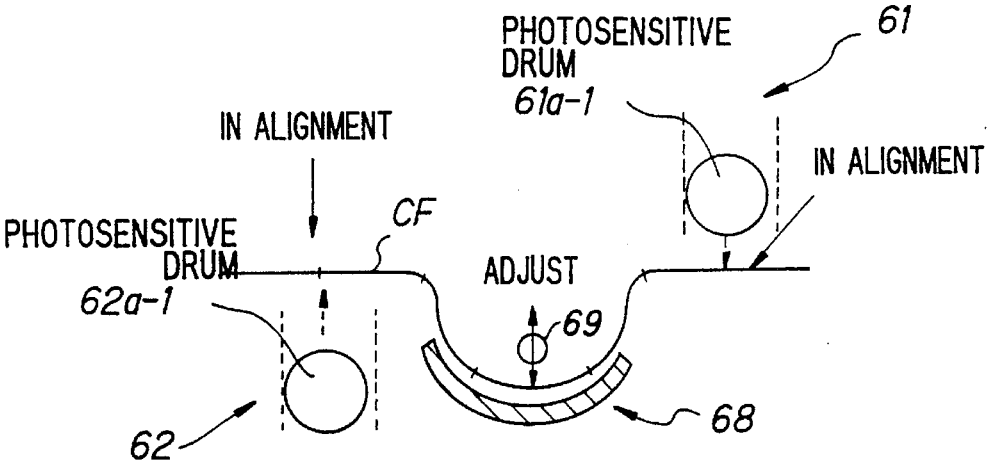
FIG. 36C explains the mechanism for adjusting the length of the continuous forms between the printing positions of the first and second printing portions in the third embodiment shown in FIG. 31.

To solve this problem, in the present invention, there is provided a means for adjusting the number of forms between the printing positions of the first printing portion 61 and the second printing portion 62 to exactly an integer. As shown in FIG. 36C, an intermediate buffer 68 provided with a paper size adjusting lever 69 is disposed between the first and second printing portions 61, 62. The lever 69 is vertically moved in accordance with the paper size so that the number of pages existing between the printing positions of the first and second printing portions 61, 62 is an integer.

Figure 37A:
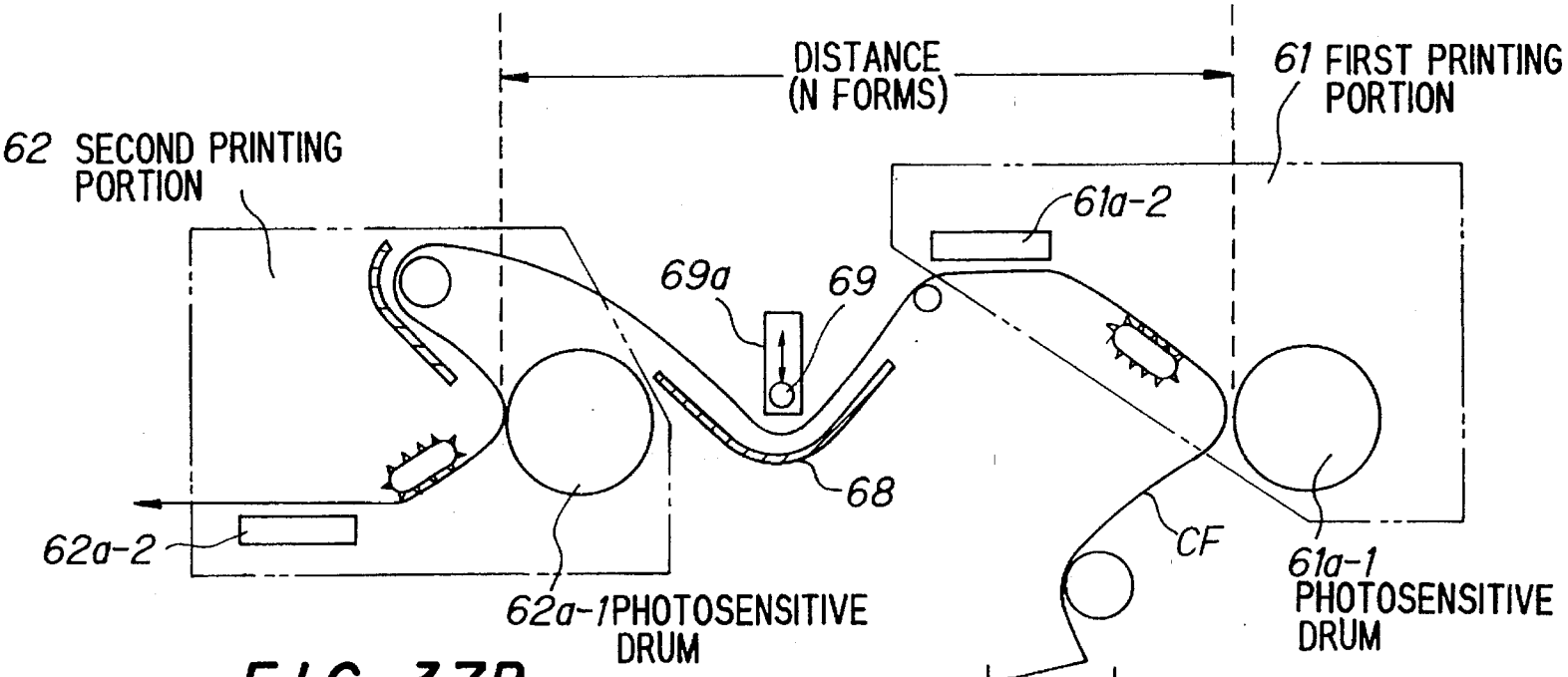
FIG. 37A shows the structure of a part of a double-sided printing apparatus provided with a mechanism for adjusting the length of the continuous forms between the printing positions of the first and second printing portions.
Figure 37B:
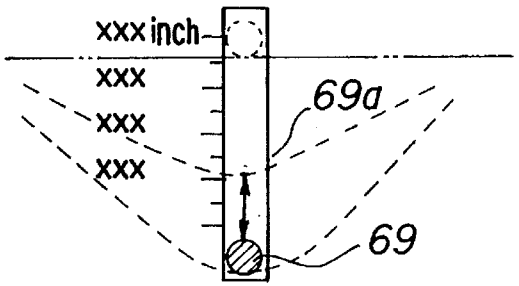
FIG. 37B explains the mechanism for adjusting the length of the continuous forms in the double-sided printing apparatus shown in FIG. 37.

FIG. 37A is a detailed view of a part of a double-sided printing apparatus provided with an intermediate buffer. The reference numerals 61 and 62 denote the first and second printing portions, and the intermediate buffer 68 provided with the paper size adjusting lever 69 is disposed between the first and second printing portions 61, 62. The paper size adjusting lever 69 is attached to a guide portion 69*a* so as to extend over the width of the continuous forms CF and to be vertically movable along the guide portion 69*a*. The guide portion 69*a* is vertically graduated so as to indicate paper sizes, as shown in FIG. 37B. If the lever 69 is fixed at the position corresponding to the page size of the continuous forms CF, the number of pages existing between the printing positions of the first and second printing portions 61, 62 becomes exactly an integer.

In this way, it is possible to adjust the number of pages existing between the printing positions of the first and second printing portions 61, 62 to exactly an integer, thereby enabling printing accurately on the same position on the top surface and on the back surface by a simple control.

(f) Printing Mode

Figure 38A:
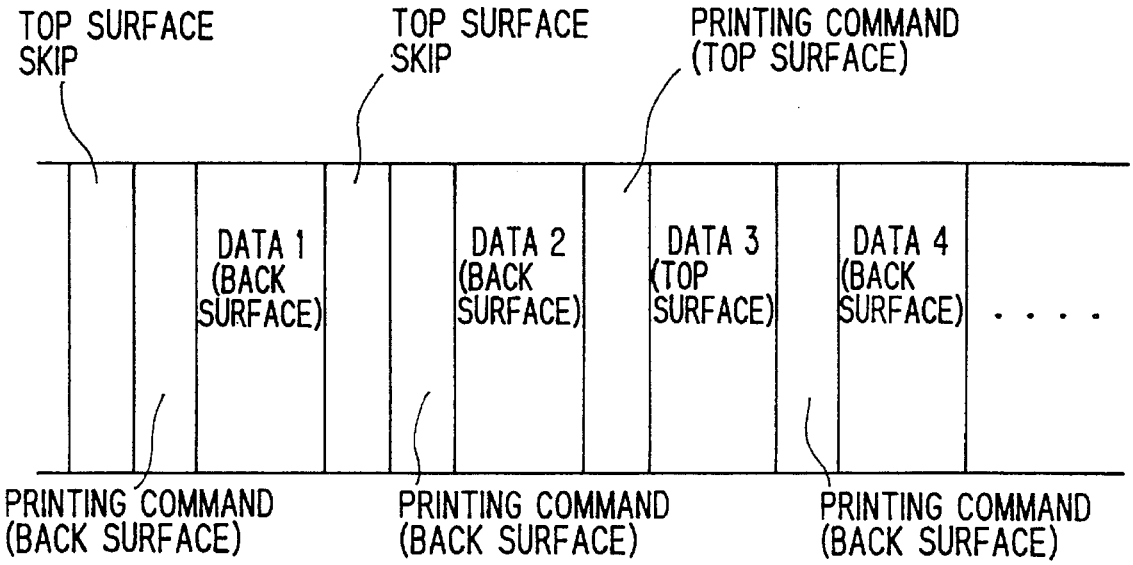
FIGS. 38A to 38C explain the printing control executed when the printing data for designating the printing surface is received.

Printing modes are largely classified into a double-sided printing mode and a single-side printing mode. In the double-sided printing mode, the host apparatus 70 (1) alternately supplies printing data for the top surface and the printing data for the back surface, or (2) supplies printing data with the instruction of a printing surface such as back surface, back surface, top surface, back surface, . . . as in the case of a cut paper printer. FIG. 38A shows an example of such a printing command chain (2). The host apparatus 70 issues a printing command accompanying data designating the printing surface such as top surface skip, print (back surface), top surface skip, print (back surface), print (top surface), print (back surface), . . . .

Figure 38B:
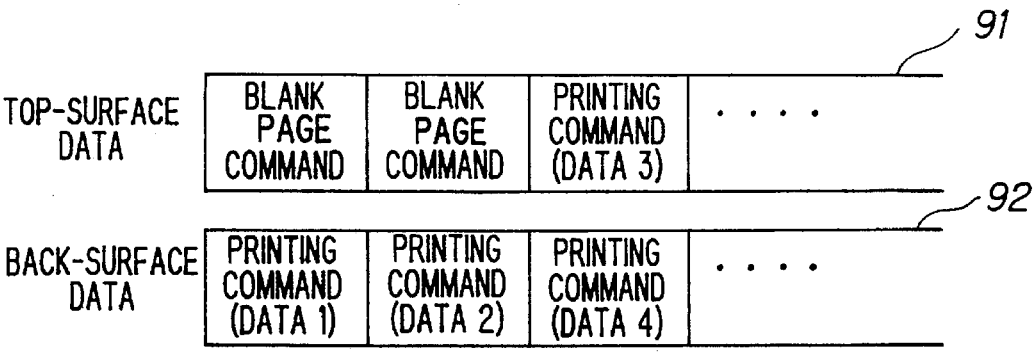
Figure 38C:
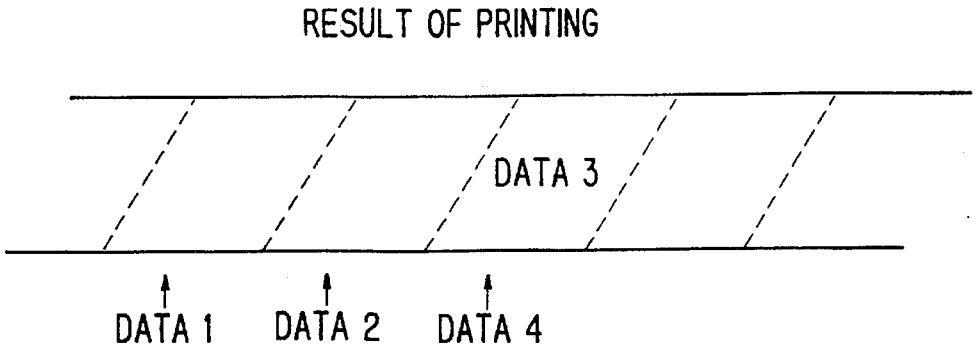
Figure 39:
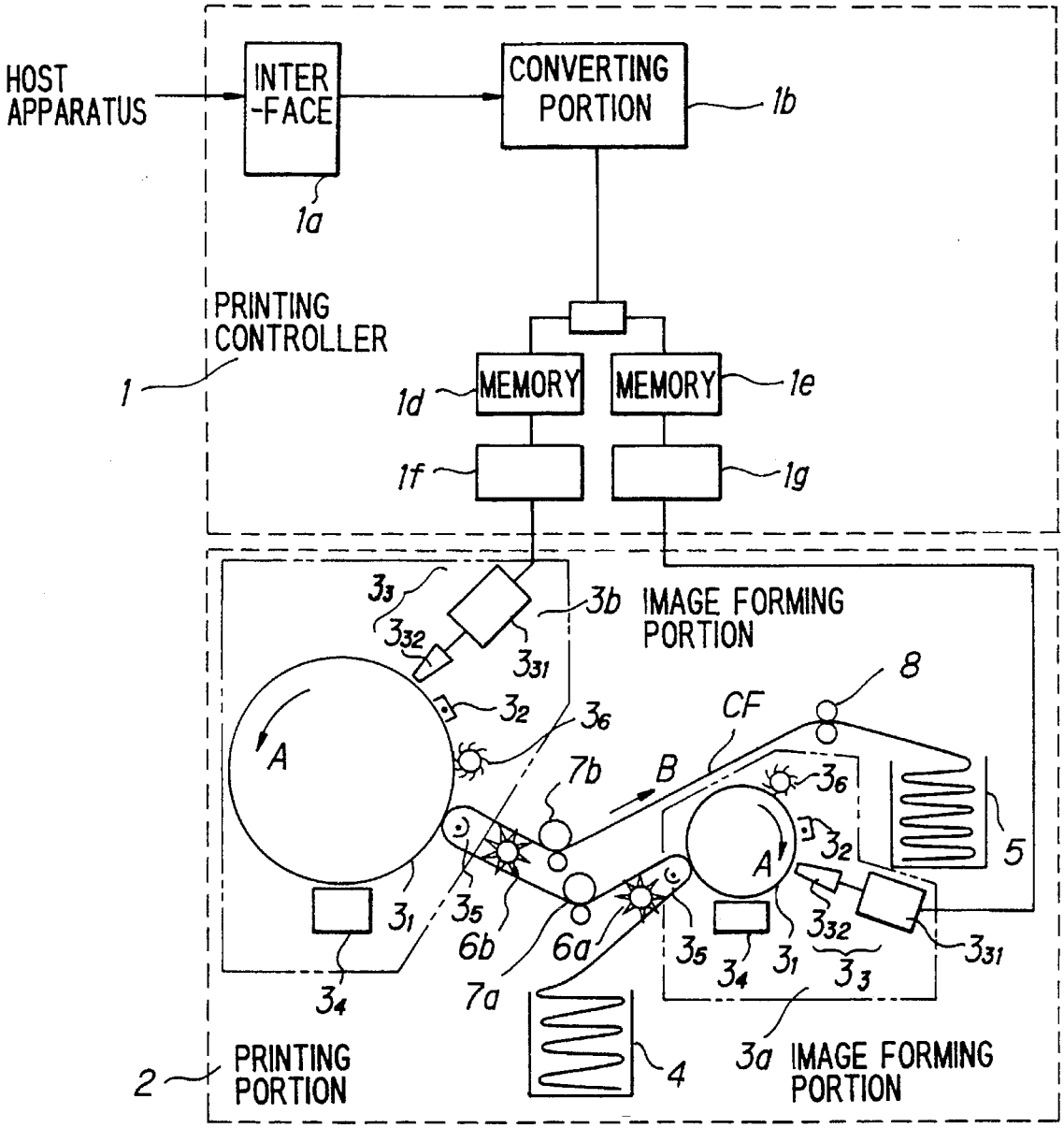
FIG.39 PRIOR ART
FIG. 39 shows the structure of a conventional double-sided printing apparatus.

If the printing data for the top surface and the back surface are alternately supplied, as shown in FIG. 34A, the printing controller 63 alternately distributes the printing data to the first and second printing portions 61, 62. If the printing data which designate the skipping surface and the printing surface are supplied, as shown in FIG. 38A, the printing controller 63 converts the skipping command into a blank form command and outputs it. Therefore, when the printing data shown in FIG. 38A are supplied, the printing controller 63 converts the data into a top-surface data train 91 and a back-surface data train 92, as shown in FIG. 38B, and outputs them to the first and second printing portions 61, 62.

In the single-side printing mode, there are cases of printing on the top surface of the continuous forms CF and printing on the back surface thereof. In the case of printing on the top surface, the printing controller 63 inputs all the printing data to the first printing portion 61 so as to be printed on the top surface. In the case of printing on the back surface, the printing controller 63 inputs all the printing data to the second printing portion 62 so as to be printed on the top surface.

The printing mode is set by operating by the operation panel 62 and it is stored in a backup memory 63*a* (memory for holding the stored contents even if the power source is turned off) (FIG. 32) provided within the printing controller 63. The contents of the backup memory 63*a* are then loaded on the work region by IMPL (Initial Micro Program Loading), and thereafter, double-sided printing, top-surface printing, or back-surface printing is controlled in the thus-set mode.

Alternatively, the mode may be set by issuing a mode setting command from the host apparatus 70. When the printing controller 63 receives the mode setting command from the host apparatus 70, it finishes printing the printing data received and then stops printing. After stopping printing, the operational environment of the control program of the printing controller 63 is changed into the designated mode (double-sided printing, top-surface printing, or back-surface printing), and the printing controller 63 thenceforth receives the printing data in the designated mode and controls printing.

(E) ADVANTAGES OF THE INVENTION

As described above, according to the present invention, it is easy to construct a double-sided printing system for printing both sides of continuous forms by using two printers and, in addition, to keep an appropriate amount of sag in the continuous forms between both printers by absorbing the difference in printing speed, namely, paper feeding speed between both printers, thereby preventing the paper from jamming and being cut.

If a reversing mechanism for reversing the surface of the continuous forms CF is provided between the first and second printers, printing on the back surface of the continuous forms by the second printer is facilitated.

If it is assumed that the number of pages of the continuous forms between the printing positions of the first and second printers is N, the host apparatus adds blank data for N pages to the end of all the printing data which are to be printed on the first surface and supplies the total data to the first printer, and adds blank data for N pages to the beginning of all the printing data which are to be printed on the second surface and supplies the total data to the second printer. In this manner, it is possible to print by the second printer on the back surface exactly at the portion printed by the first printer.

In addition, when a start switch or a stop switch is operated or when printing is impossible, one of the first and second printers outputs a switch ON signal or a NOT READY signal indicating that printing is impossible to the other printer. It is therefore possible that the first and second page printers simultaneously start or stop printing. In this manner, the problem brought about when only one page printer is operated is eliminated.

According to the present invention, a double-sided printing system is composed of a first counter for counting the amount of feed of the continuous forms on the first printer side after the continuous forms are loaded on the first printer; a second counter for counting the amount of feed of the continuous forms on the second printer side after the continuous forms are loaded on the second printer; and printer controllers which are provided in the first and second printers so as to be communicable to each other. And, the printer controller of the first printer supplies the count value N of the first counter at the start of printing on the first surface to the printer controller of the second printer, and the printer controller of the second printer starts printing on the second surface when the count value of the second counter becomes equal to the supplied count value N. It is thus possible to print accurately on the top surface and on the back surface of continuous forms.

When a double-sided print cancellation command for demanding single-side printing is issued from the host apparatus, the printer controller of the second printer feeds the continuous forms by the amount which corresponds to the count value n every time the count value of the counter which is informed of by the first printer increases by n. In this way, single-side printing is also enabled by the double-sided printing system. In addition, by using the first and second printers separately from each other, the double-sided printing system can be used as two single-side presses.

A virtual intermediate buffer device for absorbing the difference in paper feeding speed between both printers is provided between the first and second printers. When the between the count values of the counter $PC_A$ and $PC_B$ falls below the first set value N1, printing and paper feeding by the second printer is stopped, and when the difference exceeds the second set value N2, paper feeding and printing by the first printer is stopped. When printing and paper feeding by the second printer is stopped because the difference ($[PC_A]-[PC_B]$) falls below the first set value N1, if the difference becomes not less than a set value N1R which is larger than the first set value N1, printing and paper feeding by the second printer is resumed. When printing and paper feeding by the first printer is stopped because the difference ($[PC_A]-[PC_B]$) exceeds the second set value N2, if the difference becomes not more than a set value N2R which is smaller than the second set value N2, printing and paper feeding by the first printer is resumed. In this way, it is possible to constantly keep an appropriate amount of sag in the continuous forms between both printers by absorbing the difference in printing speed, namely, paper feeding speed between both printers, thereby preventing the paper from jamming and being cut. In addition, the amount of sag can be recognized on the basis of the signal which is output from the sensor without the need for any special amount of retention detector or intermediate buffer device, which is advantageous in points of installation space and cost.

In the present invention, the second printer stops printing and paper feeding when the difference ($[PC_A]-[PC_B]$) in count value falls below the first set value N1. In this case, if the second printer is in course of printing operation, the second printer supplies a feed request to the first printer. The first printer judges (1) whether or not a predetermined time has passed without receiving the next printing data after receiving a command which indicates the end of the printing data, and (2) whether or not a switch for commanding the second printer to print to the end of the printing data is operated. After the feed request is issued, if either the condition (1) or (2) holds, the first printer 11 feeds the continuous forms CF, and if the difference ($[PC_A]-[PC_B]$) becomes not less than the third set value N1R, the second printer resumes printing and paper feeding. In this way, even if printing has been finished by the first printer, the second printer 12 can resume printing. In this case, since the first printer feeds the continuous forms in synchronism with the paper feeding of the second printer after the resumption of printing and paper feeding by the second printer, the difference ($[PC_A]-[PC_B]$) in count value does not henceforth fall below the first set value N1, so that the operation of stopping and resuming printing and paper feeding is not repeated.

Similarly, the first printer stops printing and paper feeding when the difference ($[PC_A]-[PC_B]$) in count value exceeds the second set value N2. In this case, if the first printer is in course of printing operation, the first printer supplies a feed request to the second printer. The second printer judges (1) whether or not a predetermined time has passed without receiving the next printing data after receiving a command which indicates the end of printing data, and (2) whether or not a switch for commanding the first printer to print to the end of the printing data is operated. After the feed request is issued, if either the condition (1) or (2) holds, the second printer 12 feeds the continuous forms, and if the difference becomes not more than the set value N2R, the first printer resumes printing and paper feeding. In this case, since the second printer feeds the continuous forms in synchronism with the paper feeding of the first printer after the resumption of printing and paper feeding by the first printer, the difference ($[PC_A]-[PC_B]$) in count value does not henceforth exceed the second set value N2, so that the operation of stopping and resuming printing and paper feeding is not repeated.

According to the present invention, a mark printing means is provided in the first printer and a mark detecting means is provided in the second printer. The mark printing means of the first printer prints a mark on the first surface of the continuous forms, and the second printer starts printing on the second surface of the continuous forms when the mark is detected. In this way, it is possible to print accurately on the top surface and on the back surface of the continuous forms by a simple structure even if it is necessary to cut off several pages due to breakage or the like before the continuous forms are loaded on the second printer.

Since the bit map memory for storing the image data for N pages is provided in the second printing portion so that the second printing portion starts printing after the first printing portion prints N pages, even if the photosensitive drums have the same diameter, it is possible to accurately print on the top surface and on the back surface of the continuous forms without causing a positional deviation.

In addition, since the second printing portion warms up the image forming portion simultaneously with the first printing portion, the second printing portion can immediately start printing on the back surface when a printing command is issued, thereby preventing a positional deviation and enhancing the printing efficiency.

Furthermore, according to the present invention, a means for adjusting the number of pages of the continuous forms existent between the printing positions of the first printing portion and the second printing portion, it is possible to adjust the number of pages of the continuous forms existing between the printing positions to exactly an integer, thereby enabling accurate printing on the top surface and on the back surface of the continuous forms without a positional deviation by a simple control.

As many apparently widely different embodiments of the present invention can be made without departing from the spirit and scope thereof, it is to be understood that the invention is not limited to the specific embodiment thereof except as defined in the appended claims.

What is claimed is:

1. A double-sided printing system for continuous forms for printing on both sides of continuous forms by sequentially operating two printers, comprising:

a first printer for printing on one side which is a first surface of said continuous forms;

a second printer provided at a subsequent stage to said first printer in the direction of paper feeding so as to print on the other side, which is a second surface of said continuous forms;

a host apparatus for transferring printing data which are to be printed on said first and second surfaces to said first and second printers, respectively;

an intermediate buffer device provided between said first and second printers so as to absorb a difference in paper feeding speeds between said first and second printers;

a detecting portion provided in said intermediate buffer device so as to detect the amount of retention of said continuous forms in said intermediate buffer device;

and a controlling means for stopping printing and paper feeding by said second printer when said amount of retention of said continuous forms falls below a first set value, and stopping paper feeding and printing by said first printer when said amount of retention of said continuous forms exceeds a second set value.

2. A double-sided printing system for continuous forms according to claim 1, wherein said controlling means includes a first control means for stopping printing and paper feeding by said second printer when said amount of retention of said continuous forms falls below said first set value, and a second control means for stopping paper feeding and printing by said first printer when said amount of retention of said continuous forms exceeds said second set value.

3. A double-sided printing system for continuous forms according to claim 1, wherein said controlling means further resumes printing and paper feeding by said second printer when said amount of retention of said continuous forms becomes not less than a predetermined value, and resumes printing and paper feeding by said first printer when the amount of retention of the continuous forms becomes not more than a predetermined value.

4. A double-sided printing system for continuous forms according to claim 1, further comprising a reversing mechanism provided between said first printer and said second printer so as to reverse the surface of said continuous forms.

5. A double-sided printing system for continuous forms according to claim 1, wherein said host apparatus adds blank data for N pages to the end of all the printing data which are to be printed on the first surface and supplies the total data to said first printer, and adds blank data for N pages to the beginning of all the printing data which are to be printed on the second surface and supplies the total data to said second printer in the case of that the number of pages of said continuous forms between the printing positions of said first and second printers is N.

6. A double-sided printing system for continuous forms according to claim 5, wherein said number N is the number of pages of said continuous forms between the printing positions of said first and second printers when said continuous forms are set in said first and second printers.

7. A double-sided printing system for continuous forms according to claim 1, further comprising a means for supplying said number N of pages between said printing positions to said host apparatus.

8. A double-sided printing system for continuous forms according to claim 1, wherein each of said first and second printers includes a start switch for instructing said printer to start printing, a means for informing the other printer of the fact that said start switch is operated when said start switch is operated, and a means for making said printer ready for printing when said start switch of one of said printers is operated.

9. A double-sided printing system for continuous forms according to claim 1, wherein each of said first and second printers includes a stop switch for instructing said printer to stop printing, a means for informing the other printer of the fact that said stop switch is operated when said stop switch is operated during printing, and a means for stopping said printer when said stop switch of either of said printers is operated.

10. A double-sided printing system for continuous forms according to claim 1, wherein each of said first and second printers includes a means for informing the other printer of the fact that printing is impossible by said printer when printing becomes impossible, and a means for stopping said printer when printing becomes impossible in either of said printers.

11. A double-sided printing apparatus for continuous forms for printing on both sides of continuous forms, comprising:

a first printing portion for printing on one side, which is a first surface of said continuous forms;

a second printing portion for printing on the other side, which is a second surface of said continuous forms which are printed by said first printing portion;

a host apparatus for transferring printing data which are to be printed on said first and second surfaces to said first and second printing portions, respectively; and an intermediate buffer device provided between said first and second printing portions so as to absorb a difference in paper feeding speeds between said first and second printing portions.

12. A double-sided printing apparatus for continuous forms for printing on both sides of continuous forms, comprising:

a first printing portion for printing on one side, which is a first surface of said continuous forms;

a second printing portion for printing on the other side, which is a second surface of said continuous forms which are printed by said first printing portion;

a host apparatus for transferring printing data which are to be printed on said first and second surfaces to said first and second printing portions, respectively;

an intermediate buffer device provided between said first and second printing portions so as to absorb a difference in paper feeding speeds between said first and second printing portions;

a detecting portion provided in said intermediate buffer device so as to detect the amount of retention in said intermediate buffer device; and a controller for stopping printing and paper feeding by said second printing portion when said amount of retention falls below a first set value, and stopping paper feeding and printing by said first printing portion when said amount of retention exceeds a second set value.

13. A double-sided printing apparatus for continuous forms for printing on both sides of continuous forms, comprising:

a first printing portion for printing on one side, which is a first surface of said continuous forms;

a second printing portion for printing on the other side, which is a second surface of said continuous forms which are printed by said first printing portion;

a host apparatus for transferring printing data which are to be printed on said first and second surfaces to said first and second printing portions, respectively;

an intermediate buffer device provided between said first and second printing portions so as to absorb a difference in paper feeding speeds between said first and second printing portions;

a detecting portion provided in said intermediate buffer device so as to detect the amount of retention in said intermediate buffer device; and a controller for stopping printing and paper feeding by said second printing portion when said amount of retention falls below a first set value, and stopping paper feeding and printing by said first printing portion when said amount of retention exceeds a second set value, wherein said controller includes a first control means for stopping printing and paper feeding by said second printing portion when said amount of retention falls below said first set value, and a second control means for stopping paper feeding and printing by said first printing portion when said amount of retention exceeds said second set value.

14. A double-sided printing system for continuous forms for printing on both sides of continuous forms by sequentially operating a first printer for printing on one side, which is a first surface of said continuous forms, and a second printer provided at a subsequent stage to said first printer in the direction of paper feeding so as to print on the other side which is a second surface of said continuous forms, said double-sided printing system comprising:

a first counter for counting the amount of feed of said continuous forms on the first printer side after said continuous forms are loaded on said first printer;

a second counter for counting the amount of feed of said continuous forms on the second printer side after said continuous forms are loaded on said second printer; and printing controllers which are provided in said first and second printers so as to be communicable to each other, wherein said printing controller of said first printer supplies the count value N of said first counter at the start of printing on the first surface to said printing controller of said second printer, and said printing controller of said second printer starts printing on the second surface when the count value of said second counter becomes equal to the supplied count value N.

15. A double-sided printing system for continuous forms according to claim 14, wherein said printing controller of said second printer feeds said continuous forms by the amount corresponding to the increment n of said first counter and increases the count value of said second counter by n every time the count value of said first counter increases by n until the count value of said second counter becomes equal to said supplied count value N.

16. A double-sided printing system for continuous forms according to claim 14, wherein said first printer starts printing on the first surface after said continuous forms are set in said first and second printers.

17. A double-sided printing system for continuous forms having a first printer for printing on one side, which is a first surface of said continuous forms, a second printer provided at a subsequent stage to said first printer in the direction of paper feeding so as to print on the other side, which is a second surface of said continuous forms, and a host apparatus for transferring printing data which are to be printed on said first and second surfaces to said first and second printers, respectively, thereby printing on both sides of said continuous forms by sequentially operating said first and second printers, said double-sided printing system comprising:

a first counter for counting the amount of feed of said continuous forms on the first printer side on the basis of the position of said continuous forms at which said continuous forms are loaded on said first printer;

a second counter for counting the amount of feed of said continuous forms on the second printer side on the basis of the position of said continuous forms at which said continuous forms are loaded on said second printers; and printing controllers which are provided in said first and second printers so as to be communicable to each other;

wherein said host apparatus supplies to the first and second printer a double-sided print indication command which indicates that the data supplied thereafter are data for double-sided print or a double-sided print cancellation command which cancels the double-sided print and indicates that the data supplied thereafter are data for single-side printing and, at the time of double-sided printing, said printing controller of said first printer supplies, to said printing controller of said second printer, the count value N of said first counter when said double-sided print indication command is executed, and said printing controller of said second printer feeds said continuous forms by the amount corresponding to the increment n of said first counter and increases the count value of said second counter every time the count value of said first counter increases by n until the count value of said second counter becomes equal to said supplied count value N, and starts printing on the second surface when the count value of said second counter becomes equal to N, while at the time of single-side printing, said printing controller of said second printer feeds said continuous forms by the amount corresponding to the increment n of said first counter and increases the count value of said second counter every time the count value of said first counter increases by n.

18. A double-sided printing system for continuous forms for printing on both sides of continuous forms by sequentially operating a first printer for printing on one side, which is a first surface of said continuous forms, and a second printer provided at a subsequent stage to said first printer in the direction of paper feeding so as to print on the other side, which is a second surface of said continuous forms, said double-sided printing system comprising:

an intermediate buffer device provided between said first and second printers so as to absorb a difference in paper feeding speeds between said first and second printers;

a first counter for counting the amount of feed of sad continuous forms on the first printer side after said continuous forms are loaded on said first printer;

a second counter for counting the amount of feed of said continuous forms on the second printer side after said continuous forms are loaded on said second printer; and printing controllers which are provided in said first and second printers so as to be communicable to each other, and which stop printing and paper feeding by said second printer when the difference, $PC_A$–$PC_B$ between the count value, $PC_A$ of said first counter and the count value, $PC_B$ of said second counter falls below a first set value, and stop printing and paper feeding by said first printer when said difference exceeds a second set value.

19. A double-sided printing system for continuous forms according to claim 18, wherein said printing controllers resume printing and paper feeding by said second printer when said difference, $PC_A$–$PC_B$ in count value becomes not less than a third set value which is larger than said first set value after said second printer stops printing and paper feeding because said difference, $PC_A$–$PC_B$ falls below said first set value, and resume printing and paper feeding by first printer when said difference, $PC_A$–$PC_B$ becomes not more than a fourth set value which is smaller than said second set value after said first printer stops printing and paper feeding because said difference, $PC_A$–$PC_B$ exceeds said second set value.

20. A double-sided printing system for continuous forms according to claim 19, wherein said second printer supplies a feed request to said first printer if said second printer is in course of printing operation when said second printer stops printing and paper feeding because said difference, $PC_A$–$PC_B$ in count value falls below said first set value;

said printing controller of said first printer judges whether or not a predetermined time has passed without receiving the next printing data after receiving a command which indicates the end of printing data, and whether a switch for commanding said second printer to print to the end of the printing data is operated;

said first printer feeds said continuous forms if said predetermined time has passed or said switch is operated after said feed request is issued; and said second printer resumes printing and paper feeding if said difference, $PC_A$–$PC_B$ becomes not less than said third set value.

21. A double-sided printing system for continuous forms according to claim 20, wherein said first printer feeds said continuous forms by the amount which corresponds to the count value n and increases the count value of said first counter by n every time the count value of said second counter increases by n after the resumption of printing and paper feeding by said second printer.

22. A double-sided printing system for continuous forms according to claim 19, wherein said first printer supplies a feed request to said second printer if said first printer is in course of printing operation when said first printer stops printing and paper feeding because said difference, $PC_A-PC_B$ in count value exceeds said second set value;

said printing controller of said second printer judges whether or not a predetermined time has passed without receiving the next printing data after receiving a command which indicates the end of printing data, and whether or not a switch for commanding said first printer to print to the end of the printing data is operated;

said second printer feeds said continuous forms if said predetermined time has passed or said switch is operated after said feed request is issued; and said first printer resumes printing and paper feeding if said difference, $PC_A-PC_B$ becomes not more than said fourth set value.

23. A double-sided printing system for continuous forms according to claim 22, wherein said second printer feeds said continuous forms by the amount which corresponds to the count value n and increases the count value of said second counter by n every time the count value of said first counter increases by n after the resumption of printing and paper feeding by said first printer.

24. A double-sided printing system for continuous forms having a first printer for printing on one side, which is a first surface of said continuous forms, a second printer provided at a subsequent stage to said first printer in the direction of paper feeding so as to print on the other side, which is a second surface of said continuous forms, and a host apparatus for transferring printing data which are to be printed on said first and second surfaces to said first and second printers, respectively, thereby printing on both sides of said continuous forms by sequentially operating aid first and second printers, said double-sided printing system comprising:

first and second printing controllers which are provided in said first and second printers so as to be communicable to each other;

a mark printing means provided in said first printer;

a mark detecting means provided in said second printer;

wherein said mark printing means of said first printer prints a mark on the first surface of said continuous forms; and said printing controller of said second printer begins printing control for the second surface of said continuous forms when said mark detecting means detects said mark.

25. A double-sided printing system for continuous forms according to claim 24, wherein said host apparatus supplies a double-sided print indication command to said first and second printers at the time of double-sided print;

said printing controller of said first printer controls said mark printing means so as to print a mark in accordance with said double-sided print indication command; and said printing controller of said second printer so controls said mark detecting means so as to start detecting said mark in accordance with said double-sided print indication command.

26. A double-sided printing system for continuous forms according to claim 24, further comprising a first counter for counting the amount of feed of said continuous forms on the first printer side after said continuous forms are loaded on said first printer;

a second counter for counting the amount of feed of said continuous forms on the second printer side after said continuous forms are loaded on said second printer;

wherein said printing controller of said second printer feeds said continuous forms by the amount corresponding to the increment n of said first counter and increases the count value of said second counter by n every time the count value of said first counter increases by n until said mark is detected when double-sided print is demanded by said double-sided print indication command, and resumes printing on the second surface when said mark is detected.

27. A double-sided printing system for continuous forms according to claim 24, further comprising:

an intermediate buffer device provided between said first and second printers so as to absorb a difference in paper feeding speeds between said first and second printers;

a first counter for counting the amount of feed of said continuous forms on the first printer side after said continuous forms are loaded on said first printer; and a second counter for counting the amount of feed of said continuous forms on the second printer side after said continuous forms are loaded on said second printer;

wherein said printing controllers stop printing and paper feeding by said second printer when the difference, $PC_A-PC_B$ between the count value, $PC_A$ of said first counter and the count value, $PC_B$ of said second counter falls below a first set value, stop printing and paper feeding by said first printer when said difference exceeds a second set value, resume printing and paper feeding by said second printer when said difference, $PC_A-PC_B$ in count value becomes not less than a third set value which is larger than said first set value after said second printer stops printing and paper feeding because said difference, $PC_A-PC_B$ falls below said first set value, and resume printing and paper feeding by said first printer when said difference, $PC_A-PC_B$ becomes not more than a fourth set value which is smaller than said second set value after said first printer stops printing and paper feeding because said difference, $PC_A-PC_B$ exceeds said second set value.

28. A double-sided printing apparatus for continuous forms for printing on both sides of continuous forms, comprising:

a first printing portion for printing on one side, which is a first surface of said continuous forms;

a second printing portion for printing on the other side, which is a second surface of said continuous forms;

a host apparatus for transferring printing data which are to be printed on the first surface and on the second surface to said first and second printing portions; and a printing controller for distributing said printing data to be printed on the first and second surfaces which are received from said host apparatus to said first and second printing portions, respectively;

wherein said second printing portion includes a bit map memory for storing dot printing image data for N pages which are the number of pages of said continuous forms between the printing positions of said first and second printing portions, and said printing controller instructs said second printing portion to start printing on the second surface after said first printer prints N pages on the first surface of said continuous forms.

29. A double-sided printing apparatus for continuous forms according to claim 28, wherein said printing controller instructs said first printing portion to start printing a first page on the first surface, and said second printing portion to warm up an image forming portion thereof;

said first printing portion starts printing after warming up an image forming portion thereof; and said second printing portion warms up said image forming portion and waits for a printing command, and when said printing command is issued from said printing controller, said second printing portion starts printing without the need for warm-up.

30. A double-sided printing apparatus for continuous forms according to claim 28, further comprising a paper buffer including an adjusting means for adjusting a distance between printing positions of said first printing portion and said second printing portion to be equal to n times of the length of one page even if the length of one page is changed, n being an integer.

31. A double-sided printing apparatus for continuous forms according to claim 28, wherein said printing data transferred from said host apparatus are alternately distributed to said first and second printing portions in a double-sided printing mode.

32. A double-sided printing apparatus for continuous forms according to claim 28, wherein when said printing data transferred from said host apparatus contain a print skip command and the data designating a printing surface, said print skip command is converted into blank printing data, and the total printing data are alternately distributed to said first and second printing portions in said double-sided printing mode.

33. A double-sided printing apparatus for continuous forms according to claim 28, wherein said printing data transferred from said host apparatus are input to said first printing portion in a single-side printing mode for printing only on a first surface.

34. A double-sided printing apparatus for continuous forms according to claim 28, wherein said printing data transferred from said host apparatus are input to said second printing portion in a single-side printing mode for printing only on a second surface.

* * * * *